US008215033B2

(12) United States Patent
Carboy et al.

(10) Patent No.: US 8,215,033 B2
(45) Date of Patent: Jul. 10, 2012

(54) ARTICLE OF FOOTWEAR FOR SNOWBOARDING

(75) Inventors: Shawn G. Carboy, Portland, OR (US); Stephen D. Pelletier, Jr., Portland, OR (US)

(73) Assignee: NIKE, Inc., Beaverton, OR (US)

( * ) Notice: Subject to any disclaimer, the term of this patent is extended or adjusted under 35 U.S.C. 154(b) by 485 days.

(21) Appl. No.: 12/424,804

(22) Filed: Apr. 16, 2009

(65) Prior Publication Data

US 2010/0263236 A1 Oct. 21, 2010

(51) Int. Cl.
*A43C 5/00* (2006.01)
*A43B 7/20* (2006.01)

(52) U.S. Cl. ..... 36/50.1; 36/45; 36/117.1

(58) Field of Classification Search ..... 36/45, 88, 36/93, 47, 51, 50.1, 117.1, 115
See application file for complete search history.

(56) References Cited

U.S. PATENT DOCUMENTS

| | | | | |
|---|---|---|---|---|
| 888,994 | A | | 5/1908 | Gilman |
| 3,546,796 | A | | 12/1970 | Adams |
| 4,329,790 | A | | 5/1982 | Bell |
| 4,366,634 | A | | 1/1983 | Giese et al. |
| 4,453,727 | A | | 6/1984 | Bourque |
| 4,538,367 | A | | 9/1985 | Adams |
| 4,783,910 | A | | 11/1988 | Boys, II et al. |
| 4,835,885 | A | | 6/1989 | Hoshizaki et al. |
| 4,882,856 | A | | 11/1989 | Glancy |
| 5,243,772 | A | | 9/1993 | Francis et al. |
| 5,345,628 | A | * | 9/1994 | Keefer ..... 5/682 |
| D351,058 | S | | 10/1994 | Hatfield et al. |
| 5,370,133 | A | | 12/1994 | Darby et al. |
| 5,377,430 | A | | 1/1995 | Hatfield et al. |
| 5,732,483 | A | | 3/1998 | Cagliari |
| 5,761,835 | A | | 6/1998 | Okajima |
| 5,771,608 | A | | 6/1998 | Peterson |
| D399,283 | S | | 10/1998 | Rench |
| D399,284 | S | | 10/1998 | Rench |
| 5,819,440 | A | | 10/1998 | Okajima |
| D400,693 | S | | 11/1998 | Rench |
| D404,078 | S | | 1/1999 | Meibock et al. |
| 5,909,946 | A | | 6/1999 | Okajima |
| D411,757 | S | | 7/1999 | Rench et al. |
| 5,979,080 | A | | 11/1999 | Borsoi |

(Continued)

FOREIGN PATENT DOCUMENTS

DE 142641 1/1902

(Continued)

OTHER PUBLICATIONS

The International Search Report and the Written Opinion of the International Searching Authority, or The Declaration mailed Nov. 19, 2010 in PCT Application No. PCT/US2010/031004.

(Continued)

*Primary Examiner* — Jila Mohandesi
(74) *Attorney, Agent, or Firm* — Plumsea Law Group, LLC

(57) ABSTRACT

An article of footwear for use in sporting activities such as snowboarding is disclosed. The article of footwear can include a flex notch and a coupled lace loop design. The article can further include an internal harness to enhance stability of the foot. The article can also include a threading layer configured to strengthen the upper and a corresponding connecting layer to bond the threading layer to the upper and to provide protection to other areas of the upper.

28 Claims, 29 Drawing Sheets

U.S. PATENT DOCUMENTS

| | | | | |
|---|---|---|---|---|
| 5,992,057 | A | 11/1999 | Monti | |
| 6,000,704 | A | 12/1999 | Balbinot et al. | |
| 6,073,370 | A | 6/2000 | Okajima | |
| 6,102,412 | A | 8/2000 | Staffaroni | |
| 6,119,372 | A | 9/2000 | Okajima | |
| 6,170,175 | B1 * | 1/2001 | Funk | 36/89 |
| 6,295,679 | B1 | 10/2001 | Chenevert | |
| 6,298,582 | B1 | 10/2001 | Friton et al. | |
| 6,305,103 | B1 | 10/2001 | Camargo | |
| 6,382,641 | B2 | 5/2002 | Dennis et al. | |
| 6,399,962 | B1 | 6/2002 | Kim | |
| 6,499,233 | B1 | 12/2002 | Chenevert | |
| 6,519,877 | B2 | 2/2003 | Oetting et al. | |
| 6,533,885 | B2 | 3/2003 | Davis et al. | |
| 6,574,887 | B2 | 6/2003 | Jones et al. | |
| 6,601,042 | B1 | 7/2003 | Lyden | |
| 6,701,644 | B2 * | 3/2004 | Oorei et al. | 36/129 |
| 6,726,225 | B1 | 4/2004 | Stewart et al. | |
| 6,748,676 | B1 | 6/2004 | Chenevert | |
| 6,851,682 | B2 | 2/2005 | Durocher | |
| 6,922,919 | B2 | 8/2005 | Chenevert | |
| D516,793 | S | 3/2006 | Sedlbauer | |
| D517,304 | S | 3/2006 | Sedlbauer | |
| D517,305 | S | 3/2006 | Sedlbauer | |
| 7,016,867 | B2 | 3/2006 | Lyden | |
| 7,028,420 | B2 | 4/2006 | Tonkel | |
| 7,086,179 | B2 | 8/2006 | Dojan et al. | |
| 7,086,180 | B2 | 8/2006 | Dojan et al. | |
| 7,107,235 | B2 | 9/2006 | Lyden | |
| 7,325,337 | B2 | 2/2008 | Cox et al. | |
| 7,331,363 | B2 | 2/2008 | Lanzi | |
| 7,401,420 | B2 | 7/2008 | Dojan et al. | |
| 7,546,698 | B2 * | 6/2009 | Meschter | 36/45 |
| 7,587,841 | B2 * | 9/2009 | Culpepper | 36/89 |
| 2003/0154627 | A1 | 8/2003 | Hirayama | |
| 2004/0020081 | A1 | 2/2004 | Symons et al. | |
| 2004/0181972 | A1 * | 9/2004 | Csorba | 36/50.1 |
| 2005/0132609 | A1 | 6/2005 | Dojan et al. | |
| 2005/0284001 | A1 | 12/2005 | Hoffman et al. | |
| 2006/0137221 | A1 | 6/2006 | Dojan et al. | |
| 2007/0068043 | A1 | 3/2007 | Clark et al. | |
| 2007/0107264 | A1 | 5/2007 | Meschter et al. | |
| 2007/0175576 | A1 | 8/2007 | Dojan et al. | |
| 2007/0227045 | A1 | 10/2007 | Aveni et al. | |
| 2007/0271821 | A1 | 11/2007 | Meschter | |
| 2007/0271822 | A1 | 11/2007 | Meschter | |
| 2007/0271823 | A1 | 11/2007 | Meschter | |
| 2008/0000106 | A1 * | 1/2008 | Culpepper | 36/89 |
| 2008/0022554 | A1 | 1/2008 | Meschter et al. | |
| 2008/0086915 | A1 | 4/2008 | Cox et al. | |
| 2008/0110048 | A1 | 5/2008 | Dua et al. | |
| 2008/0110049 | A1 | 5/2008 | Sokolowski et al. | |
| 2008/0201983 | A1 | 8/2008 | Dojan et al. | |
| 2008/0201984 | A1 | 8/2008 | Dojan et al. | |
| 2008/0201985 | A1 | 8/2008 | Dojan et al. | |
| 2008/0222917 | A1 | 9/2008 | Dojan et al. | |

FOREIGN PATENT DOCUMENTS

| | | |
|---|---|---|
| EP | 0821889 | 2/1998 |
| FR | 2457651 | 12/1980 |
| FR | 2694167 | 2/1994 |
| JP | 1008903 | 1/1989 |
| JP | 1008904 | 1/1989 |
| WO | WO 98/43506 | 10/1998 |

OTHER PUBLICATIONS

International Preliminary Report on Patentability (including Written Opinion of the ISA) mailed Oct. 27, 2011 in International Application No. PCT/US2010/031004.

Invitation to Pay Additional Fees mailed Sep. 10, 2010 in PCT Application No. PCT/US2010/031004.

* cited by examiner

ARTICLE OF FOOTWEAR FOR SNOWBOARDING

BACKGROUND OF THE INVENTION

1. Field of the Invention

The present invention relates to an article of footwear, and in particular to a boot for use in snowboarding.

2. Description of Related Art

Articles of footwear for use in sporting activities, such as snowboarding, have been previously proposed. Some designs for snowboarding boots have previously been focused on provisions for increasing the durability of one or more portions of the upper or sole. Some other designs have been focused on provisions to attach a snowboard boot to bindings of a snowboard.

Some previous designs for articles have taught features for increasing flexibility of a component of the article. Francis et al. (U.S. Pat. No. 5,243,772) teaches a shoe with an external shell. Francis teaches a shoe with a sole, a sock attached to the sole and a form-retaining shell attached to the sole and not attached to the sock above the region of the sole, such that the sole may be flexible during use. Francis teaches a notch that enables the sole to flex in use. Francis also teaches an embodiment of the article with a gap that serves the same purpose of the notch (i.e. to allow the sole to flex during use). In another embodiment, Francis teaches that the notch is partially or wholly replaced by a flexible corrugated or bellow portion having a relatively thin, fan-like cross-section which may be molded into the shell.

Adams (U.S. Pat. No. 3,546,796) teaches a special sport shoe for people with high insteps. Adams teaches a shoe with an upper vamp section that is provided with V-shaped slits or openings, one on each side of the vamp. In addition, Adams teaches that in cases where the manufacturer desires to adapt the invention to somewhat more formal shoes for persons with high insteps, the V-shaped openings could be filled with an elastic gusset or other ornamental devices to cover the separation of the vamp portion of the shoe into upper and lower vamps.

Other designs for articles have taught provisions for lacing an article using lace loops. Sokolowski et al. (U.S. patent application publication number 2008/0110049) teaches an article of footwear having a flat knit upper construction. Sokolowski teaches an article of footwear that includes a sole structure and an upper. The article includes a textile element including four channels. The channels are formed from two at least partially coextensive layers of the material forming textile element.

Sokolowski also teaches lace elements that receive a lace. The lace elements include loops. In addition, the lace elements extend through the channels. The loops are positioned to extend outward from upper portions of the channels. The materials that can be used for the textile element include cotton and wool fibers, natural filaments such as silk, and synthetic filaments that include nylon, rayon, polyester and acrylic. Elastane fibers can provide substantial stretch and recoverability.

Lanzi (U.S. Pat. No. 7,331,363) teaches a textile weave of inelastic and elastic fiber forming an elastic weave with one or more rigid loops. The lace loop is made of inelastic fiber, which is connected to the inelastic-elastic weave, which is further connected to another inelastic fiber, which is then connected to the shoe. When the lace is tightened, the elastic-inelastic part stretches, but the loop does not.

Friton (U.S. Pat. No. 6,298,582) teaches an article of footwear with a heel clip. Friton teaches non-stretch lace engaging elements that may be made from nylon. The lace engaging elements include a first end containing eyelets, lace loops, or the like, and a second end that is fixedly attached to the side panel of the upper. The side panels may be flexible and may be made from a flexible mesh. Because of the flexibility of the side panels, the lace engaging elements are pulled upwardly and inwardly as the lace is tightened. Friton also teaches flexible straps that can be applied against the side panels, and in some cases can wrap over to tighten from one side to another.

Monti (U.S. Pat. No. 5,992,057) teaches a strapping closure system for an article of footwear. Monti teaches instep straps that are fixedly attached to second ends. The instep straps each have a loop at one end for receiving a lace. The instep straps are disposed through slits in the midfoot area of the upper. The instep straps are not attached to the upper so they can be tightened independently of the upper. Instead, the instep straps are attached to instep pieces.

Hatfield et al. (U.S. Pat. No. 5,377,430) teaches a shoe with an elastic closure system. Hatfield teaches a shoe in which elastic material is secured along the base of the upper on the medial and lateral sides of the shoe. A plurality of straps are separately and independently attached at their lower end to the elastic material. The straps are made of a substantially inelastic material. Lace openings are positioned at the upper ends of the straps. As the lace is drawn, the straps are tightened around the foot to place the elastic material disposed along the medial and lateral sides of the foot under tension. See the abstract.

Hatfield teaches an upper with medial straps and lateral straps. The straps are connected by web portions. Hatfield also teaches an elastic material including a first portion and a second portion disposed on the medial and lateral sides, respectively. Hatfield also teaches upper edges for the portions.

Hatfield teaches an inner sleeve including an outer layer made of a stretchable material, for example, neoprene, and an inner layer made of a stretchable material. Hatfield teaches the use of Lycra. The outer layer and inner layer are stitched together at their top ends around foot opening.

Articles with structural elements formed of threads have also been previously proposed. Meschter (U.S. patent application publication number 2007/0271823) teaches an article of footwear having an upper with thread structural elements.

SUMMARY

The invention discloses an article of footwear for use in sporting activities such as snowboarding. In one aspect, the invention provides an article of footwear, comprising: an upper comprising a lower portion corresponding to a foot and an upper portion corresponding to an ankle of the foot; a lacing region extending through the lower portion and the upper portion; a flex notch extending from the lacing region towards a heel portion of the upper; an elastic portion extending through a portion of the lacing region; and wherein the elastic portion extends between a first edge and a second edge of the flex notch.

In another aspect, the invention provides an article of footwear, comprising: an upper comprising a lower portion corresponding to a foot and an upper portion corresponding to an ankle of the foot; a lacing region extending through the lower portion and the upper portion; a flex notch extending from the lacing region towards a heel portion of the upper; the flex notch being disposed between the lower portion and the upper portion; a lace loop configured to receive a lacing member associated with the lacing region; the lace loop including a first end portion, a second end portion and an intermediate portion disposed between the first end portion and the second end portion; the first end portion being attached to the upper portion and the second end portion being attached to the lower portion; and wherein the intermediate portion spans between the flex notch.

In another aspect, the invention provides an article of footwear, comprising: an upper comprising a lower portion corresponding to a foot and an upper portion corresponding to an ankle of the foot; a lacing region extending through the lower portion and the upper portion; a flex notch extending from a lacing region towards a heel portion of the upper; an elastic portion extending through a portion of the lacing region, the elastic portion extending between a first edge and a second edge of the flex notch; a lace loop configured to receive a lacing member associated with the lacing region; the lace loop including a first end portion, a second end portion and an intermediate portion disposed between the first end portion and the second end portion; the first end portion being attached to the upper portion and the second end portion being attached to the lower portion; and wherein the intermediate portion spans the flex notch.

In another aspect, the invention provides an article of footwear, comprising: an upper including a lacing region; an elastic portion configured to attach to an edge of the lacing region; at least one lace loop including a first end portion and a second end portion, the first end portion and the second end portion being attached to the edge of the lacing region; and wherein a portion of the elastic portion is disposed between the first end portion and the second end portion of the at least one lace loop.

In another aspect, the invention provides an article of footwear, comprising: an upper including a lacing region; an elastic portion configured to attach to an edge of the lacing region; the elastic portion including an exterior portion facing outwardly on the upper and an interior portion facing inwardly on the upper, the elastic portion further including an upper edge that separates the exterior portion from the interior portion; a lace loop including a first end portion and a second end portion attached to the edge of the lacing region; the lace loop including an intermediate portion disposed between the first end portion and the second end portion; and wherein the intermediate portion is configured to wrap around the upper edge of the elastic portion.

In another aspect, the invention provides an article of footwear, comprising: an upper including a lacing region; an elastic portion configured to attach to an edge of the lacing region; a first lace loop attached to an edge of the lacing region and a second lace loop attached to the edge of the lacing region; the elastic portion extending through the first lace loop and the second lace loop; and wherein the elastic portion includes an intermediate portion that extends between the first lace loop and the second lace loop.

In another aspect, the invention provides an article of footwear, comprising: a harness, the harness including a base layer and a threading layer, the threading layer configured to attach to the base layer; the threading layer comprising threads arranged in a first thread group and a second thread group; the first thread group including a first end portion and a second end portion, wherein the threads extend radially outward from the first end portion to the second end portion; the second thread group including a third end portion and a fourth end portion, wherein the threads extend radially outward from the third end portion to the fourth end portion; the first end portion of the first thread group being substantially spaced apart from the third end portion of the second thread group by a thread gap; and wherein the base layer includes a notch associated with the thread gap.

In another aspect, the invention provides an article of footwear, comprising: a harness, the harness including a base layer and a threading layer, the threading layer configured to attach to the base layer; the threading layer comprising threads arranged in a first thread group and a second thread group; the first thread group including a first end portion and a second end portion, wherein the threads extend radially outward from the first end portion to the second end portion; the second thread group including a third end portion and a fourth end portion, wherein the threads extend radially outward from the third end portion to the fourth end portion; the first thread group including a first side edge extending from the first end portion of the first thread group to the second end portion of the first thread group; the second thread group including a second side edge extending from the third end portion of the second thread group to the fourth end portion of the second thread group; the threading layer including a thread gap disposed between the first side edge and the second side edge; and wherein the base layer includes a notch that extends between the first side edge and the second side edge.

In another aspect, the invention provides an article of footwear, comprising: a harness, the harness including a base layer and a threading layer, the threading layer configured to attach to the base layer; the harness further including a peripheral layer that is configured to attach to an outer peripheral portion of the base layer; the peripheral layer including a first tab portion including a first lace loop and a second tab portion including a second lace loop; the first tab portion being connected to the second tab portion by a segment; the threading layer comprising a plurality of threads arranged in a first thread group and a second thread group; a first end portion of the first thread group extending to the first tab portion of the peripheral layer and a second end portion of the second thread group extending to the second tab portion of the peripheral layer; the first end portion of the first thread group being spaced apart from the second end portion of the second thread group by a thread gap; and wherein the segment of the peripheral layer has a shape that corresponds to the thread gap.

In another aspect, the invention provides an article of footwear, comprising: a harness, the harness including a base layer and a threading layer, the threading layer configured to attach to the base layer; the harness further including a peripheral layer; the threading layer comprising a plurality of threads arranged in a thread group; the thread group including an end portion disposed adjacent to an edge of the base layer; and wherein the threads of the end portion are disposed between the peripheral layer and the base layer.

In another aspect, the invention provides an article of footwear, comprising: a harness, the harness including a base layer and a threading layer, the threading layer configured to attach to the base layer; the base layer including a central portion and an outer peripheral portion extending around the central portion; the threading layer extending through the central portion of the base layer; a peripheral layer disposed adjacent to the base layer; and wherein the peripheral layer is configured to confront the outer peripheral portion of the base layer.

In another aspect, the invention provides an article of footwear, comprising: a harness, the harness including a base layer and a threading layer, the threading layer configured to attach to the base layer; the harness further including a peripheral layer; the peripheral layer including at least one lace loop; and wherein at least one lace loop is bonded to a tab portion of the peripheral layer and wherein the tab portion comprises a polymer material.

In another aspect, the invention provides an article of footwear, comprising: a base layer configured to form an upper, the upper including a forefoot portion, a heel portion and a midfoot portion disposed between the forefoot portion and the heel portion; a threading layer including at least one thread group disposed on the base layer in the midfoot portion, the threading layer including an outer perimeter; a connecting layer configured to bond the threading layer to the base layer; the connecting layer including a first portion and a second portion; and wherein the first portion is configured to cover the threading layer and wherein the second portion is configured to extend away from the threading perimeter of the threading layer.

In another aspect, the invention provides an article of footwear, comprising: a base layer configured to form an upper, the upper including a forefoot portion, a heel portion and a midfoot portion disposed between the forefoot portion and the heel portion; a threading layer including a first thread group disposed on a side of the midfoot portion; a connecting layer including a first side portion and a forward portion; and wherein the first side portion corresponds to the first thread group and wherein the forward portion corresponds to a toe portion of the forefoot portion.

In another aspect, the invention provides an article of footwear, comprising: a base layer configured to form an upper, the upper including a forefoot portion, a heel portion and a midfoot portion disposed between the forefoot portion and the heel portion; a threading layer including a first thread group disposed on a medial side of the midfoot portion and the threading layer including a second thread group disposed on a lateral side of the midfoot portion; a connecting layer including a first side portion and a second side portion; and wherein the first side portion corresponds to the first thread group and the second side portion corresponds to the second thread group.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE DRAWINGS

Figure 1:
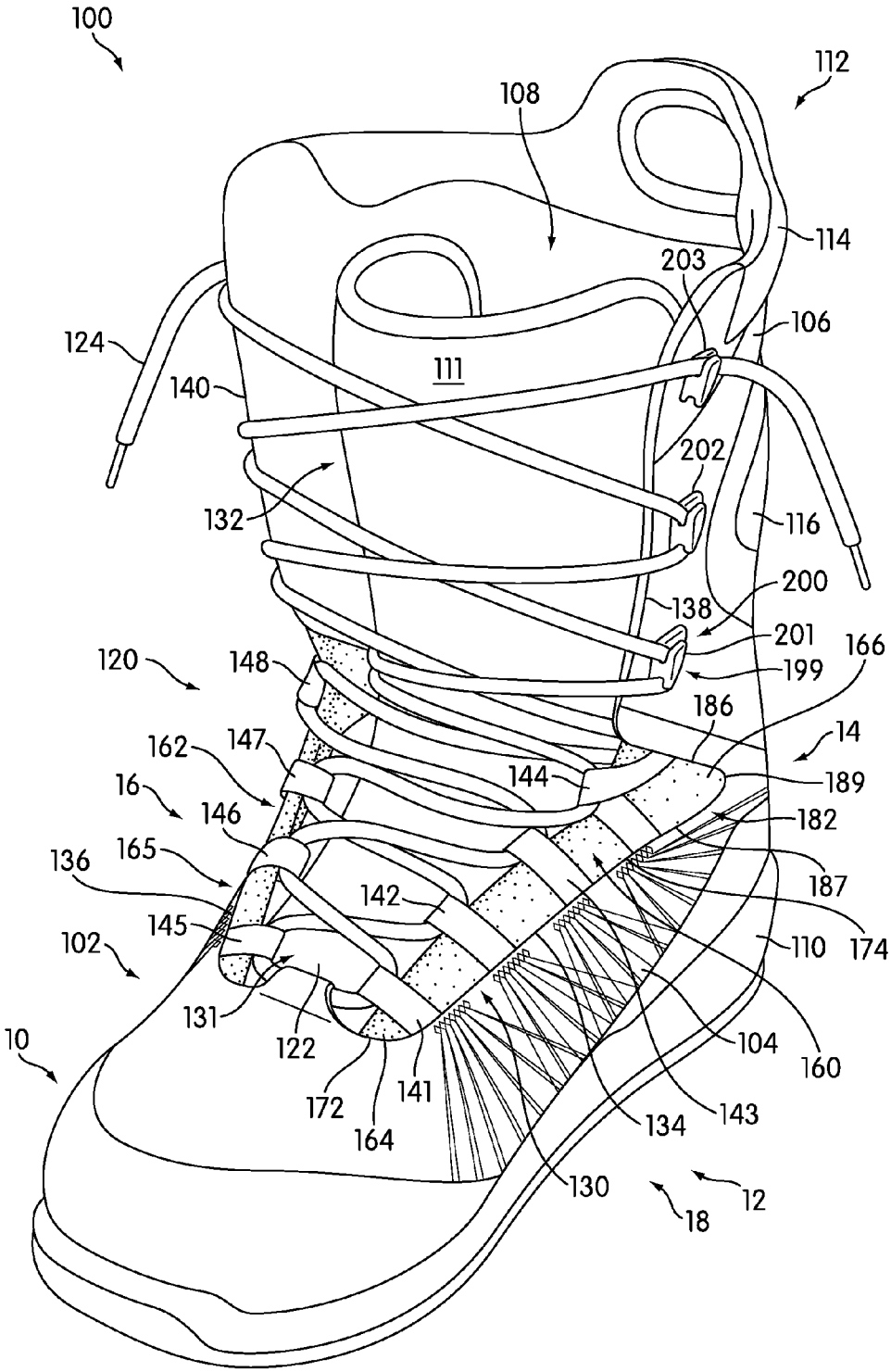
FIG. 1 is an isometric view of an exemplary embodiment of an article of footwear.
Figure 2:
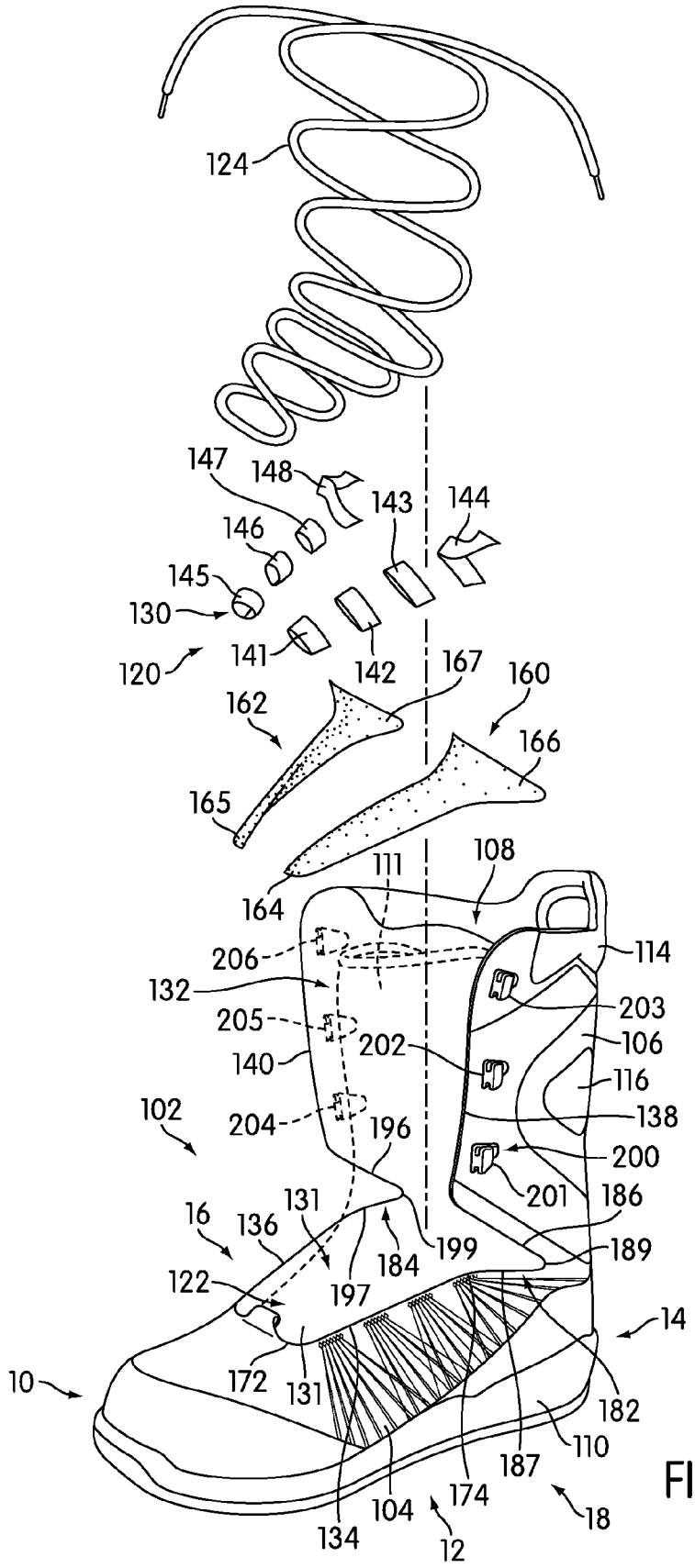
FIG. 2 is an exploded isometric view of an exemplary embodiment of an article of footwear.

FIGS. 1-2 illustrate an exemplary embodiment of article of footwear 100. In particular, FIG. 1 illustrates an isometric view of an exemplary embodiment of article of footwear 100 and FIG. 2 illustrates an exploded isometric view of an exemplary embodiment of article of footwear 100. For clarity, the following detailed description discusses an exemplary embodiment, in the form of a boot, but it should be noted that the present invention could take the form of any article of footwear including, but not limited to: hiking boots, soccer shoes, football shoes, sneakers, rugby shoes, baseball shoes as well as other kinds of shoes. Furthermore, the exemplary embodiments illustrate a boot configured to be used for snowboarding, however, in other embodiments the boot could be used for other activities such as hiking, skiing, or any other type of activity in which boots may be used. As shown in FIGS. 1-2, article of footwear 100, also referred to simply as article 100, can be used with a right foot. It is understood that the following discussion may equally apply to a mirror image of article of footwear 100 that can be used with a left foot. Features discussed herein may apply equally well for an article of footwear configured for use with a left foot or for a right foot. However, some features discussed herein or configurations shown may provide particular advantages an article of footwear configured for use with either a left foot or a right foot, such as a snowboard boot arranged for use as the lead boot for a user having an left or goofy foot stance.

For purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

Article 100 can include upper 102 and sole structure 110. Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

In embodiments where article of footwear 100 is a snowboard boot, sole structure 110 can include provisions for interacting with a snowboard. For example, in some cases, sole structure 110 can include features for receiving, and fastening to, bindings on a snowboard. Furthermore, sole structure 110 can include traction members to enhance grip between article 100 and a snowboard. For purposes of clarity, sole structure 110 is shown without any particular features for associating with a snowboard, but it will be understood that in different embodiments any such provisions known in the art can be used.

Upper 102 is configured to receive a foot of a wearer of article 100. Generally, upper 102 may be any type of upper. In particular, upper 102 could have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. In an exemplary embodiment, upper 102 has the shape of a boot upper that completely covers a foot and provides additional coverage at an ankle.

In one embodiment, upper 102 may be provided with lower portion 104 and upper portion 106. In some cases, lower portion 104 may be associated with, and configured to receive, the toes, arch and heel of a foot. Upper portion 106 may extend upwards from lower portion 104. In some cases, upper portion 106 can be associated with an ankle of a foot. In an exemplary embodiment, upper portion 106 may be a cuff portion for upper 102.

Upper 102, including both lower portion 104 and upper portion 106, may define a void in article 100 for receiving and securing the foot relative to sole structure 110. In particular, the void is shaped to accommodate a foot and extends along the lateral side of the foot, along the medial side of the foot, over the foot and under the foot. In some cases, upper 102 may be provided with entry hole 108 that provides access to the void. In an exemplary embodiment, entry hole 108 may be provided at upper end portion 112 of upper portion 106.

Upper 102 may include provisions for enhancing the durability and appearance of article 100. In some embodiments, upper 102 may include first padded portion 114. In some cases, first padded portion 114 may be disposed adjacent to entry hole 108. In an exemplary embodiment, first padded portion 114 may extend around a substantial majority of the perimeter of entry hole 108. This arrangement can facilitate cushioning at a top edge of upper 102 to enhance comfort as a foot is inserted or removed from article 100.

In addition, upper 102 can include second padded portion 116. In some embodiments, second padded portion 116 can be disposed adjacent to an ankle of the foot in order to provide cushioning for the ankle. In some cases, second padded portion 116 can be disposed on medial side 18. In other cases, however, second padded portion 116 can be disposed on lateral side 16. In still other cases, second padded portion 116 can be provided on both lateral side 16 and medial side 18 of upper 102. With this arrangement, second padded portion 116 can provide additional protection for the ankle of a user.

Article 100 can include lacing system 120 for purposes of adjusting upper 102. In some cases, lacing system 120 can extend from forefoot portion 10 through midfoot portion 12 of article 100. Furthermore, in some cases, lacing system 120 can extend through lower portion 104 and upper portion 106 of upper 102. In particular, lacing system 120 may be associated with lacing region 122 that is disposed between lateral side 16 and medial side 18 of upper 102.

In some embodiments, upper 102 includes lower gap 131 and upper gap 132. In some cases, lower gap 131 may span between lower medial edge 134 and lower lateral edge 136 of lower portion 104. Likewise, upper gap 132 may span between upper medial edge 138 and upper lateral edge 140. In an exemplary embodiment, lacing system 120 can include provisions for changing the sizes of lower gap 131 and upper gap 132 in order to adjust the size of upper 102 and thereby tighten or loosen upper 102 around a foot.

In some embodiments, upper 102 may include tongue 111 that extends through lacing region 122. In some cases, tongue 111 may be integrally formed with upper 102. In other cases, however, tongue 111 may be a separate component from upper 102 and may be attached to upper 102 using conventional methods such as stitching or adhesives.

In some embodiments, lacing system 120 can include lacing member 124. The term 'lacing member', as used throughout this detailed discussion, refers to any type of lace that may be used with an article of footwear. Generally, the size, including cross sectional shape and length, of lacing member 124 may be varied. Also, lacing member 124 may be made of any material, including, but not limited to: various types of natural and/or synthetic fibers, as well as other types of materials that may be used as laces. Furthermore it should be understood that although a single lacing member is shown in this preferred embodiment, other embodiments may incorporate more than one lace.

In some embodiments, lacing system 120 may include provisions for securing lacing member 124 to various portions of upper 102. In some embodiments, lacing system 120 may include lace receiving members configured to receive portions of lacing member 124. In other words, these lace receiving members may function in a similar manner to traditional eyelets. In different embodiments, different types of lace receiving members may be used. Examples of different lace receiving members include but are not limited to: eyelets, hooks, lace loops, as well as other types of lace receiving members.

In some embodiments, lacing system 120 may include lace hook set 200. In particular, lace hook set 200 can include first lace hook 201, second lace hook 202 and third lace hook 203 that are associated with upper medial edge 138 of upper 102. In addition, lace hook set 200 can include fourth lace hook 204, fifth lace hook 205 and sixth lace hook 206 that are associated with upper lateral edge 140 of upper 102. In an exemplary embodiment, first lace hook 201, second lace hook 202, third lace hook 203, fourth lace hook 204, fifth lace hook 205 and sixth lace hook 206 are traditional types of lace hooks. Generally, lace hooks of lace hook set 200 can have any shape that is configured to receive lacing member 124 for the purposes of tightening upper medial edge 138 and upper lateral edge 140. It will be understood that in other embodiments different types of lacing guides could be used in place of lace hooks.

In an exemplary embodiment, lacing system 120 may include lace loop set 130 that is associated with lower medial edge 134 and lower lateral edge 136. In particular, lace loop set 130 can include first lace loop 141, second lace loop 142, third lace loop 143 and fourth lace loop 144 that are associated with lower medial edge 134. In addition, lace loop set 130 can include fifth lace loop 145, sixth lace loop 146, seventh lace loop 147 and eighth lace loop 148 that are associated with lower lateral edge 136. Using lace loop set 130, lacing member 124 can be configured to tighten lower portion 104 of upper 102.

In different embodiments, the geometry of one or more lace loops can vary. As illustrated in FIG. 2, each lace loop of lace loop set 130 may have a substantially rectangular shape. In other embodiments, however, the shape of one or more lace loops can vary. In addition, each of the lace loops in the current embodiment have lengths that vary in a generally longitudinal direction along lacing region 122. In particular, first lace loop 141 and fifth lace loop 145 are generally smaller than the remaining lace loops. Likewise, fourth lace loop 144 and eighth lace loop 148 are generally larger than the remaining lace loops. Furthermore, the lengths of second lace loop 142, third lace loop 143, sixth lace loop 146 and seventh lace loop 147 increase from forefoot portion 10 towards heel portion 14. It will be understood, however, that in different embodiments the length of each lace loop of lace loop set 130 can vary.

An article can be provided with provisions for enhancing the flexibility between an upper portion and a lower portion of an upper. For example, in cases where an upper includes an upper portion that wraps around an ankle, an article can include provisions to allow the ankle to move forwards and rearwards with respect to the foot. In an exemplary embodiment, an article can include one or more flex notches that are configured to facilitate increased flexibility for a cuff of an upper, which can facilitate leaning forwards and rearwards during snowboarding maneuvers.

Referring to FIGS. 1-2, article 100 includes first flex notch 182 and second flex notch 184 disposed on medial side 18 and lateral side 16, respectively. In one embodiment, first flex notch 182 has an approximately triangular shape. In particular, first flex notch 182 includes first edge 186, which is associated with upper portion 106. Also, first flex notch 182 can include second edge 187, which is associated with lower portion 104. Furthermore, first edge 186 may extend from upper medial edge 138 in a rearwards direction towards heel portion 14. Likewise, second edge 187 may extend from lower medial edge 134 towards heel portion 14. In some cases, first edge 186 and second edge 187 may be joined at first vertex portion 189. In an exemplary embodiment, first edge 186 and second edge 187 are disposed at an acute angle with respect to one another. With the arrangement, first flex notch 182 may be configured to facilitate movement between upper portion 106 and lower portion 104 on medial side 18.

In a similar manner, second flex notch 184 may be configured with a shape that facilitates enhanced flexibility of lateral side 16 of upper 102. In one embodiment, second flex notch 184 also has an approximately triangular shape. In particular, second flex notch 184 may include third edge 196, which is associated with upper portion 106. Also, second flex notch 184 can include fourth edge 197, which is associated with lower portion 104. Furthermore, third edge 196 may extend from upper lateral edge 140 in a rearwards direction towards heel portion 14. Likewise, fourth edge 197 may extend from lower lateral edge 136 towards heel portion 14. In some cases, third edge 196 and fourth edge 197 may be joined at second vertex portion 199. In an exemplary embodiment, third edge 196 and fourth edge 197 are disposed at an acute angle with respect to one another. With the arrangement, second flex notch 184 may be configured to facilitate movement between upper portion 106 and lower portion 104 on lateral side 16.

It will be understood that the location of one or more flex notches can vary in different embodiments. In other embodiments, a flex notch could be disposed closer to a toe portion of an upper in order to facilitate increased flexibility at the middle of an upper. In still other embodiments, a flex notch could be disposed closer to an entry hole of an upper to facilitate increased flexibility at a high ankle portion of an upper.

Furthermore, the geometry of one or more flex notches can vary in different embodiments. In one embodiment, the angle formed between a first edge and a second edge of a flex notch can be in the range between 10 degrees and 50 degrees. In an exemplary embodiment, the angle formed between a first edge and a second edge of a flex notch can be in the range between 20 degrees and 40 degrees. In other embodiments, the angle could be less than 10 degrees or greater than 50 degrees. In another embodiment, for example, the angle formed between a first edge and a second edge of a flex notch could be an approximately right angle. In still other embodiments, the angle formed between a first edge and a second edge could be an obtuse angle.

It will also be understood that the shape of a flex notch is not limited to an approximately triangular shape. In other embodiments, a flex notch could be configured with any other kind of shape including, but not limited to: rectangular shapes, oval-like shapes, rounded shapes, polygonal shapes, irregular shapes, as well as any other type of shape.

In addition, while the current embodiment includes two flex notches disposed on the medial and lateral sides of the upper, other embodiments could include any number of flex notches. For example, in another embodiment, a flex notch could be provided on only a medial side or lateral side of the upper. In other embodiments, either the medial or lateral side of the upper can be provided with two or more flex notches.

An article of footwear can include provisions for controlling the flexibility of a lacing region. In some cases, an article can be provided with a layer of material that extends through a portion of the lacing region. In an exemplary embodiment, the article can include an elastic layer that extends through a portion of the lacing region.

Article 100 can include first elastic portion 160 and second elastic portion 162. Generally, first elastic portion 160 can have any shape. In some cases, first elastic portion 160 can be configured to extend through a portion of lacing region 122. In particular, first portion 164 of first elastic portion 160 may be configured to extend from first end portion 172 to second end portion 174 along medial side 18 of lacing region 122. In a similar manner, first portion 165 of second elastic portion 162 may extend from first end portion 172 to second end portion 174 along lateral side 16 of lacing region 122. With this arrangement, first elastic portion 160 and second elastic portion 162 may enhance the flexibility of lacing region 122 in order to help upper 102 conform to a foot for a better fit.

In some embodiments, an elastic portion can be further associated with a flex notch in order to provide increased stability for the flex notch. In the current embodiment, first elastic portion 160 may include second portion 166. In some cases, second portion 166 of first elastic portion 160 may be configured to extend into first flex notch 182. Additionally, second elastic portion 162 may include second portion 167. In some cases, second portion 167 of second elastic portion 162 may be configured to extend into second flex notch 184. With this arrangement, the flexibility of first flex notch 182 and second flex notch 184 can be fine tuned.

In different embodiments, the size and shape of each elastic portion can vary. For example, in another embodiment, first elastic portion 160 and second elastic portion 162 can be configured as inner linings for upper 102. In particular, first elastic portion 160 and second elastic portion 162 can extend further into an interior portion of upper 102. In some cases, first portion 164 of first elastic portion 160 can extend below lower medial edge 134 of lacing region 122. In addition, second portion 166 of first elastic portion 160 can extend beyond first edge 186 and second edge 187 of first flex notch 182. In a similar manner, first portion 165 and second portion 167 of second elastic portion 162 can extend below lower lateral edge 136 and second flex notch 184, respectively.

In different embodiments, the materials used for the various components of article 100 may vary. For example, sole structure 110 may be made from any suitable material, including, but not limited to: elastomers, siloxanes, natural rubber, other synthetic rubbers, aluminum, steel, natural leather, synthetic leather, or plastics. In some cases, the materials used for making sole structure 110 may be selected to accomplish stability and cushioning for a foot undergoing forces typically associated with snowboarding.

Also, upper 102 may be made from any suitable material. Examples of materials for upper 102 include, but are not limited to: nylon, natural leather, synthetic leather, natural rubber or synthetic rubber. In some cases, upper 102 can be made of any suitable knitted, woven or non-woven material. In an exemplary embodiment, upper 102 can be made of a combination of outer and inner layers. For example, in some cases, upper 102 can be provided with an outer layer made of synthetic leather, which can enhance the durability of upper 102. The outer layer can be reinforced on an interior side of upper 102 by an inner layer made of, for example, a synthetic fabric that provides increased comfort to a foot.

Components associated with a lacing system can be made of any materials known in the art. For example, lace loops used in a lacing system can be made of materials including, but not limited to: leather, synthetic leather, knitted fabrics, woven fabrics, rubbers, plastics, or any other type of material. In an exemplary embodiment, lace loops used with upper 102 may be made of a fabric with a woven mesh, which can provide substantial flexibility to the lace loops.

The term "elastic portion" as used throughout this detailed description and in the claims is used to describe any component that is capable of substantial elastic deformation. It should be understood that the term "elastic portion" is not intended to be limited to a particular class of elastic materials. In some cases, one or more elastic portions can be made of an elastomeric material including, but not limited to: natural rubber, synthetic polyisoprene, butyl rubber, halogenated butyl rubbers, polybutadiene, styrene-butadiene rubber, nitrile rubber, hydrogenated nitrile rubbers, chloroprene rubber (such as polychloroprene, neoprene and bayprene), ethylene propylene rubber (EPM), ethylene propylene diene rubber (EPDM), epichlorohydrin rubber (ECO), polyacrylic rubber, silicone rubber, fluorosilicone rubber (FVMQ), fluoroelastomers (such as Viton, Tecnoflon, Fluorel, Aflas and Dai-El), perfluoroelastomers (such as Tecnoflon PFR, Kalrez, Chemraz, Perlast), polyether block amides (PEBA), chlorosulfonated polyethylene (CSM), ethylene-vinyl acetate (EVA), various types of thermoplastic elastomers (TPE), for example Elastron, as well as any other type of material with substantial elastic properties. In other cases, an elastic portion could be made of another type of material that is capable of elastic deformation. In other words, materials used for an elastic portion are not limited to elastomeric materials. In an exemplary embodiment, each elastic portion may be made of neoprene.

Figure 3:
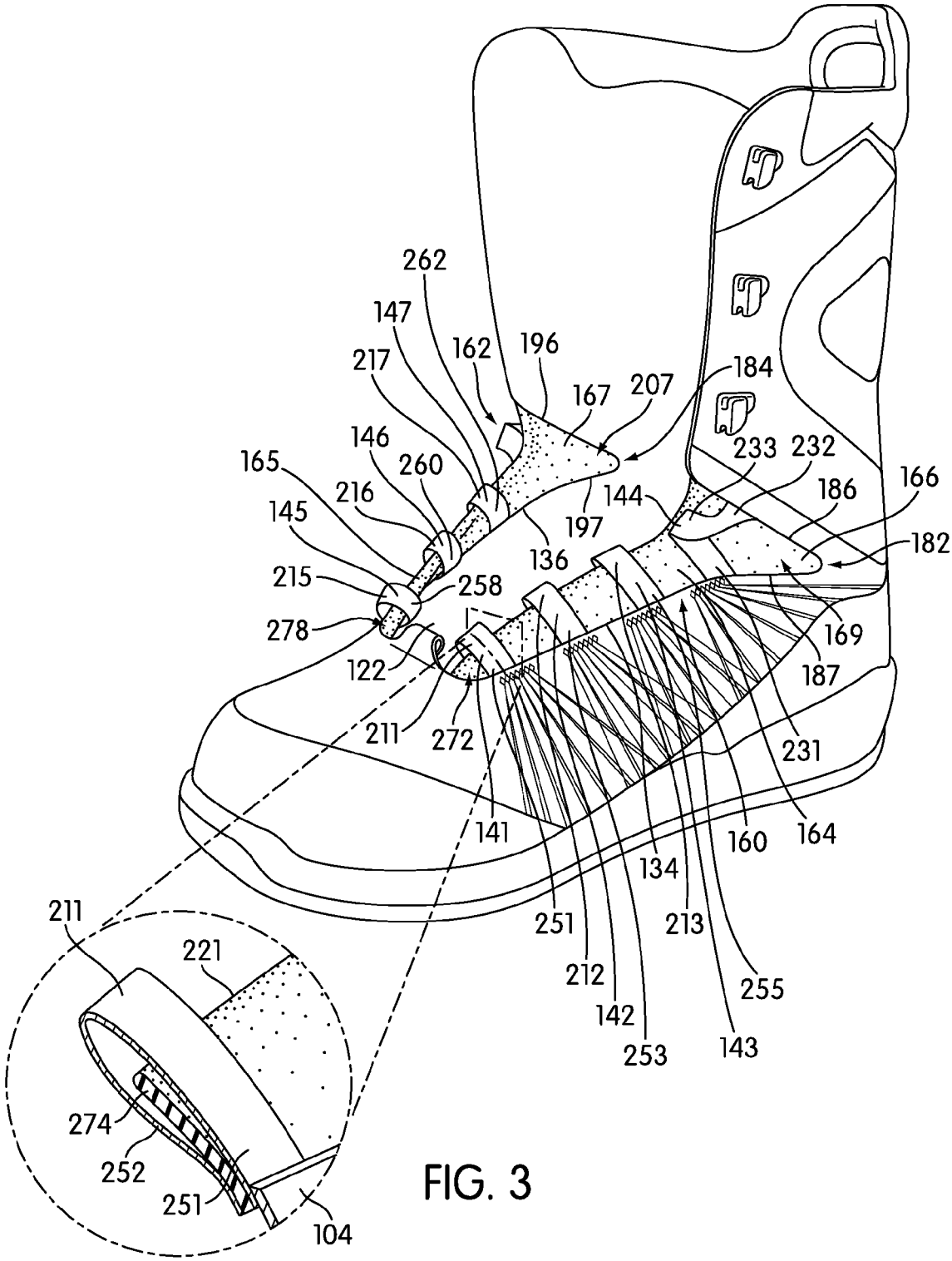
FIG. 3 is an isometric view of an exemplary embodiment of a medial side of a lacing system for an article of footwear.
Figure 4:
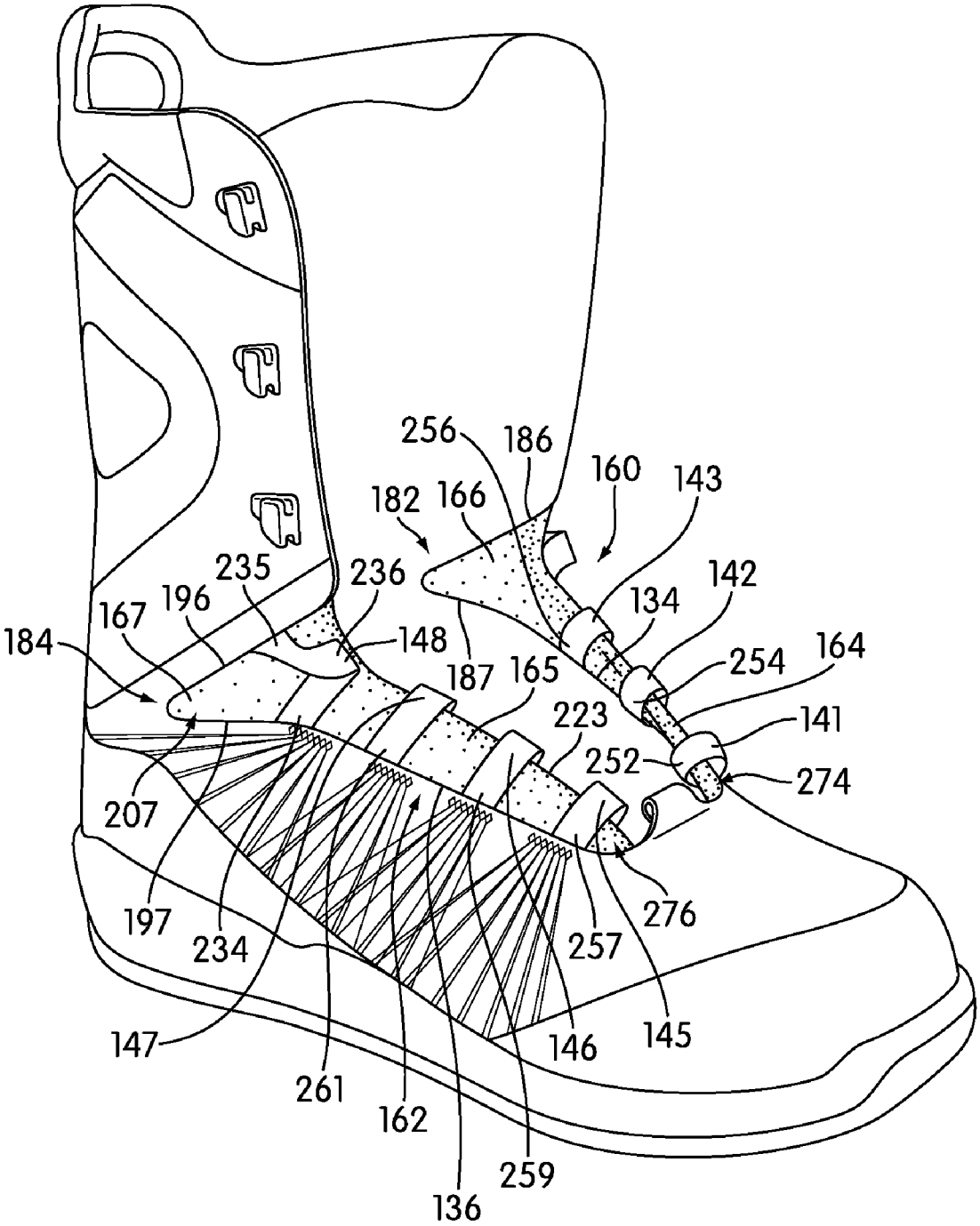
FIG. 4 is an isometric view of an exemplary embodiment of a lateral side of a lacing system for an article of footwear.
Figure 5:
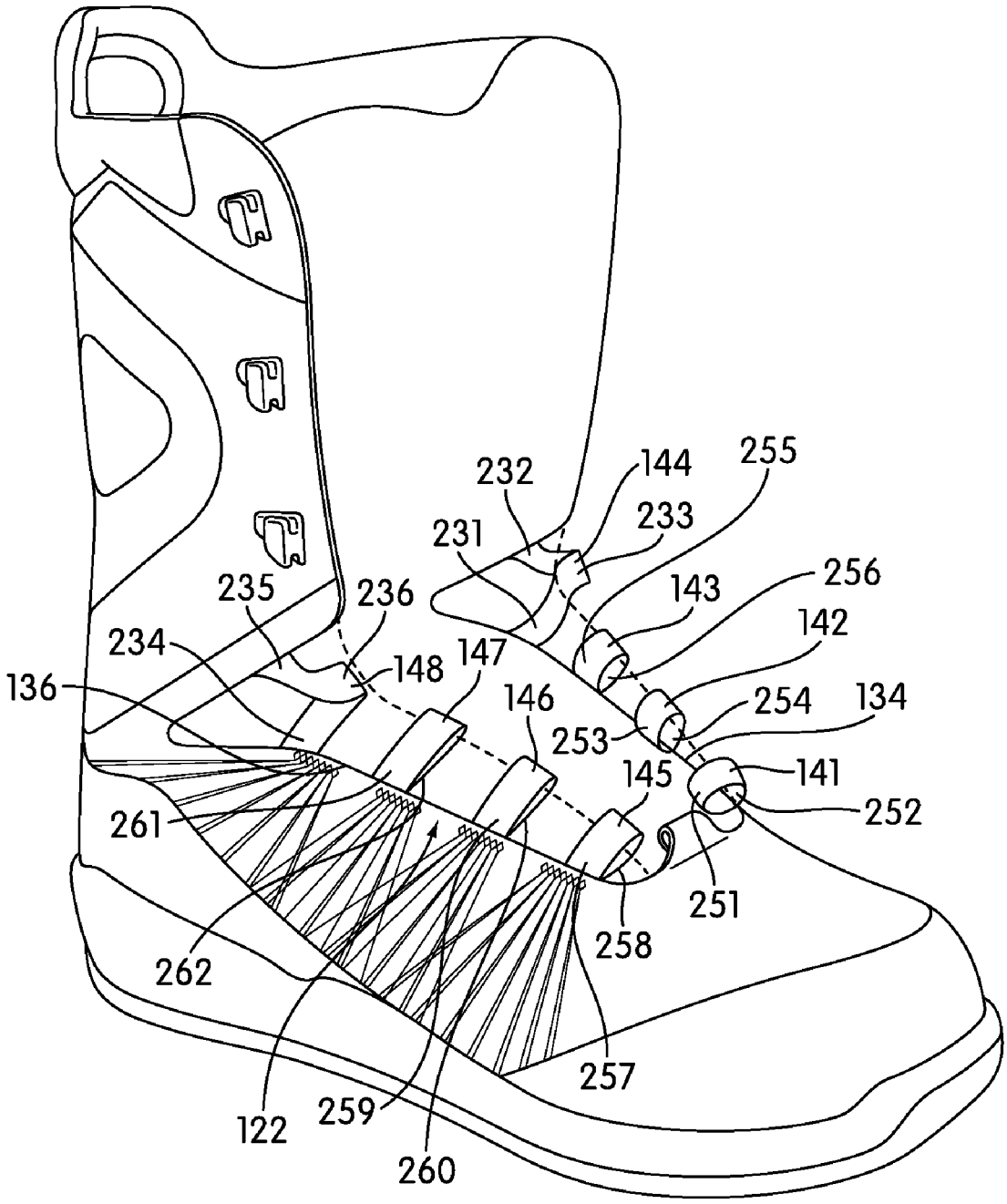
FIG. 5 is an isometric view of an exemplary embodiment of a lateral side of a lacing system for an article of footwear with elastic portions illustrated in phantom.

FIGS. 3 through 5 illustrate assembled views of lacing system 120 of article 100. For purposes of clarity, tongue 111 is not illustrated. Referring to FIGS. 3 through 5, first portion 164 of first elastic portion 160 may be associated with lower medial edge 134 of upper 102, as previously discussed. In addition, second portion 166 may be associated with first flex notch 182. In some cases, first portion 164 may be stitched to lower medial edge 134. In other cases, first portion 164 could be attached to lower medial edge 134 using an adhesive. In still other cases, first portion 164 may be attached to lower medial edge 134 in any other manner known in the art. In a similar manner, in some cases, peripheral edge 169 of second portion 166 can be stitched to first edge 186 and second edge 187 of first flex notch 182. In other cases, peripheral edge 169 can be fastened to first edge 186 and second edge 187 of first flex notch 182 in another manner, such as through the use of an adhesive.

Second elastic portion 162 can be attached to upper 102. In some cases, first portion 165 of second elastic portion 162 may be associated with lower lateral edge 136 of upper 102. Likewise, second portion 167 may be associated with second flex notch 184. In some cases, first portion 165 may be stitched to lower lateral edge 136. In other cases, first portion 165 may be attached to lower lateral edge 136 in another manner. In a similar manner, in some cases, peripheral edge 207 of second portion 167 can be stitched to third edge 196 and fourth edge 197 of second flex notch 184. In other cases, peripheral edge 207 can be fastened to third edge 196 and fourth edge 197 of second flex notch 184 in another manner.

In this embodiment, each lace loop of first lace loop 141, second lace loop 142 and third lace loop 143 may be configured to attach to lower medial edge 134 of lacing region 122. In particular, first lace loop 141 includes first end portion 251 and second end portion 252. In some cases, first end portion 251 and second end portion 252 may be attached to lower medial edge 134 of lacing region 122. In a similar manner, second lace loop 142 may include third end portion 253 and fourth end portion 254 that are configured to attach to lower medial edge 134. Similarly, third lace loop 143 may include fifth end portion 255 and sixth end portion 256 that are configured to attach to lower medial edge 134.

Each lace loop of fifth lace loop 145, sixth lace loop 146 and seventh lace loop 147 may be configured to attach to lower lateral edge 136 of lacing region 122. In particular, fifth lace loop 145 can include seventh end portion 257 and eighth end portion 258 configured to attach to lower lateral edge 136. In addition, sixth lace loop 146 includes ninth end portion 259 and tenth end portion 260 configured to attach to lower lateral edge 136. Also, seventh lace loop 147 includes eleventh end portion 261 and twelfth end portion 262 configured to attach to lower lateral edge 136.

In contrast to the lace loops discussed above, fourth lace loop 144 and eighth lace loop 148 may include end portions that attach at separated portions of upper 102. In one embodiment, fourth lace loop 144 includes first end portion 231 and second end portion 232. In some cases, first end portion 231 may be attached to second edge 187 of first flex notch 182. Also, second end portion 232 may be attached to first edge 186 of first flex notch 182. Furthermore, fourth lace loop 144 may include intermediate portion 233 that is disposed between first end portion 231 and second end portion 232. In some cases, intermediate portion 233 can be configured to extend between first edge 186 and second edge 187 of first flex notch 182. This arrangement can help a wearer to adjust first flex notch 182, since fourth lace loop 144 extends between adjacent edges of first flex notch 182.

In some embodiments, eighth lace loop 148 can include first end portion 234 and second end portion 235. In some cases, first end portion 234 may be attached to fourth edge 197 of second flex notch 184. In addition, second end portion 235 may be attached to third edge 196 of second flex notch 184. Furthermore, eighth lace loop 148 may include intermediate portion 236 that is disposed between first end portion 234 and second end portion 235. In some cases, intermediate portion 236 can be configured to extend between third edge 196 and fourth edge 197 of second flex notch 184. This arrangement can help a wearer adjust second flex notch 184, since eighth lace loop 148 extends between adjacent edges of second flex notch 184.

An article including lace loops can include provisions to increase comfort in a lacing region of the footwear. In some cases, lace loops can be associated with an elastic portion that extends throughout a lacing region in order to reduce localized pressure that may be applied by a lace loop when a lacing member is tightened. In an exemplary embodiment, lace loops can be configured to wrap around an elastic portion to enhance the comfort in the lacing region.

Generally, some lace loops of lace loop set 130 may be configured to wrap around first elastic portion 160 and second elastic portion 162. For example, first lace loop 141 is configured to wrap around first elastic portion 160. In particular, first end portion 251 of first lace loop 141 is disposed adjacent to first exterior portion 272 of first elastic portion 160. In addition, second end portion 252 of first lace loop 141 is disposed adjacent to first interior portion 274 of first elastic portion 160. Furthermore, first intermediate portion 211 of first lace loop 141, which is disposed between first end portion 251 and second end portion 252, is disposed adjacent to first upper edge 221 of first elastic portion 160. In other words, first elastic portion 160 extends through the aperture formed within first lace loop 141.

In an exemplary embodiment, second lace loop 142 and third lace loop 143 may be configured to wrap around first elastic portion 160. Also, fifth lace loop 145, sixth lace loop 146 and seventh lace loop 147 may be configured to wrap around second elastic portion 162. In particular third end portion 253 and fifth end portion 255 of second lace loop 142 and third lace loop 143 are disposed adjacent to first exterior portion 272 of first elastic portion 160. In addition, fourth end portion 254 and sixth end portion 256 of second lace loop 142 and third lace loop 143 are disposed adjacent to first interior portion 274 of first elastic portion 160. Furthermore, second lace loop 142 and third lace loop 143 include second intermediate portion 212 and third intermediate portion 213, respectively, disposed around first upper edge 221 of first elastic portion 160.

In a similar manner, seventh end portion 257, ninth end portion 259 and eleventh end portion 261 of fifth lace loop 145, sixth lace loop 146 and seventh lace loop 147 are disposed adjacent to second exterior portion 276 of second elastic portion 162. In addition, eighth end portion 258, tenth end portion 260 and twelfth end portion 262 of fifth lace loop 145, sixth lace loop 146 and seventh lace loop 147 are disposed adjacent to second interior portion 278 of second elastic portion 162. Furthermore, fifth lace loop 145, sixth lace loop 146 and seventh lace loop 147 include fifth intermediate portion 215, sixth intermediate portion 216 and seventh intermediate portion 217, respectively, disposed around second upper edge 223 of second elastic portion 162.

In some embodiments, fourth lace loop 144 and eighth lace loop 148 may not be configured to wrap around first elastic portion 160 and second elastic portion 162, respectively. Instead, fourth lace loop 144 may be disposed adjacent to first exterior portion 272 of first elastic portion 160. In particular, first end portion 231 and second end portion 232 of fourth lace loop 144 may be both disposed adjacent to first exterior portion 272 of first elastic portion 160. Likewise, first end portion 234 and second end portion 235 of eighth lace loop 148 may be both disposed adjacent to second exterior portion 276 of second elastic portion 162.

Typically, as a wearer adjusts an article with lace loops, the lace loops may tighten against a top surface of the article. In embodiments with free-floating lace loops, which are lace loops that are not wrapped around an elastic portion, the tension of the lace loops against an upper surface of the article can cause discomfort to a wearer.

Figure 6:
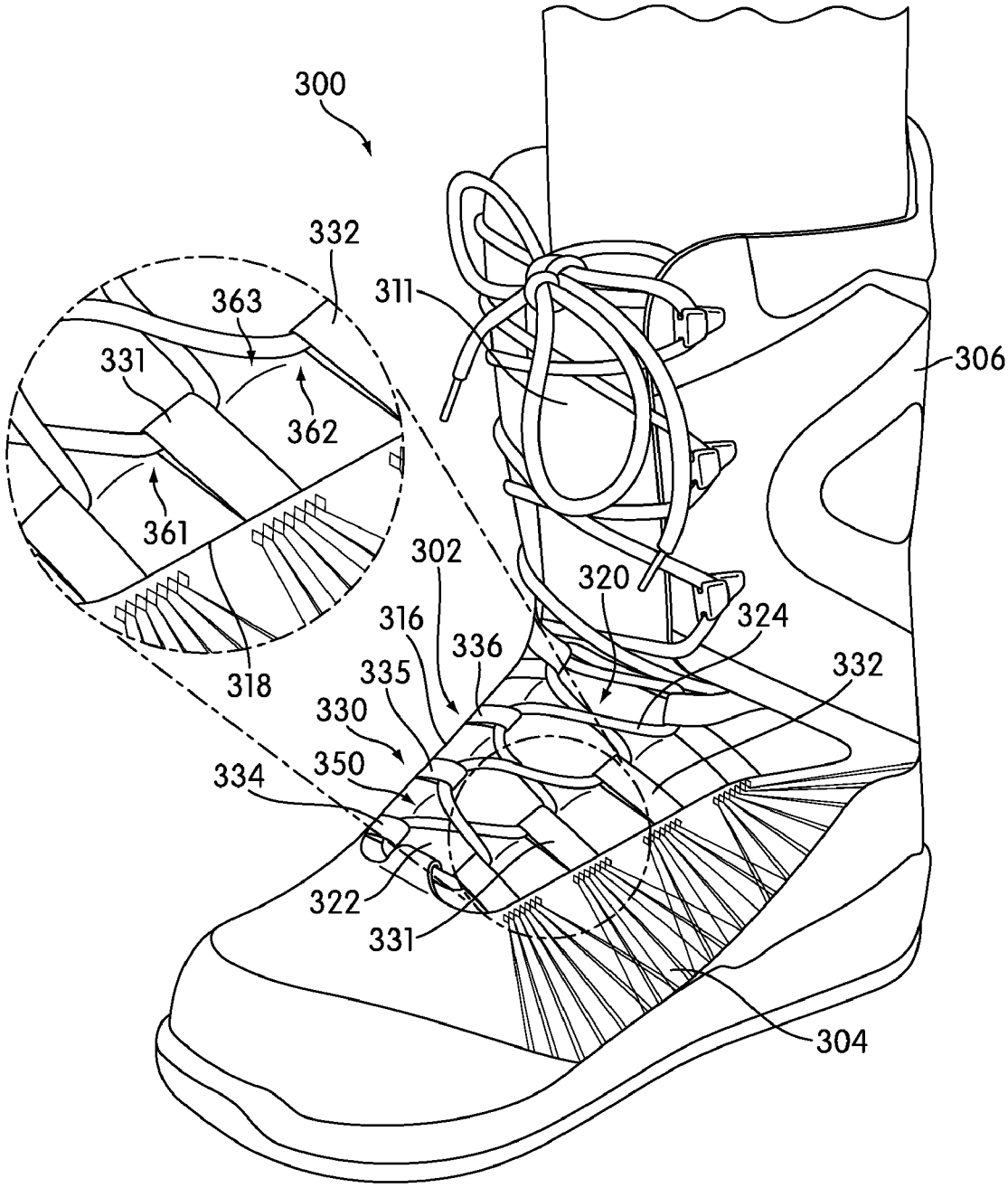
FIG. 6 is an enlarged view of an alternative embodiment of a lacing system for an article of footwear.

FIG. 6 illustrates an alternative embodiment of an article including lace loops. Referring to FIG. 6, article 300 may have a substantially similar design to the embodiment discussed above. For example, article 300 may be a boot, such as a boot designed for snowboarding. In particular, article 300 can include upper 302, which further includes lower portion 304 and upper portion 306. Lower portion 304 may be configured to receive a foot, including the toes, arch and heel. In addition, upper portion 306 may be a cuff-like portion configured to receive an ankle.

Furthermore, article 300 can be provided with lacing system 320, which is disposed in lacing region 322. In the alternative embodiment, lacing system 320 further includes lower set of lace loops 330, which includes first lace loop 331, second lace loop 332, third lace loop 333, fourth lace loop 334, fifth lace loop 335 and sixth lace loop 336. In this case, the lace loops of lower set of lace loops 330 are associated with lower portion 304 of upper 302. In particular, lacing member 324 of lacing system 320 may be inserted through each lace loop of lacing system 320 in order to facilitate fastening of lower portion 304.

In this alternative embodiment, the end portions of each lace loop of lower set of lace loops 330 are attached directly to medial edge 318 and lateral edge 316 of lacing region 322. In particular, the end portions of each lace loop are attached to one another and a corresponding edge of lacing region 322. In contrast to the previous embodiment, however, article 300 does not include any elastic portions disposed through lacing region 322.

In this alternative embodiment, lacing member 324 has been pulled to tighten fully lacing system 320. As lacing member 324 is tightened, each lacing loop of lower set of lace loops 330 is pulled taught against upper surface 350 of upper 102. In this embodiment, upper surface 350 is associated with an upper surface of tongue 311 of upper 302. However, in other embodiments without a tongue, each lace loop of lower set of lace loops 330 may be pressed directly against an inner lining of upper 302.

As each lace loop tightens around upper surface 350, pressure may be applied at localized regions of upper surface 350. For example, in this embodiment first lace loop 331 applies a downward and inward pressure at first localized region 361 of upper surface 350. In addition, second lace loop 332 applies a downward and inward pressure at second localized region 362 of upper surface 350. This arrangement can cause depressions in upper surface 350 at first localized region 361 and second localized region 362 of upper surface 350. Furthermore, as first localized region 361 and second localized region 362 of upper surface 350 are compressed under the pressure applied by first lace loop 331 and second lace loop 332, intermediate region 363 of upper surface 350 may expand outwardly from adjacent regions of upper surface 350. In other words, intermediate region 363 may bunch due to the forces applied at first localized region 361 and second localized region 362.

In a similar manner, upper surface 350 may be depressed in localized regions adjacent to third lace loop 333, fourth lace loop 334, fifth lace loop 335 and sixth lace loop 336. Furthermore, regions intermediate to any two adjacent lace loops may experience bunching or bulging due to the pressure applied locally at the lace loops. This bunched arrangement for upper surface 350 can lead to discomfort for a wearer, as the uneven surface created at upper surface 350 can lead to an irregular lower surface of tongue 111 that is configured to contact a foot or sock of a wearer.

In contrast to the arrangement described in the alternative embodiment without elastic portions, an article with elastic portions disposed through lace loops can help reduce localized pressures that can cause an irregular upper surface for an upper. In particular, the exemplary design includes a lace loop system in which the lace loops are coupled with the elastic portions in a manner that provides substantially even pressure over an upper surface of an upper, especially adjacent to edges of the lacing region.

Figure 7:
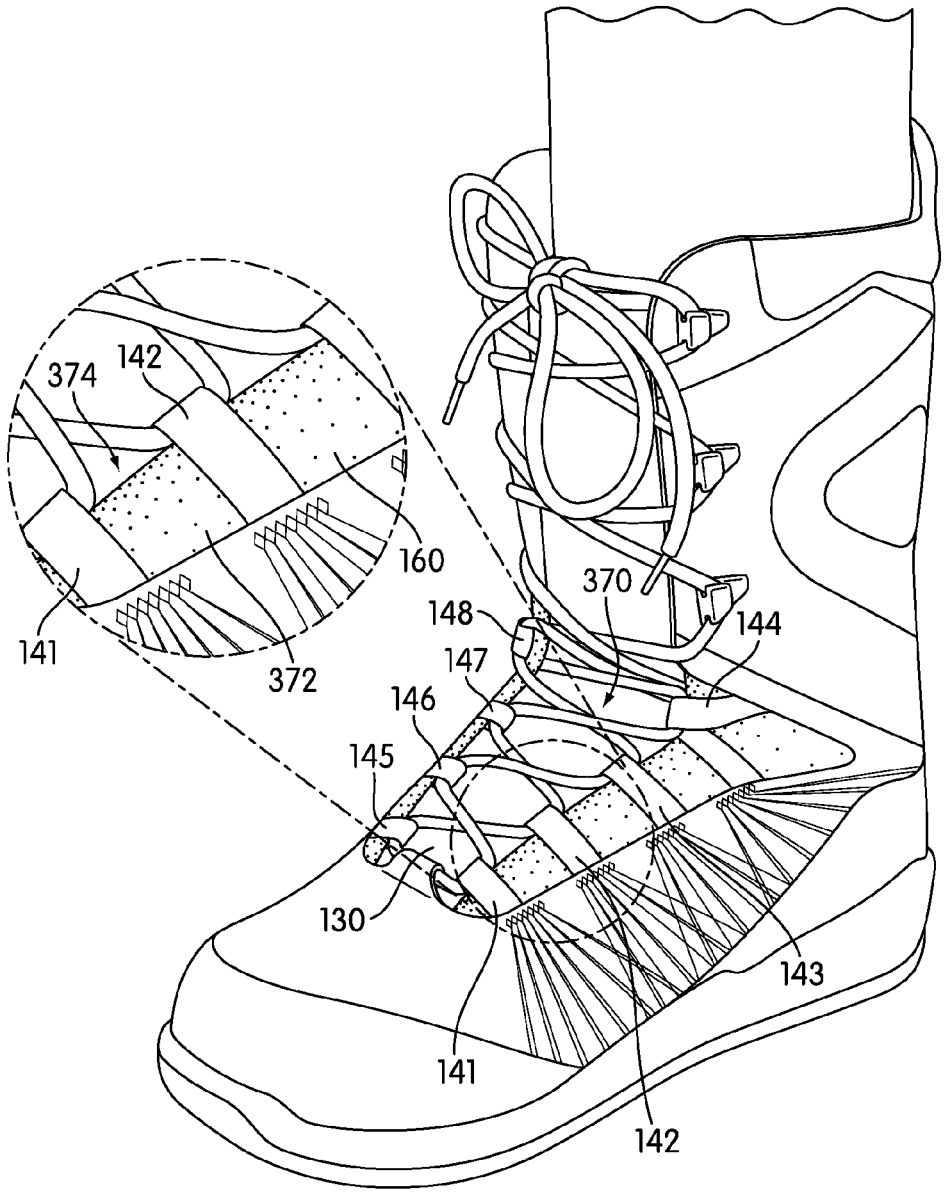
FIG. 7 is an enlarged view of an exemplary embodiment of a lacing system for an article of footwear.

Referring to FIG. 7, article 100 includes lace loops that are configured to wrap around elastic portions, as previously discussed. In this embodiment, as lacing member 124 is tightened, each lace loop of lace loop set 130 may be pulled inwardly and downwardly against upper surface 370 of upper 102. For example, first lace loop 141 is pulled taught against upper surface 370. Also, second lace loop 142 is pulled taught against upper surface 370. In addition, because first elastic portion 160 is disposed through first lace loop 141 and second lace loop 142, intermediate elastic portion 372 is also pulled taught against upper surface 370. Therefore, the forces applied by first lace loop 141 and second lace loop 142 are distributed over first region 374, which is extends beneath first lace loop 141, second lace loop 142 and intermediate elastic portion 372.

In a similar manner, as other lace loops of lace loop set 130 are pulled tightly against upper surface 370, the pressures that would normally be applied to localized regions are instead distributed over wider regions that span between adjacent lace loops. With this arrangement, pressure is evenly applied over a relatively large region of upper surface 370, which results in a substantially smooth surface. In other words, this arrangement helps reduce the bunching and uneven surfaces that are created using the free-floating lace loop arrangement described in the alternative embodiment.

Figure 8:
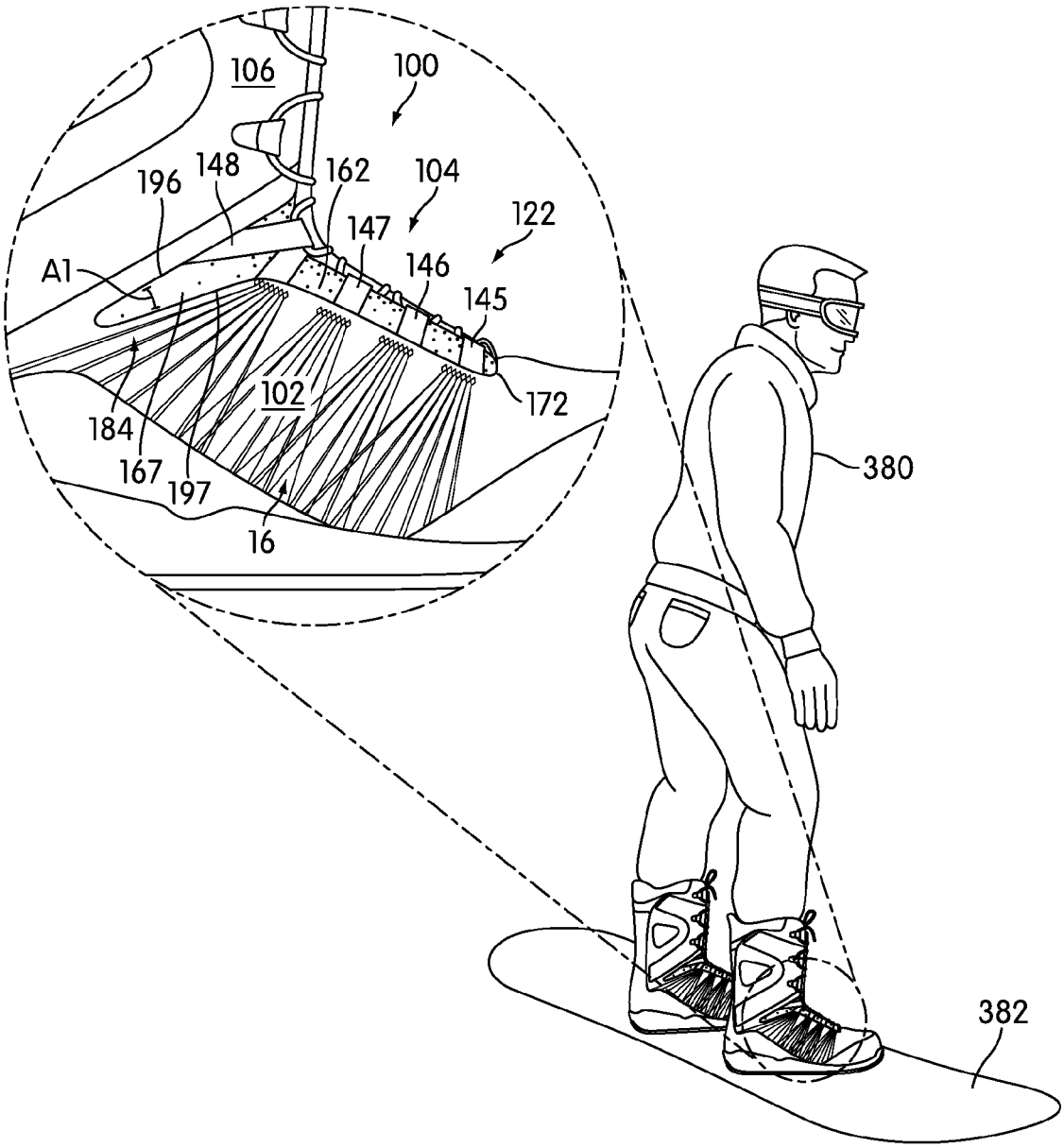
FIG. 8 is a side view of an exemplary embodiment of an article of footwear illustrating a normal position of a flex notch.
Figure 9:
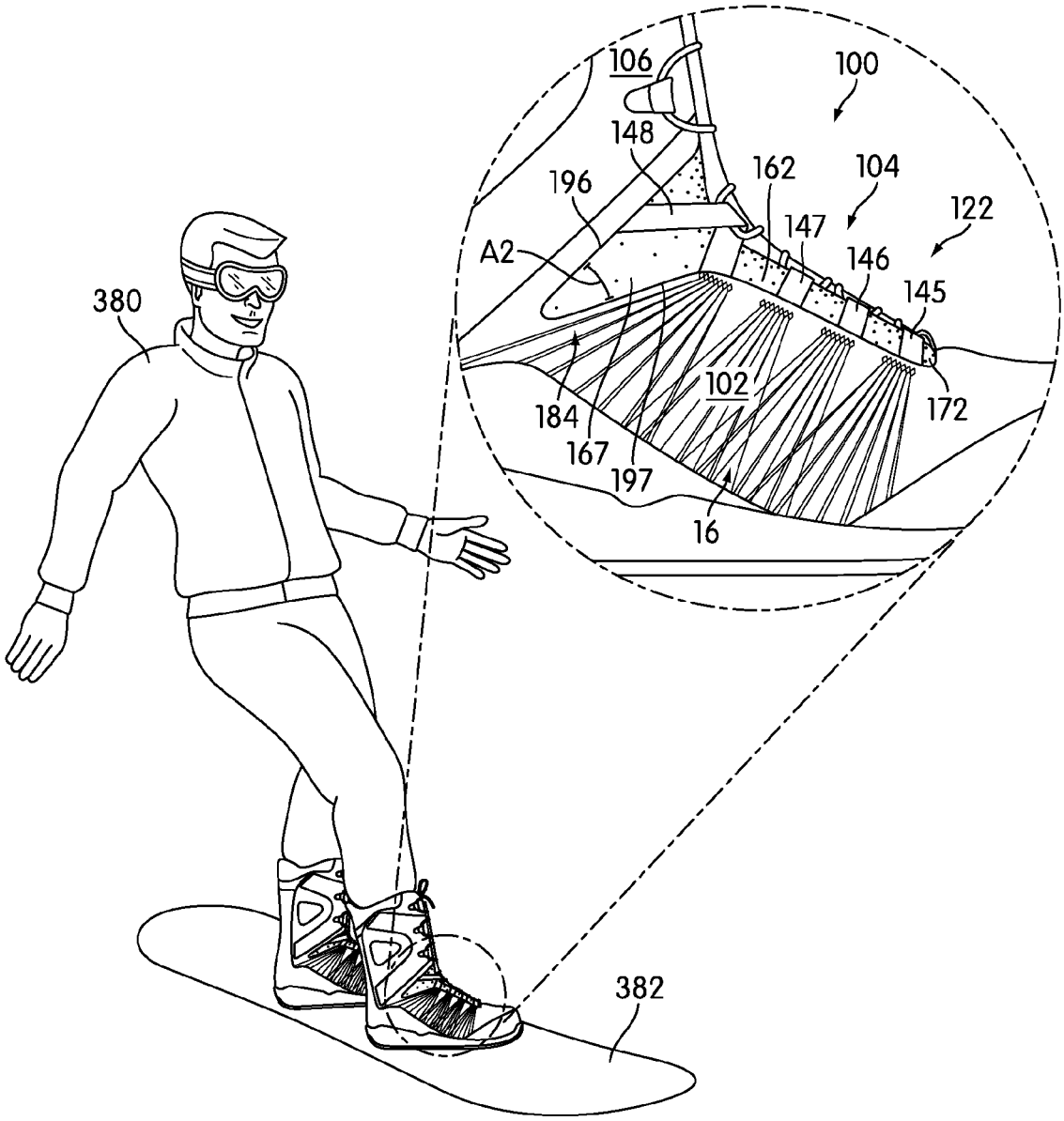
FIG. 9 is a side view of an exemplary embodiment of an article of footwear illustrating a flexed position of a flex notch as well as the expansion of an elastic portion associated with the flex notch.

FIGS. 8 and 9 are intended to illustrate the enhanced stability provided for a flex notch that is associated with an elastic portion. Referring to FIGS. 8 and 9, the flexibility of second flex notch 184 can be controlled using second elastic portion 162 that extends between third edge 196 and fourth edge 197 of second flex notch 184. In particular, second portion 167 can provide an elastic tension between third edge 196 and fourth edge 197 that helps urge third edge 196 and fourth edge 197 together as a user leans forward in article 100. Furthermore, as a user leans rearwards in article 100, which acts to widen second flex notch 184, second elastic portion 162 can help provide a restoring force to second flex notch 184 to enhance stability.

In addition, because second elastic portion 162 extends along lateral side 16 of lacing region 122, second elastic portion 162 may be configured to provide a greater restoring force for flexing at second flex notch 184. Likewise, because first elastic portion 160 extends along medial side 18 of lacing region 122, first elastic portion 160 may be configured to provide a greater restoring force at first flex notch 182.

As illustrated in FIG. 8, athlete 380 is standing in a generally upright position to steer snowboard 382 in a generally straight manner. It is understood that a binding mechanism (not shown) may bind article 100 to snowboard 382 during use, which has been omitted for clarity. The term athlete is intended to include both professional athletes and amateur athletes. In particular, the term athlete, as used throughout this detailed discussion and in the claims, refers to any user of article 100. In this situation, second flex notch 184 may be disposed on a substantially non-flexed position. In this case, third edge 196 may form an angle A1 with fourth edge 197.

Referring to FIG. 9, the shoulders of athlete 380 are rotated to turn snowboard 382. As athlete 380 twists, upper portion 106 extends in a rearward direction and second flex notch 184 expands to accommodate the flexing of upper portion 106 with respect to lower portion 104. In particular, third edge 196 may form an angle A2 with fourth edge 197 in this flexed position.

In this case, second elastic portion 162 may stretch to accommodate the widening of second flex notch 184. In particular, second flex notch 184 may expand to fill the increased surface area between third edge 196 and fourth edge 197 of second flex notch 184. In addition, second elastic portion 162 may be configured to expand in a substantially longitudinal direction between first end portion 172 of lacing region 122 and third edge 196 of second flex notch 184. This arrangement can help increase the restoring force to second flex notch 184 that is provided by second elastic portion 162. In particular, this arrangement may provide for increased stability over a system in which an elastic portion is confined to a flex notch.

Although only lateral side 16 is illustrated in FIGS. 8 and 9, it will be understood that first flex notch 182, which is disposed on medial side 18, may be configured to flex in a similar manner to second flex notch 184. Furthermore, first elastic portion 160 can also be configured to accommodate flexing at first flex notch 182. In particular, first elastic portion 160 can provide a similar restoring force for first flex notch 182 during maneuvers where upper portion 106 is titled backwards with respect to lower portion 104.

The arrangement discussed here for an article of footwear with flex notches can provide increased flexibility for an athlete. As discussed above, first flex notch 182 and second flex notch 184 can accommodate bending between lower portion 104 and upper portion 106. In addition to facilitating bending between lower portion 104 and upper portion 106 of upper 102, first flex notch 182 and second flex notch 184 can also accommodate twisting between lower portion 104 and second lower portion 106. By accommodating both bending and twisting of upper 102, article 100 can help assist an athlete in performing various athletic maneuvers. For example, when article of footwear 100 is used for snowboarding, first flex notch 182 and second flex notch 184 can help the athlete in performing various types of snowboarding moves such as turning and carving. In addition, article 100 can be configured to help an athlete perform various types of snowboarding tricks including aerial tricks, such as ollies, as well as surface tricks, including but not limited to wheelies, butters and nose and tail rolls, grinding tricks, such as 50/50 grinds, halfpipe tricks such as alley oops, as well as any other type of snowboarding trick.

An article with one or more flex notches can include provisions for modifying the size of the one or more flex notches. In some cases, one or more straps can be associated with a flex notch. In other cases, one or more lace loops can be associated with a flex notch. In an exemplary embodiment, a flex notch of an article can include a lace loop with opposing ends that are attached to adjacent edges of the flex notch.

Figure 10:
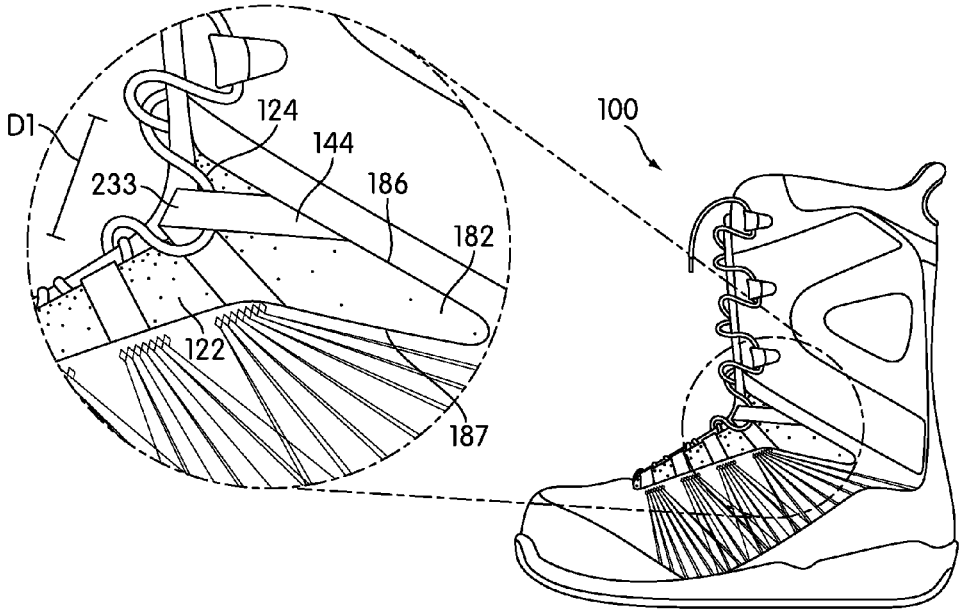
FIG. 10 is an enlarged view of an exemplary embodiment of a flex notch when a lacing system is loosened.
Figure 11:
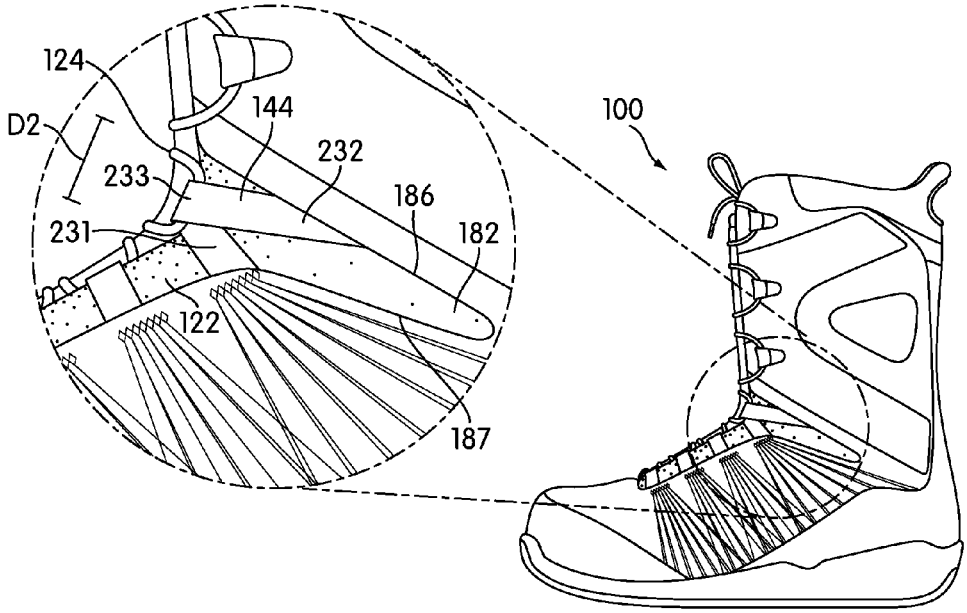
FIG. 11 is an enlarged view of an exemplary embodiment of a flex notch when a lacing system is tightened.

FIGS. 10 and 11 are intended to illustrate the use of fourth lace loop 144 for modifying the size of first flex notch 182. Although the embodiment shown here only illustrates medial side 18 of upper 102, including first flex notch 182 and fourth lace loop 144, it will be understood that eighth lace loop 148 may be used to modify the size of second flex notch 184 in a similar manner. In particular, because lacing member 124 is generally laced in a symmetric manner through lace loop set 130, including both fourth lace loop 144 and eighth lace loop 148, similar forces are applied to both fourth lace loop 144 and eighth lace loop 148 by lacing member 124.

Referring to FIG. 10, lacing member 124 has not been tightened. In particular, lacing member 124 is loose and disposed away from intermediate portion 233 of fourth lace loop 144. At this point, first flex notch 182 is in a non-flexed position. As illustrated, first edge 186 and second edge 187 are separated by a distance D1.

Referring now to FIG. 11, lacing member 124 has been tightened to adjust upper 102 around a foot. In particular, lacing member 124 is drawn tightly against intermediate portion 233 of fourth lace loop 144. In this case, lacing member 124 pulls intermediate portion 233 towards the middle of lacing region 122. As intermediate portion 233 is pulled, first end portion 231 and second end portion 232 of fourth lace loop 144 are pulled closer together, which also acts to pull first edge 186 and second edge 187 of first flex notch 182 closer together. As illustrated, in this tightened position, first edge 186 and second edge 187 are separated by a distance D2. In an exemplary embodiment, distance D2 is substantially smaller than distance D1. With this arrangement, the size of first flex notch 182, which corresponds to the distance between first edge 186 and second edge 187, can be controlled using lacing member 124. This arrangement can facilitate a more controlled fit for a wearer, since first flex notch 182 can be adjusted to different positions.

An article of footwear can include provisions to enhance stability for a foot. In an article configured as a boot, the upper may include additional provisions for securely wrapping around the rear of a foot. In some embodiments, the article can include a harness that is associated with a rear portion of a foot. In some cases, the harness can be disposed externally over an upper. In an exemplary embodiment, an article can include a harness that is disposed internally within an upper.

Figure 12:
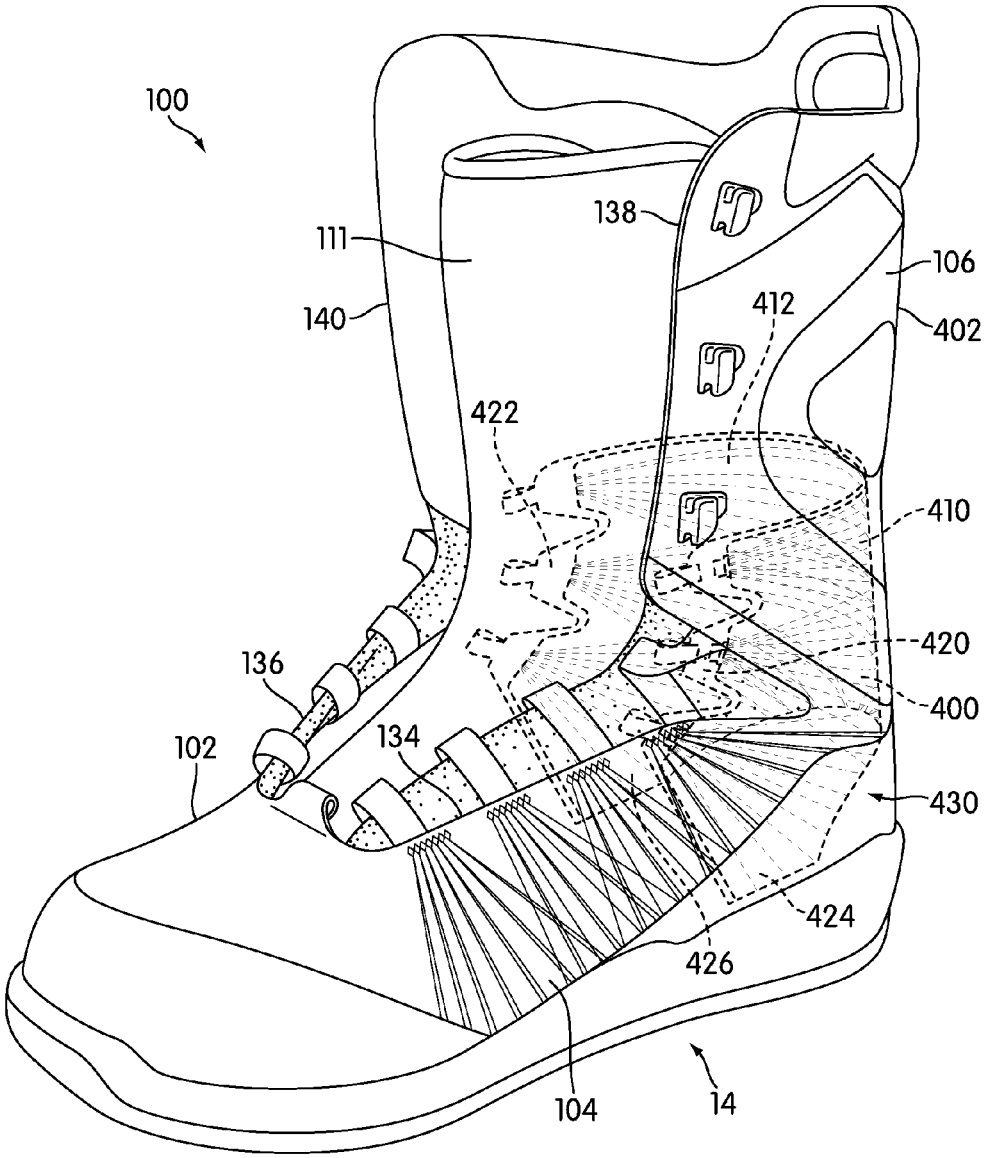
FIG. 12 is an isometric view of an exemplary embodiment of an article of footwear with an internal harness shown in phantom.
Figure 13:
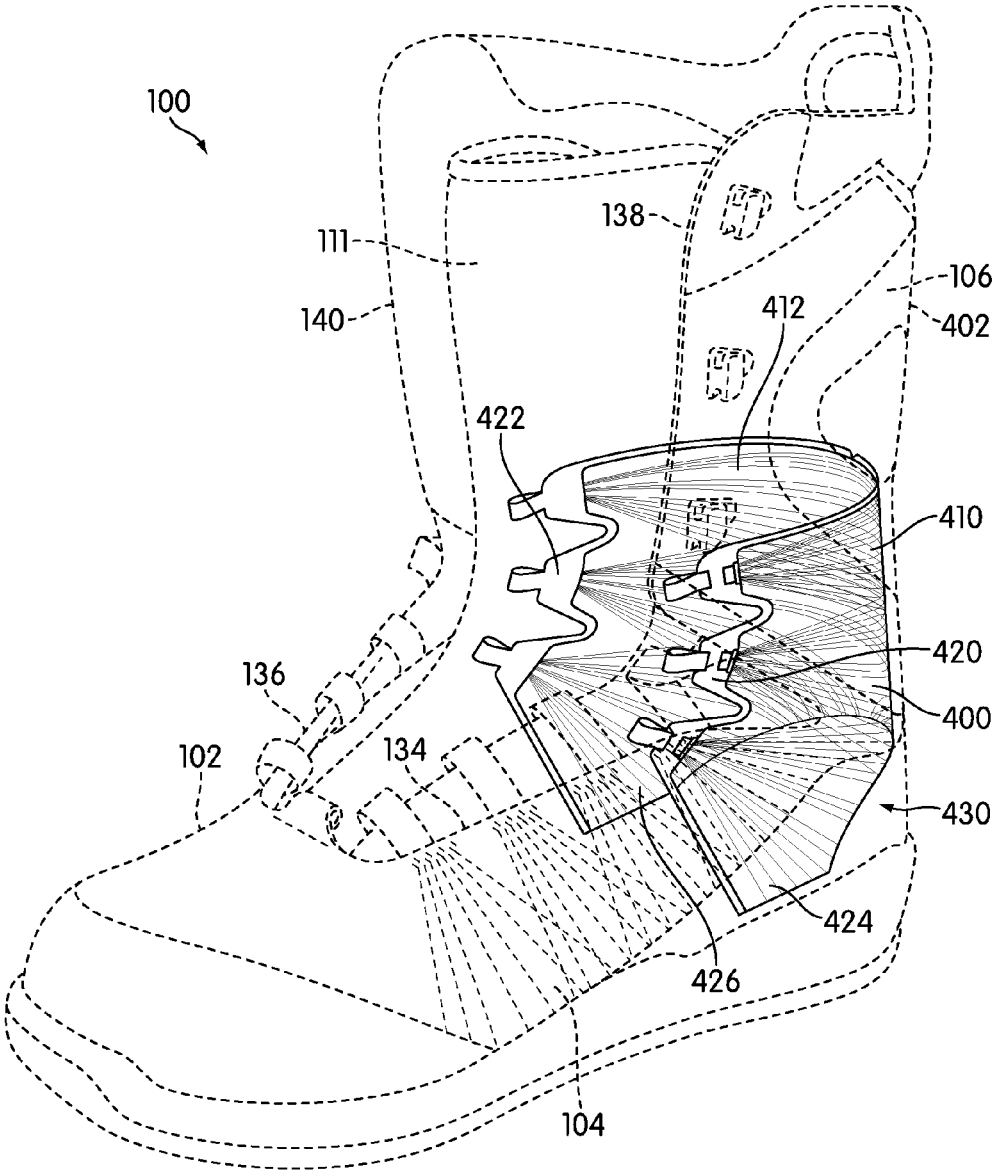
FIG. 13 is an isometric view of an exemplary embodiment of an article of footwear shown in phantom including an internal harness illustrated in solid.
Figure 14:
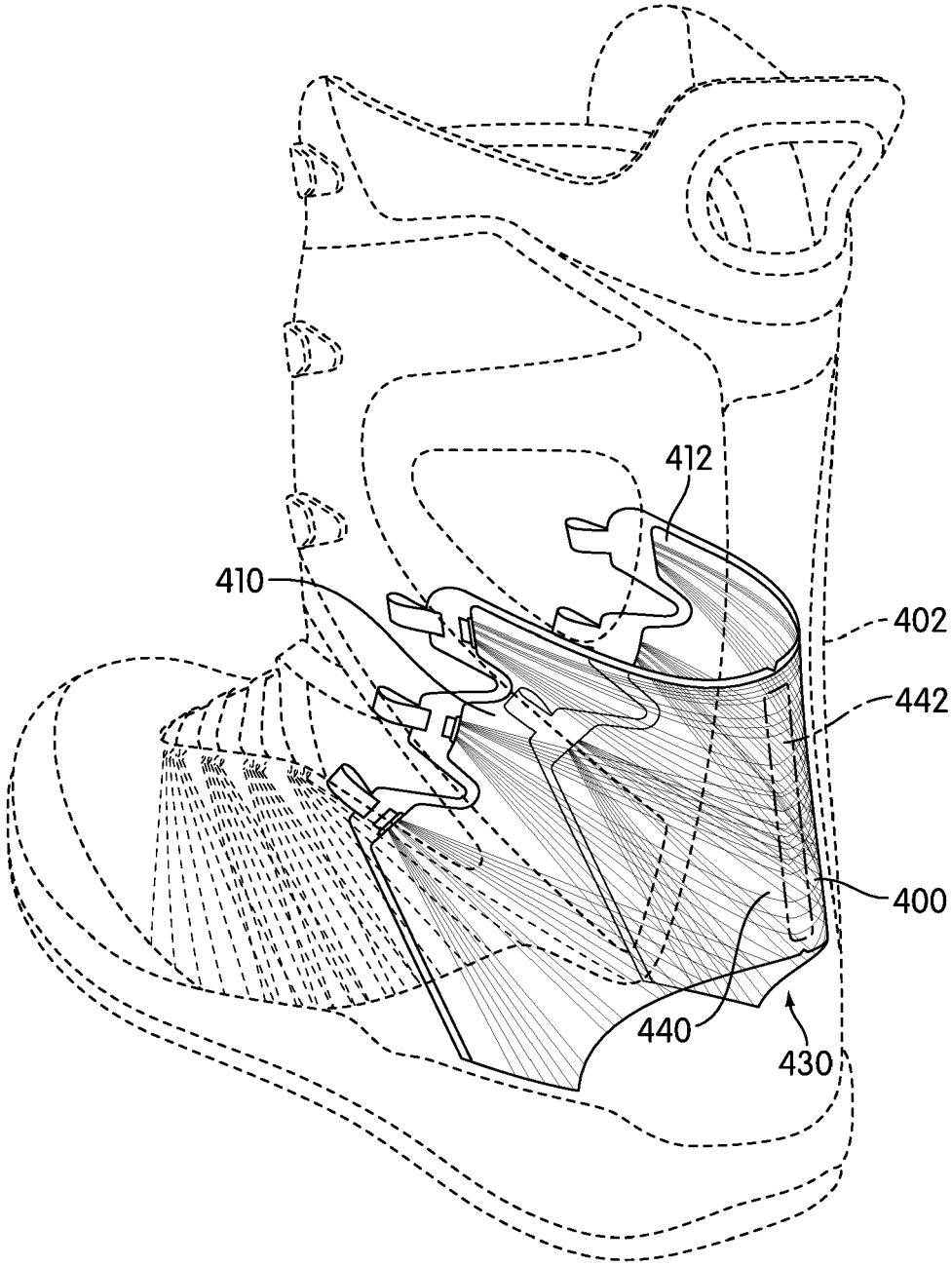
FIG. 14 is an isometric rear view of an exemplary embodiment of an article of footwear including an internal harness illustrating the attachment of the internal harness to a rear wall of the upper.
Figure 15:
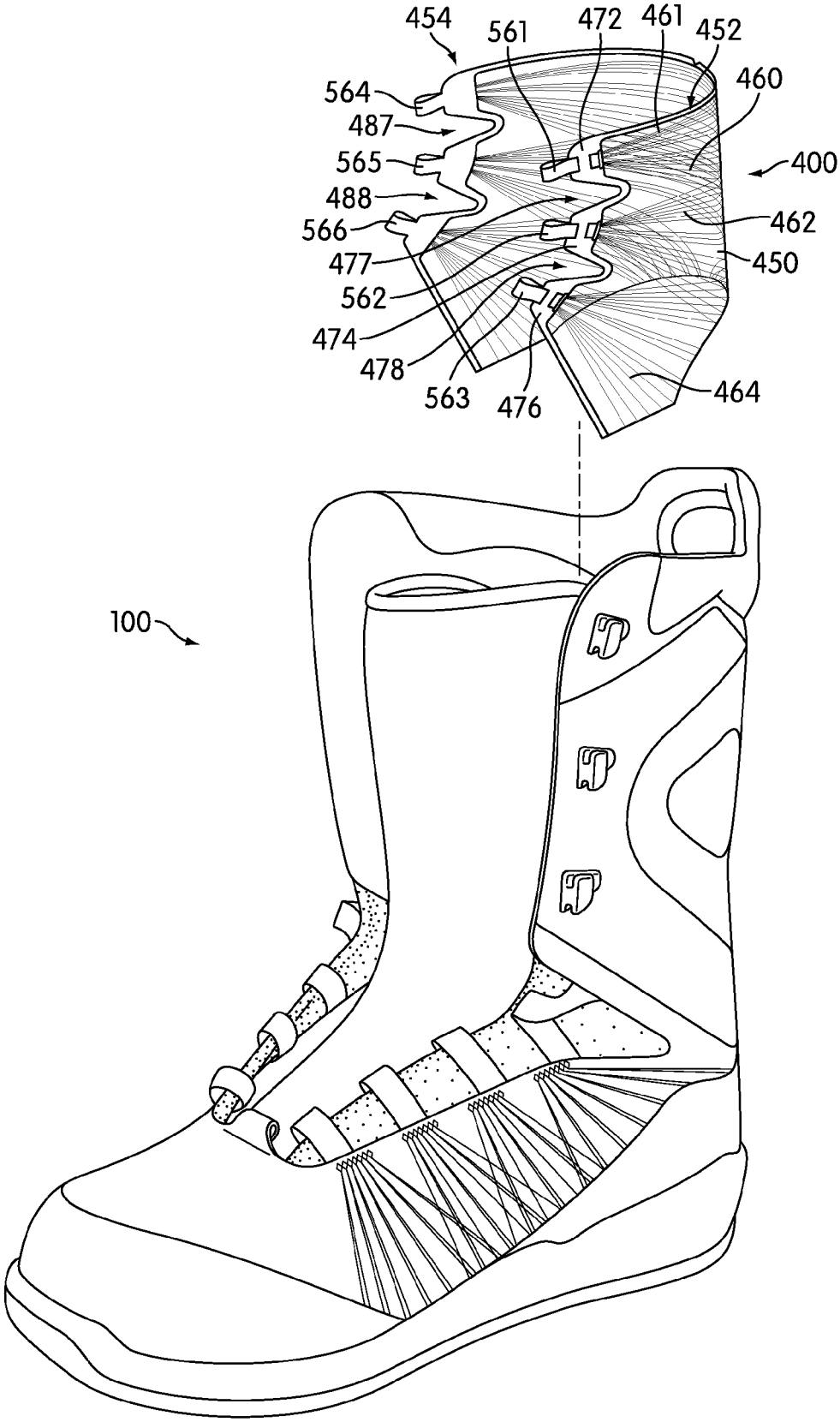
FIG. 15 is an exploded isometric view of an exemplary embodiment of an article of footwear with a harness.
Figure 16:
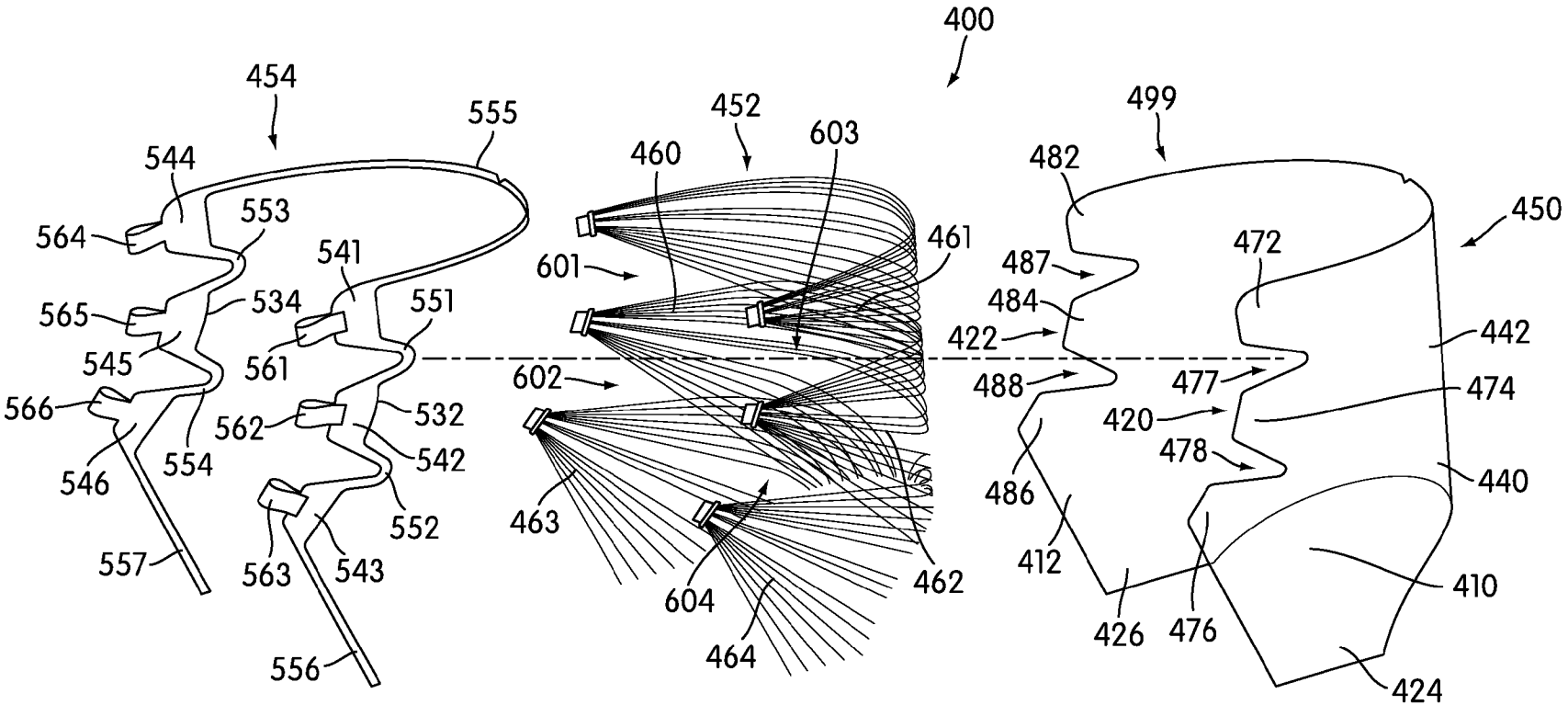
FIG. 16 is an exploded isometric view of an exemplary embodiment of a harness.
Figure 17:
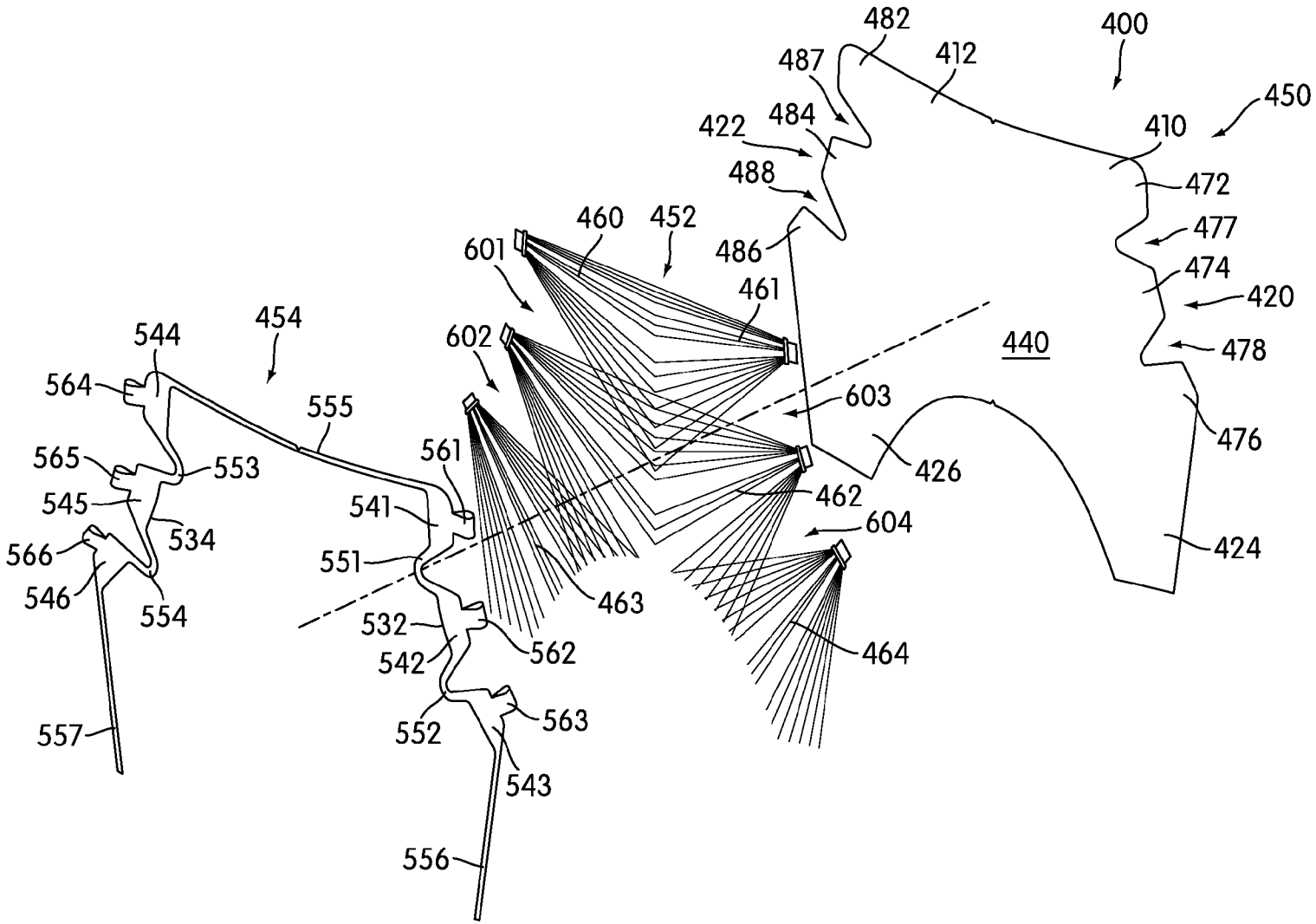
FIG. 17 is an isometric exploded view of an exemplary embodiment of a harness.

FIGS. 12 through 14 illustrate isometric views of an embodiment of article 100 including harness 400. Referring to FIGS. 12 through 14, harness 400 is disposed within upper 102 of article 100. In some cases, harness 400 may be disposed adjacent to heel portion 14 of upper. In particular, harness 400 may extend between rear wall 402 of upper 102 and tongue 111 in a substantially longitudinal direction. Also, harness 400 may extend through both lower portion 104 and upper portion 106 in a substantially vertical direction.

In some embodiments, harness 400 can have a substantially symmetric shape that includes first side portion 410 and second side portion 412. In some cases, first side portion 410 may be configured to partially wrap around a medial side of a foot that is inserted into upper 102. In particular, first side portion 410 may engage the medial side of the foot at or just below the ankle of the foot. In a similar manner, second side portion 412 may be configured to partially wrap around a lateral side of a foot that is inserted into upper 102. In particular, second side portion 412 may engage the lateral side of the foot at or just below the ankle of the foot. With this arrangement, harness 400 can be configured to cradle a rear portion of the foot and provide enhanced stability for article 100.

In one embodiment, first side portion 410 includes medial edge 420. Likewise, second side portion 412 includes lateral edge 422. In an exemplary embodiment, medial edge 420 is disposed adjacent to upper medial edge 138 of lacing region 122. In some cases, a portion of medial edge 420 may extend below upper medial edge 138 of lacing region 122. In other cases, a portion of medial edge 420 can substantially coincide with upper medial edge 138 of lacing region 122. In some embodiments, lateral edge 422 is disposed adjacent to upper lateral edge 140 of lacing region 122. In some cases, a portion of lateral edge 422 may extend below upper lateral edge 140. In other cases, a portion of lateral edge 422 can substantially coincide with upper lateral edge 140 of lacing region 122. With this arrangement, medial edge 420 and lateral edge 422 of harness 400 may be associated with lacing region 122. In some embodiments, medial edge 420 and lateral edge 422 can be configured to receive laces, as discussed in further detail below.

It will be understood that in other embodiments, medial edge 420 and lateral edge 422 could be associated with different parts of lacing region 122. For example, in another embodiment, medial edge 420 and lateral edge 422 could be disposed adjacent to lower medial edge 134 and lower lateral edge 136, respectively, of lacing region 122. In still other embodiments, medial edge 420 and lateral edge 422 may not be associated with any portions of lacing region 122.

In some embodiments, first side portion 410 may include first lower extended portion 424. In some cases, first lower extended portion 424 may extend downwards towards lower surface 421 of upper 102. In a similar manner, second side portion 412 may include second lower extended portion 426. In some cases, second lower extended portion 426 may also extend downwards towards lower surface 421. With this arrangement, first lower extended portion 424 and second lower extended portion 426 can enhance stability of a foot at a base of the heel.

In some embodiments, harness 400 can include heel opening 430 to provide clearance for a heel in the rear of upper 102. In particular, heel opening 430 may be provided between first lower extended portion 424 and second lower extended portion 426. With this arrangement, heel opening 430 allows the heel of a foot to be disposed directly against an inner lining, or interior surface, of upper 102.

In this exemplary embodiment, heel opening 430 has an approximately semi-circular shape. However, in other embodiments, heel opening 430 can have any other shape including, but not limited to: squares, circles, rectangles, regular polygons, irregular polygons, irregular shapes or any other type of shape. In particular, a different shape for heel opening 430 can be provided by modifying the shapes, and/or sizes, of first lower extended portion 424 and second lower extended portion 426.

In different embodiments, harness 400 may be attached to an interior surface of upper 102 in various ways. In some cases, a substantial majority of harness 400 can be attached to the interior surface of upper 102. In other cases, only a portion of harness 400 can be attached to the interior surface of upper 102. In an exemplary embodiment, a central portion of harness 400 can be attached to the interior surface of upper 102.

Harness 400 can include central portion 440. In particular, central portion 440 may be disposed between first side portion 410 and second side portion 412. In this exemplary embodiment, central portion 440 includes attachment region 442. Attachment region 442 may be a region of upper 102 that is attached directly to an interior surface of upper 102. In one embodiment, attachment region 442 is attached to an interior surface of upper 102 at rear wall 402 of upper 102. With this arrangement, harness 400 is prevented from shifting substantially during use.

In different embodiments, harness 400 can be attached to upper 102 in various ways. In some cases, harness 400 can be attached to upper 102 using an adhesive of some kind. In other cases, harness 400 can be attached to upper 102 using a fastening system, such as a hook and loop fastener system. In an exemplary embodiment, harness 400 can be stitched directed to upper 102.

FIGS. 15 through 19 illustrate embodiments of harness 400 isolated from upper 102. Referring to FIGS. 15 through 19, harness 400 may comprise multiple layers. In one embodiment, harness 400 can comprise base layer 450, threading layer 452 and peripheral layer 454. Generally, base layer 450 can be any substrate to which threads 460 of threading layer 452 are attached. In some cases, base layer 450 can be a single piece of material. In other cases, base layer 450 can be formed from multiple pieces of material. Furthermore, in some cases base layer 450 can comprise a single material layer. In other cases, base layer 450 can comprise multiple material layers.

Articles with threads configured to provide structural support have been previously disclosed in U.S. Patent Application Publication No. 2007/0271822, to Meschter, the entirety of which is hereby incorporated by reference. In addition, U.S. Patent Application Publication No. 2007/0271823, also to Meschter, is hereby incorporated by reference. These two references will be referred to as the thread structural elements cases throughout the remainder of this detailed description.

In an exemplary embodiment, base layer 450 defines the overall shape of harness 400. In particular, central portion 440, first side portion 410 and second side portion 412 of harness 400 may be associated with base layer 450. In addition, base layer 450 may be further associated with first lower extended portion 424 and second lower extended portion 426 of harness 400.

Base layer 450 can also include medial edge 420 associated with first side portion 410. In some embodiments, medial edge 420 can be provided with first medial portion 472, second medial portion 474 and third medial portion 476. Furthermore, first medial portion 472 may be separated from second medial portion 474 via first medial notch 477. Likewise, second medial portion 474 may be separated from third medial portion 476 by second medial notch 478.

In different embodiments, the shape of one or more medial notches of medial edge 420 can vary. In some cases, first medial notch 477 and second medial notch 478 can have substantially similar shapes. In other cases, first medial notch 477 and second medial notch 478 can have substantially different shapes. In an exemplary embodiment, first medial notch 477 and second medial notch 478 can have a substantially similar shape.

Furthermore, first medial notch 477 and second medial notch 478 can have any shape including, but not limited to: rounded shapes, rectangular shapes, circular shapes, ovular shapes, polygonal shapes, irregular shapes, as well as any other type of shape. In an exemplary embodiment, first medial notch 477 and second medial notch 478 can both have substantially triangular shapes.

Base layer 450 can also include lateral edge 422 associated with second side portion 412. In some embodiments, lateral edge 422 can be provided with first lateral portion 482, second lateral portion 484 and third lateral portion 486. Furthermore, first lateral portion 482 may be separated from second lateral portion 484 via first lateral notch 487. Likewise, second lateral portion 484 may be separated from third lateral portion 486 by second lateral notch 488.

In different embodiments, the shape of one or more lateral notches of lateral edge 422 can vary. In some cases, first lateral notch 487 and second lateral notch 488 can have substantially similar shapes. In other cases, first lateral notch 487 and second lateral notch 488 can have substantially different shapes. In an exemplary embodiment, first lateral notch 487 and second lateral notch 488 can both have substantially similar shapes.

Furthermore, first lateral notch 487 and second lateral notch 488 can have any shape including, but not limited to: rounded shapes, rectangular shapes, circular shapes, ovular shapes, polygonal shapes, irregular shapes, as well as any other type of shape. In an exemplary embodiment, first lateral notch 487 and second lateral notch 488 can both have substantially triangular shapes.

Although the current embodiment includes medial and lateral edges shaped to include two notches, in other embodiments a medial and/or lateral edge could include a different number of notches. For example, in another embodiment, a medial edge and a lateral edge could each include a single notch. In still another embodiment, a medial edge and a lateral edge could each include three or more notches. In still another embodiment, a medial and/or lateral edge could be provided without notches.

Threading layer 452 may comprise threads 460. Generally, threads 460 may be associated with base layer 450 in any manner. In some cases, portions of threads 460 can extend through base layer 450. In areas where threads 460 extend through base layer 450, threads 460 may be directly joined or otherwise secured to base layer 450. In other cases, portions of threads 460 can lie adjacent to base layer 450. In areas where threads 460 lie adjacent to base layer 450, threads 460 may be unsecured to base layer 450 or may be joined using a connecting layer or other securing element that bonds, secures, or otherwise joins portions of threads 460 to base player 450.

In order to form structural elements in harness 400, multiple threads 460 or sections of an individual thread 460 may be collected into one of various thread groups. In an exemplary embodiment, threads 460 can include first thread group 461, second thread group 462, third thread group 463 and fourth thread group 464. In particular, first thread group 461 includes threads 460 that extend between first lateral portion 482 and first medial portion 472 of base layer 450. Second thread group 462 includes threads 460 that extend between second lateral portion 484 and second medial portion 474 of base layer 450. In some cases, some threads 460 of second thread group 462 also extend between second lateral portion 484 and lower edge 490 of harness 400. In addition, some threads 460 of second thread group 462 can also extend between second medial portion 474 and lower edge 490. Third thread group includes threads 460 that extend between third lateral portion 486 and lower edge 490 of base layer 450. In a similar manner, fourth thread group includes threads 460 that extend between third medial portion 476 and lower edge 490 of base layer 450.

Figure 18:
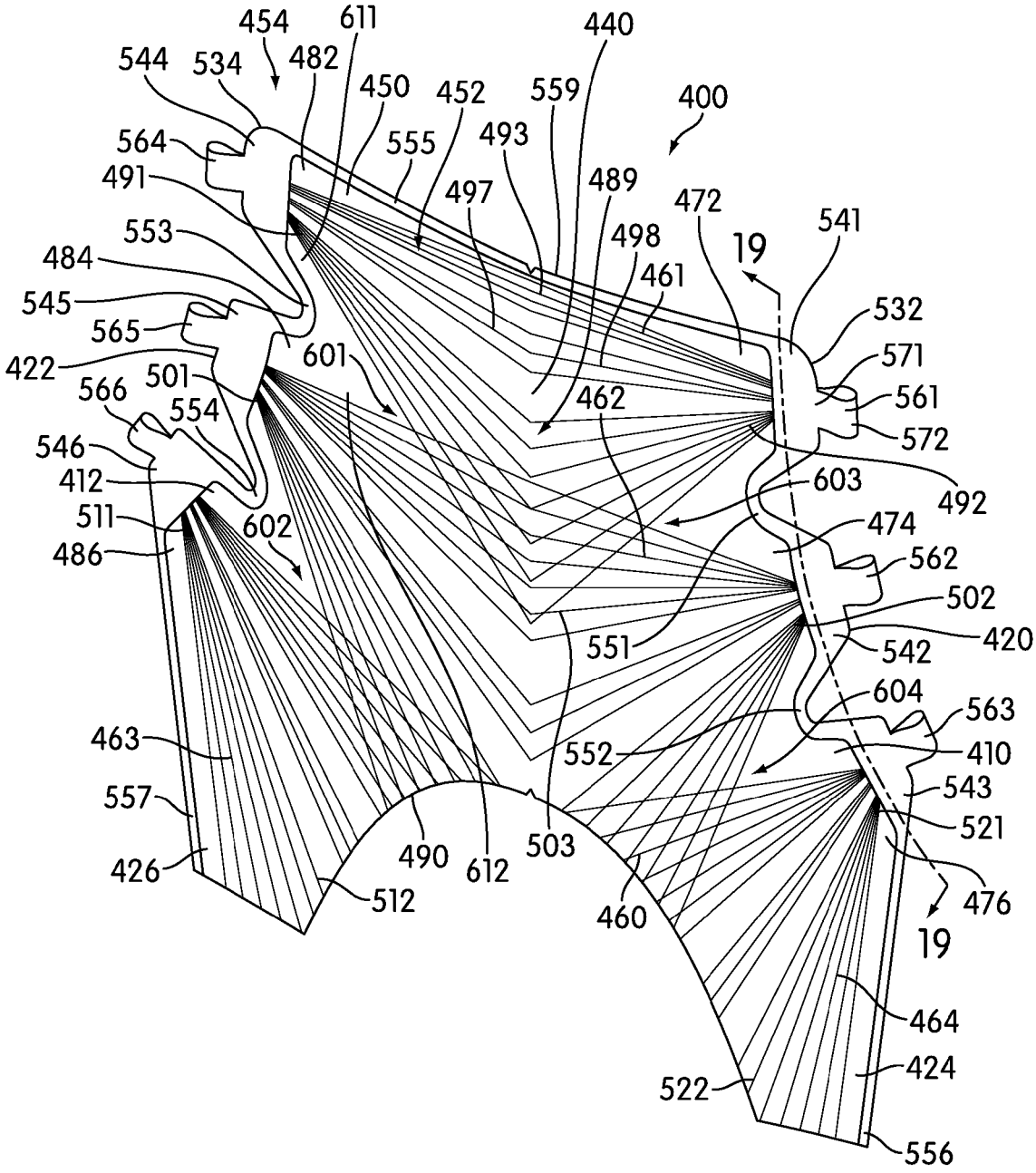
FIG. 18 is an isometric view of an exemplary embodiment of a harness in a flattened position.
Figure 19:
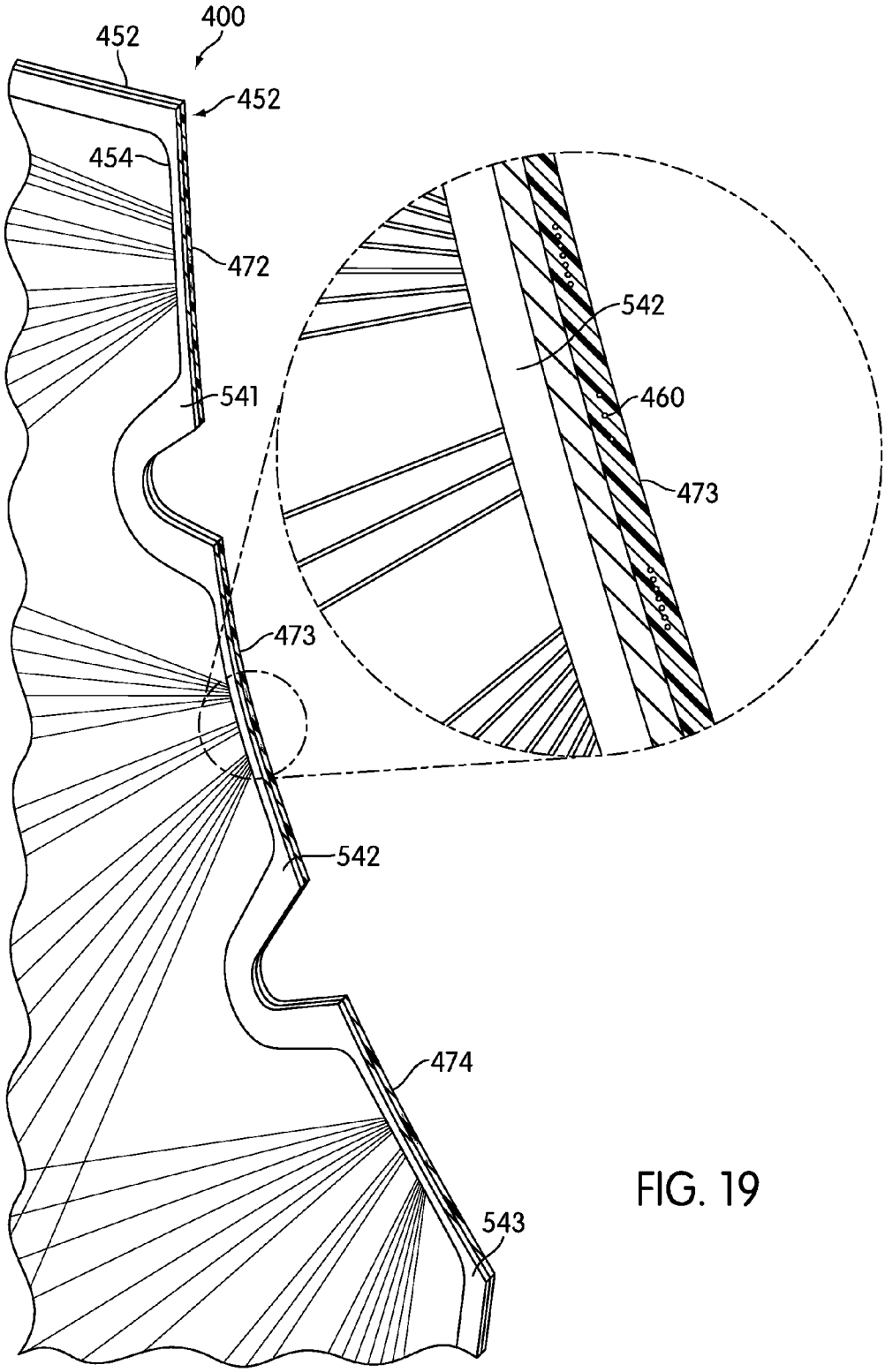
FIG. 19 is an isometric cross-sectional view of an exemplary embodiment of a harness.

Referring to FIG. 18, each thread group includes threads that extend radially outward from medial and lateral portions of base layer 450. For example, first thread group 461 includes first end portion 491 associated with first lateral portion 482 and second end portion 492 associated with first medial portion 472. In addition, first thread group 461 includes intermediate portion 493 that is associated with central portion 489 of base layer 450. In this exemplary embodiment, threads 460 are tightly packed together at first end portion 491. Moving from first end portion 491 to intermediate portion 493, threads 460 may expand radially outward. In other words, adjacent threads 460 may be spaced further apart at intermediate portion 493 than at first end portion 491. In a similar manner, threads 460 are tightly packed together at second end portion 492. Moving from second end portion 492 to intermediate portion 493, threads 460 may expands radially outwards. In other words, adjacent threads 460 may be spaced further apart at intermediate portion 493 than at second end portion 492.

Second thread group 462 can include first end portion 501 associated with second lateral portion 484 and second end portion 502 associated with second medial portion 474. In addition, second thread group 462 includes intermediate portion 503 that is associated with central portion 489 of base layer 450. In this exemplary embodiment, threads 460 are packed together at first end portion 501 and second end portion 502. Moving towards intermediate portion 503 from either first end portion 501 or second end portion 502, threads 460 may expand radially outwards.

Third thread group 463 can include first end portion 511 associated with third lateral portion 486. Third thread group 463 can also include second end portion 512 associated with lower edge 490 of base layer 450. In this exemplary embodiment, threads 460 are packed tightly at first end portion 511 and expand radially outward towards second end portion 512. In a similar manner, fourth thread group 464 can include first end portion 521 associated with third medial portion 476. Fourth thread group 464 can also include second end portion 522 associated with lower edge 490 of base layer 450. In this exemplary embodiment, threads 460 are packed tightly at first end portion 521 and expand radially outwards towards second end portion 522.

In different embodiments, threads of a thread group can be arranged in various ways. For example, in some cases, each thread of a thread group can be extended in a substantially straight manner from a first end portion to a second end portion of the thread group. In other cases, however, a thread may have various portions that are angled with respect to one another. In still other cases, a thread may be arranged in a curved shape.

In an exemplary embodiment, first thread group 461 can include first thread segment 497 that extends in a generally straight manner from first end portion 491 to intermediate portion 493. Likewise, first thread group 461 can include second thread segment 498 that extends in a generally straight manner from second end portion 492 to intermediate portion 493. In this embodiment, first thread segment 497 may be angled with respect to second thread segment 498 at intermediate portion 493. In some cases, this angled arrangement between first thread segment 497 and second thread segment 498 can be achieved by stitching down intermediate portion 493 of first thread group 491. In a similar manner, each of the threads 460 associated with second thread group 462, third thread group 463 and fourth thread group 464 can be arranged in a substantially straight manner or as a plurality of thread segments that are angled with respect to one another.

The process of applying threads 460 to base layer 450 can be achieved using any method known in the art. In particular, the order of application of different threads from various thread groups can vary from one embodiment to another. Examples of a process for applying threads to an upper for an article of footwear are discussed in the thread structural elements cases. It will be understood that similar methods could be used for applying threads to a base layer for a harness.

In different embodiments, each thread of threads 460 may be secured to base layer 450 in various ways. In one embodiment, threads 460 of first thread group 461, for example, can be secured to base layer 450 at first end portion 491 and second end portion 492 using a lock stitch. In addition, intermediate portion 493 of first thread group 461 may be attached to base layer 450 using a connecting layer that bonds, secures, or otherwise joins portions of threads 460 to base layer 450. In other embodiments, however, threads 460 of first thread group 461 could be embedded in base layer 450, especially in embodiments where base layer 450 comprises a polymer layer. Threads 460 of second thread group 462, third thread group 463 and fourth thread group 464 can also be applied to base layer 450 in any manner discussed above.

During use of article of footwear 100, forces induced in article 100 may tend to stretch harness 400 in various directions, and the forces may be concentrated at various locations. Each of threads 460 are located to form structural elements in harness 400. More particularly, first thread group 461, second thread group 462, third thread group 463 and fourth thread group 464 are collections of multiple threads 460 or sections of an individual thread 460 that form structural elements to resist stretching in various directions or reinforce locations where forces are concentrated. First thread group 461 and second thread group 462 generally extend from medial edge 420 and lateral edge 422 of harness 400 to central portion 440 of harness 400 to resist stretch in a longitudinal direction. In addition, third thread group 463 and fourth thread group 464 generally extend from medial edge 420 and lateral edge 422 to lower edge 490 to resist stretch in a substantially vertical direction.

A harness can include provisions for associating with a lacing system of an article of footwear. In some embodiments, the harness can include a layer associated with one or more lace receiving members. In an exemplary embodiment, the harness can include a layer that provides lace receiving members and also helps to reinforce one or more thread groups of a threading layer.

Harness 400 can include peripheral layer 454. In different embodiments, peripheral layer 454 can have any shape. In some cases, peripheral layer 454 can have a shape that confronts a substantial entirety of base layer 450. In other cases, peripheral layer 454 can have a shape that confronts only a portion of base layer 450. In an exemplary embodiment, peripheral layer 454 can have a shape configured to confront outer peripheral portion 499 of base layer 450. In other words, peripheral layer 454 may be configured as a peripheral lining that is only disposed on an outer edge of harness 400.

Peripheral layer 454 can include first portion 532 and second portion 534. First portion 532 may include first tab portion 541, second tab portion 542 and third tab portion 543. In addition, second portion 534 can include fourth tab portion 544, fifth tab portion 545 and sixth tab portion 546. In some embodiments, first tab portion 541 may be connected to second tab portion 542 via first segment 551. Also, second tab portion 542 may be connected to third tab portion 543 via second segment 552. In addition, fourth tab portion 544 may be connected to fifth tab portion 545 via third segment 553. Also, fifth tab portion 545 may be connected to sixth tab portion 546 via fourth segment 554. In some cases, first tab portion 541 and fourth tab portion 544 can be attached via fifth segment 555. Finally, peripheral layer 454 can also include sixth segment 556 and seventh segment 557 that extend away from third tab portion 543 and sixth tab portion 546, respectively.

In some embodiments, one or more tab portions of peripheral layer 454 may have shapes that correspond to the shape of outer peripheral portion 499. In some cases, first tab portion 541, second tab portion 542 and third tab portion 543 may be configured to confront first medial portion 472, second medial portion 474 and third medial portion 476 of base layer 450. Likewise, in some cases, fourth tab portion 544, fifth tab portion 545 and sixth tab portion 546 may be configured to confront first lateral portion 482, second lateral portion 484 and third lateral portion 486 of base layer 450.

In some embodiments, one or more segments of peripheral layer 454 may correspond to outer peripheral portion 499. In some cases, first segment 551 and second segment 552 may be shaped in a manner that corresponds to first medial notch 477 and second medial notch 478, respectively. In particular, first segment 551 and second segment 552 may be substantially v-shaped segments that correspond to the edges of first medial notch 477 and second medial notch 478. In some cases, third segment 553 and fourth segment 554 may be shaped in a manner that corresponds to first lateral notch 487 and second lateral notch 488, respectively. In particular, third segment 553 and fourth segment 554 may be substantially v-shaped segments that corresponds to the edges of first lateral notch 487 and second lateral notch 488. Furthermore, fifth segment 555 can be associated with upper edge 559 of base layer 450. Also, sixth segment 556 and seventh segment 557 can be associated with portions of lower edge 490 of base layer 450.

In some embodiments, peripheral layer 454 can include provisions for attaching to a lacing member. In some cases, peripheral layer 454 can include one or more lacing guides disposed on one or more tab portions. In other cases, peripheral layer 454 can include apertures or holes that are disposed on one or more tab portions to receive a lacing member. In an exemplary embodiment, peripheral layer 454 can include one or more lacing loops that are disposed on one or more tab portions, which are configured to receive a lacing member for the purposes of tightening harness 400.

In one embodiment, peripheral layer 454 can include first lace loop 561, second lace loop 562, third lace loop 563, fourth lace loop 564, fifth lace loop 565 and sixth lace loop 566. In some cases, each lace loop may be disposed on a corresponding tab portion of peripheral layer 454. In this exemplary embodiment, first lace loop 561 can be disposed on first tab portion 541 of peripheral layer 454. In a similar manner, second lace loop 562, third lace loop 563, fourth lace loop 564, fifth lace loop 565 and sixth lace loop 566 can be disposed on second tab portion 542, third tab portion 543, fourth tab portion 544, fifth tab portion 545 and sixth tab portion 546, respectively.

Generally, lace loops can be attached to tab portions of peripheral layer 454 in any manner. In some cases, first lace loop 561 can comprise an extended portion of first tab portion 541. Referring to FIG. 18, first end portion 571 of first lace loop 561 may be integrally formed with first tab portion 541.

In addition, second end portion 572 of first lace loop 561 may be fixedly attached to first tab portion 541 using any manner known in the art including, but not limited to: adhesives, fusing, stitching, or other methods. In other cases, first lace loop 561 could be made separately from first tab portion 541 and both first end portion 571 and second end portion 572 could be fixedly attached to first tab portion 541 using any of the methods discussed above. In a similar manner, each of the remaining lace loops, including second lace loop 562, third lace loop 563, fourth lace loop 564, fifth lace loop 565 and sixth lace loop 566 could be associated with second tab portion 542, third tab portion 543, fourth tab portion 544, fifth tab portion 545 and sixth tab portion 546 in any manner.

In different embodiments, the materials used for each of the layers of harness 400 may vary. Base layer 450 may be formed from any generally two-dimensional material. The term "two-dimensional material" as used through this detailed description and in the claims refers to any generally flat material exhibiting a length and width that are substantially greater than a thickness of the material. Examples of different materials that could be used for base layer 450 include, but are not limited to: various textiles, polymer sheets, or combinations of textiles and polymer sheets. Textiles are generally manufactured from fibers, filaments, or yarns that are, for example, either (a) produce direction from webs of fibers by bonding, fusing or interlocking to construct non-woven fabrics and felts or (b) formed through a mechanical manipulation of yarn to produce a woven fabric. The textiles may incorporate fibers that are arranged to impart one-directional stretch or multi-directional stretch, and the textiles may include coatings that form a breathable and water resistant barrier. The polymer sheets may be extruded, rolled, or otherwise formed from a polymer material to exhibit a generally flat aspect. Two-dimensional materials may also encompass laminated or otherwise layered materials that include two or more layers of textiles, polymer sheets, or combinations of textiles and polymer sheets. In addition to textiles and polymer sheets, other two-dimensional materials may be utilized for base layer 450. Although two-dimensional materials may have smooth or generally untextured surfaces, some two-dimensional materials will exhibit textures or other surface characteristics, such as dimpling, protrusions, ribs, or various patterns, for example. Despite the presence of surface characteristics, two-dimensional materials remain generally flat and exhibit a length and a width that are substantially greater than a thickness.

In embodiments where base layer 450 comprises a textile material, base layer 450 can be any type of textile material. Examples of different textile materials include, but are not limited to: plant based textiles (such as cotton), mineral textiles (such as glass fiber), synthetic textiles (such as polyester, aramid, acrylic, nylon, spandex, olefin fiber, ingeo and lurex), as well as other textiles. It will also be understood that base layer 450 can comprise a combination of various textile materials. As previously mentioned, base layer 450 may also include a combination of textile and polymer materials.

In embodiments where base layer 450 comprises a polymer material, base layer 450 can be any type of polymer. Examples of different types of polymers include synthetic polymers, or plastics, such as thermoplastics, thermosets and elastomers. Some examples of thermoplastics include, but are not limited to: acrylonitrile butadiene styrene (ABS), acrylic (PMMA), celluloid, cellulose acetate, ethylene-vinyl acetate (EVA), ethylene vinyl alcohol (EVOH), fluoroplastics (PTFE), ionomers, Kydex, liquid crystal polymer (LCP), polyacetal (POM or Acetal), polyacrylates (Acrylic), polyacrylonitrile (PAN or Acrylonitrile), polyamide (PA or Nylon), polyamide-imide (PAI), polyaryletherketone (PAEK or Ketone), polybutadiene (PBD), polybutylene (PB), polybutylene terephthalate (PBT), polycaprolactone (PCL), polychlorotrifluoroethylene (PCTFE), polyethylene terephthalate (PET), polycyclohexylene dimethylene terephthalate (PCT), polycarbonate (PC), polyhydroxyalkanoates (PHAs), polyketone (PK), polyester, polyethylene (PE), polyetheretherketone (PEEK), polyetherimide (PEI), polyethersulfone (PES), polyethylenechlorinates (PEC), polyimide (PI), polylactic acid (PLA), polymethylpentene (PMP), polyphenylene oxide (PPO), polyphenylene sulfide (PPS), polyphthalamide (PPA), polypropylene (PP), polystyrene (PS), polysulfone (PSU), polytrimethylene terephthalate (PTT), polyurethane (PU), polyvinyl acetate (PVA), polyvinyl chloride (PVC), polyvinylidene chloride (PVDC), styrene-acrylonitrile (SAN) as well as any other type of thermoplastic. In an exemplary embodiment, base layer 450 may comprise a layer of thermoplastic urethane (TPU).

Threads 460 may be formed from any generally one-dimensional material. As utilized with respect to the present invention, the term "one-dimensional material" or variants thereof is intended to encompass generally elongated materials exhibiting a length that is substantially greater than a width and a thickness. Accordingly, suitable materials for threads 460 include various filaments and yarns, for example. Filaments may be formed from a plurality of synthetic materials such as rayon, nylon, polyester, and polyacrylic, with silk being the primary, naturally-occurring exception. In addition, various engineering fibers, such as aramid fibers, para-aramid fibers, and carbon fibers, may be utilized. Yarns may be formed from at least one filament or a plurality of fibers. Whereas filaments have an indefinite length, fibers have a relatively short length and generally go through spinning or twisting processes to produce a yarn of suitable length. With regarding to yarns formed from filaments, these yarns may be formed from a single filament or a plurality of individual filaments grouped together. Yarns may also include separate filaments formed from different materials, or yarns may include filaments that are each formed from two or more different materials. Similar concepts also apply to yarns formed from fibers. Accordingly, filaments and yarns may have a variety of configurations exhibiting a length that is substantially greater than a width and a thickness. In addition to filaments and yarns, other one-dimensional materials may be utilized for threads. Although one-dimensional materials will often have a cross-section where width and thickness are substantially equal (e.g., a round or square cross-section), some one-dimensional materials may have a width that is greater than a thickness (e.g., a rectangular cross-section). Despite the greater width, a material may be considered one-dimensional if a length of the material is substantially greater than a width and a thickness of the material.

Peripheral layer 454 may also be formed from any substantially two-dimensional layer. Furthermore, the materials used for peripheral layer 454 can be any type of material including textile materials, polymer materials, or any combination of textile and polymer materials. In some cases, materials for peripheral layer 454 can be selected to provide substantial bonding between base layer 450 and peripheral layer 454. In addition, materials can be selected that include high tensile strength, since segments of peripheral layer 454 may be narrow and exposed to various strains along the edges of harness 400.

A harness can include provisions for increasing the flexibility of edges of a harness that are configured with one or more lace loops. In embodiments including a threading layer, the threads may be packed closely together at end portions adjacent to one or more lace loops. In particular, the threads may form thread groups that are spaced apart adjacent to the lace loops. In an exemplary embodiment, the base layer of a harness may include notches that correspond to the spacing between threads adjacent to one or more lace loops.

In the exemplary embodiment, threads 460 of first thread group 461, second thread group 462, third thread group 463 and fourth thread group 464 are packed tightly at end portions disposed adjacent to lateral edge 422 and medial edge 420 of base layer 450. In particular, first thread group 461 has an approximately pointed shape adjacent to first medial portion 472 and first lateral portion 482. Likewise, second thread group 462 has an approximately pointed shape adjacent to second medial portion 474 and second lateral portion 484. Also, third thread group 463 and fourth thread group 464 have approximately pointed shapes adjacent to third lateral portion 486 and fourth medial portion 476, respectively.

In an exemplary embodiment, first end portion 491 of first thread group 461 may be spaced apart from first end portion 501 of second thread group 462 by first thread gap 601. In addition, second end portion 492 of first thread group 461 may be spaced apart from second end portion 502 of second thread group 462 by second thread gap 602. In a similar manner, first end portion 501 of second thread group 462 may be spaced apart from first end portion 511 of third thread group 463 by third thread gap 603. Also, second end portion 502 of second thread group 462 may be spaced apart from first end portion 521 of fourth thread group 464 by fourth thread gap 604.

Generally, first thread gap 601, second thread gap 602, third thread gap 603 and fourth thread gap 604 may be associated with any shape. Examples of different shapes include, but are not limited to: circular shapes, ovular shapes, rectangular shapes, triangular shapes, polygonal shapes, irregular shapes as well as any other types of shapes. In an exemplary embodiment, first thread gap 601, second thread gap 602, third thread gap 603 and fourth thread gap 604 may have approximately triangular or wedge-like shapes. For example, first thread gap 601 can have a wedge like shape defined by first thread edge 611 of first thread group 461 and second thread edge 612 of second thread group 462. In a similar manner, each of the remaining thread gaps may have substantially similar wedge-like shapes to first thread gap 601.

In some cases, one or more layers adjacent to threading layer 452 can include gaps or notches that correspond to the thread gaps of threading layer 452. In one embodiment, first lateral notch 487 of base layer 450 can correspond to first thread gap 601 of threads 460. In particular, first lateral notch 487 extends into first thread gap 601. In a similar manner, second lateral notch 488 of base layer 450 can correspond to second thread gap 602 of threads 460. In particular, second lateral notch 488 extends into second thread gap 602. In a similar manner, first medial notch 477 of base layer 450 can correspond to third thread gap 603 of threads 460. In particular, first medial notch 477 extends into third thread gap 603. In a similar manner, second medial notch 478 of base layer 450 can correspond to fourth thread gap 604 of threads 460. In particular, second medial notch 478 extends into fourth thread gap 604.

With this arrangement, a substantial majority of the surface area of base layer 450 is reinforced with threads 460 in order to enhance the overall strength of harness 400. In particular, by removing areas of base layer 450 that are not disposed adjacent to, or disposed beneath, threads 460, this arrangement reduces or substantially eliminates regions of base layer 450 that may be weaker.

As previously discussed, peripheral layer 454 may have a shape that corresponds to the notches of base layer 450. In particular, peripheral layer 454 may include first segment 551, second segment 552, third segment 553 and fourth segment 554 that are shaped to correspond to the edges of first medial notch 477, second medial notch 478, first lateral notch 487 and second lateral notch 488, respectively. With this arrangement, first segment 551 may also correspond to the shape of third thread gap 603. In other words, first segment 551 may be disposed between first thread group 461 and second thread group 462. Likewise, second segment 552 may correspond to the shape of fourth thread gap 604. In other words, second segment 552 may be disposed between second thread group 462 and fourth thread group 464. Additionally, third segment 553 may correspond to the shape of first thread gap 601. In other words, third segment 553 may be disposed between first thread group 461 and second thread group 462. Finally, fourth segment 554 may correspond to the shape of second thread gap 602. In other words, fourth segment 554 may be disposed between second thread group 462 and third thread group 463. This arrangement for peripheral layer 454 can help reinforce regions where threads 460 are not provided on base layer 450.

In addition to enhancing the strength of a majority of the surface area of harness 400, these provisions can also help to reduce the costs of producing harnesses, since less material is required. Furthermore, this configuration can help reduce the weight of harness 400, by decreasing the overall surface area of harness 400. Such reductions in weight can be useful since boot-like articles are typically heavier than traditional low-top articles, which can inhibit comfort and mobility for a user. By reducing the weight of any components of the article, such as the harness, the experience of the user in activities such as snowboarding can be enhanced.

In some previous designs, threads have attached to portions of a base layer. However, these designs have lacked provisions for reinforcing the end portions of the threads with a layer that opposes the base layer. In contrast to such designs, the current design includes provisions for reinforcing the attachment of the threads to a harness by applying a peripheral layer over the first end portions of the threads.

In some embodiments, first tab portion 541 may be disposed over second end portion 492 of first thread group 461. In particular, first tab portion 541 may be configured to confront first medial portion 472 of base layer 450 such that second end portion 492 of first thread group 461 is disposed between first tab portion 541 and first medial portion 472. With this arrangement, first tab portion 541 can help to reinforce second end portion 492 of first thread group 461, which can help prevent detachment of threads 460 associated with second end portion 492.

In a similar manner, second tab portion 542, third tab portion 543, fourth tab portion 544, fifth tab portion 545 and sixth tab portion 546 may be configured to reinforce second medial portion 474, third medial portion 476, first lateral portion 482, second lateral portion 484 and third lateral portion 486 of base layer 450. Therefore, the end portions of threads 460 may be surrounded by protective layers to help prevent detachment of threads 460 from base layer 450.

A conventional harness for an upper may be formed from multiple material layers that each impart different properties to various areas of the harness. During use, the harness may experience significant tensile forces, and one or more layers of material are positioned in areas of the harness to resist the tensile forces. That is, individual layers may be incorporated into specific portions of the harness to resist tensile forces that arise during use of the footwear. As an example, a woven textile may be incorporated into a harness to impart stretch resistance in the longitudinal direction. A woven textile is formed from yarns that interweave at right angles to each other. If the woven textile is incorporated into the upper for purposes of longitudinal stretch-resistance, then only the yarns oriented in the longitudinal direction will contribute to longitudinal stretch-resistance, and the yarns oriented orthogonal to the longitudinal direction will not generally contribute to longitudinal stretch-resistance. Approximately one-half of the yarns in the woven textile are, therefore, superfluous to longitudinal stretch-resistance. As a further example, the degree of stretch-resistance required in different areas of the harness may vary. Whereas some areas of the harness may require a relatively high degree of stretch-resistance, other areas of the harness may require a relatively low degree of stretch-resistance. Because the woven textile may be utilized in areas requiring both high and low degrees of stretch-resistance, some of the yarns in the woven textile are superfluous in areas requiring the low degree of stretch-resistance. In each of these examples, the superfluous yarns add to the overall mass of the footwear, without adding beneficial properties to the footwear. Similar concepts apply to other materials, such as leather and polymer sheets, that are utilized for one or more of wear-resistance, flexibility, air-permeability, cushioning, and moisture-wicking, for example.

Based upon the above discussion, materials utilized in the conventional harness formed from multiple layers of material may have superfluous portions that do not significantly contribute to the desired properties of the harness. With regard to stretch-resistance, for example, a layer may have material that imparts (a) a greater number of directions of stretch-resistance or (b) a greater degree of stretch-resistance than is necessary or desired. The superfluous portions of these materials may, therefore, add to the overall mass of the footwear without contributing beneficial properties.

In contrast with the conventional layered construction, harness 400 is constructed to minimize the presence of superfluous material. Base layer 450 provides a large surface area to wrap around a foot, but exhibits a relatively low mass. In addition, some of the thread groups of first thread group 461, second thread group 462, third thread group 463 and fourth thread group 464 are located to provide stretch resistance in predetermined directions and the number of threads 460 are selected to impart the desired amount of stretch resistance. In addition, some of the thread groups of first thread group 461, second thread group 462, third thread group 463 and fourth thread group 464 are located to reinforce specific areas of harness 400. With this arrangement, the orientations, locations and quantity of threads 460 are selected to provide structural elements for harness 400 that are tailored for a specific purpose.

Threads 460 may be utilized to modify properties of article 100 other than stretch resistance. For example, threads 460 may be utilized to provide additional wear-resistance in specific areas of harness 400. For example, threads 460 may be utilized for wear resistance. If utilized for wear resistance, threads 460 may be selected from materials that also exhibit relatively high wear-resistance properties. Threads 460 may also be utilized to modify the flex characteristics of harness 400. That is, areas with relatively high concentrations of threads 460 may flex to a lesser degree than areas with relatively low concentrations of threads 460. Similarly, areas with relatively high concentrations of threads 460 may be less air-permeable than areas with relatively low concentrations of threads 460.

Figure 20:
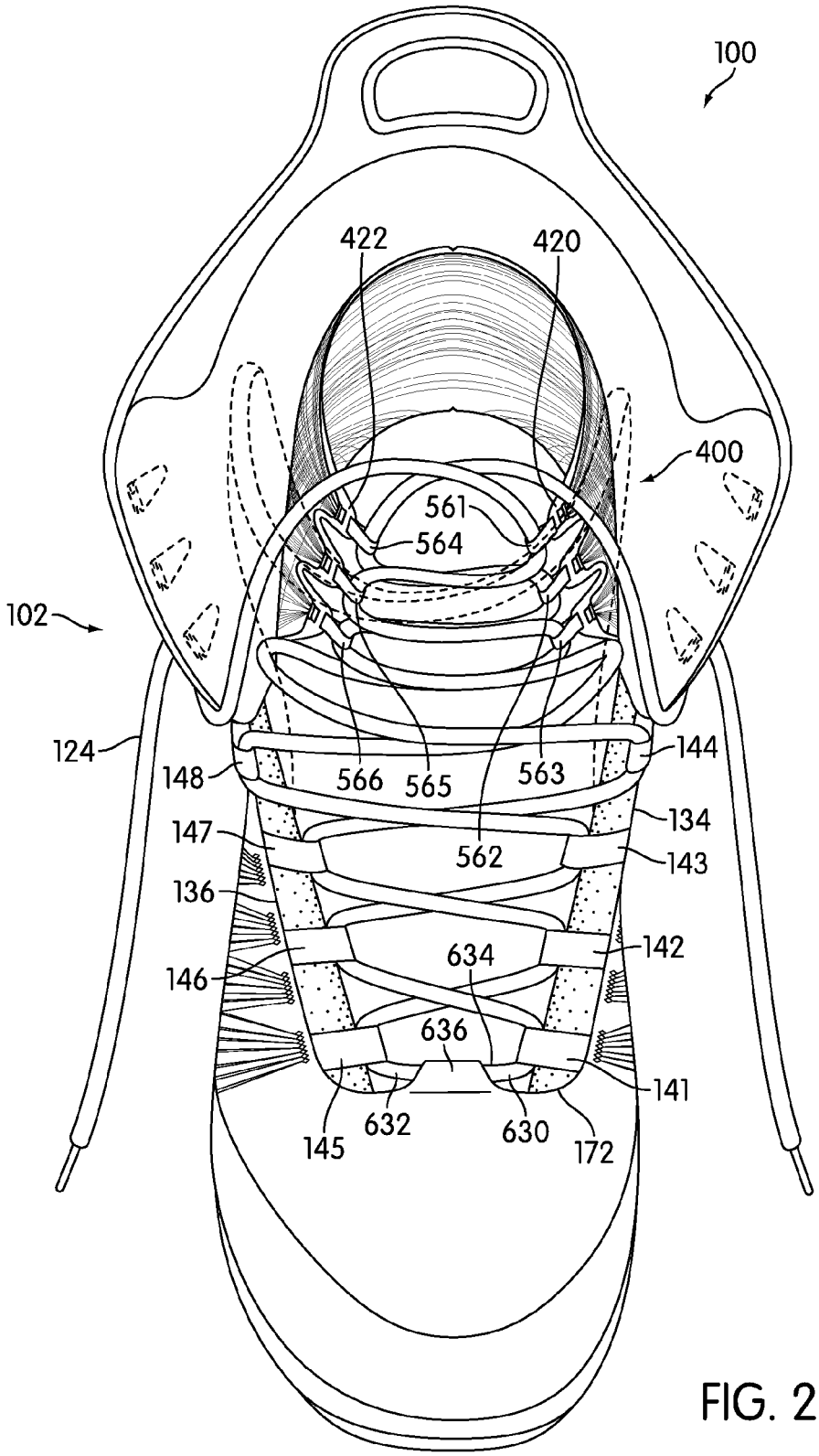
FIG. 20 is a top isometric view of an exemplary embodiment of a lacing arrangement for an article of footwear including a harness.
Figure 21:
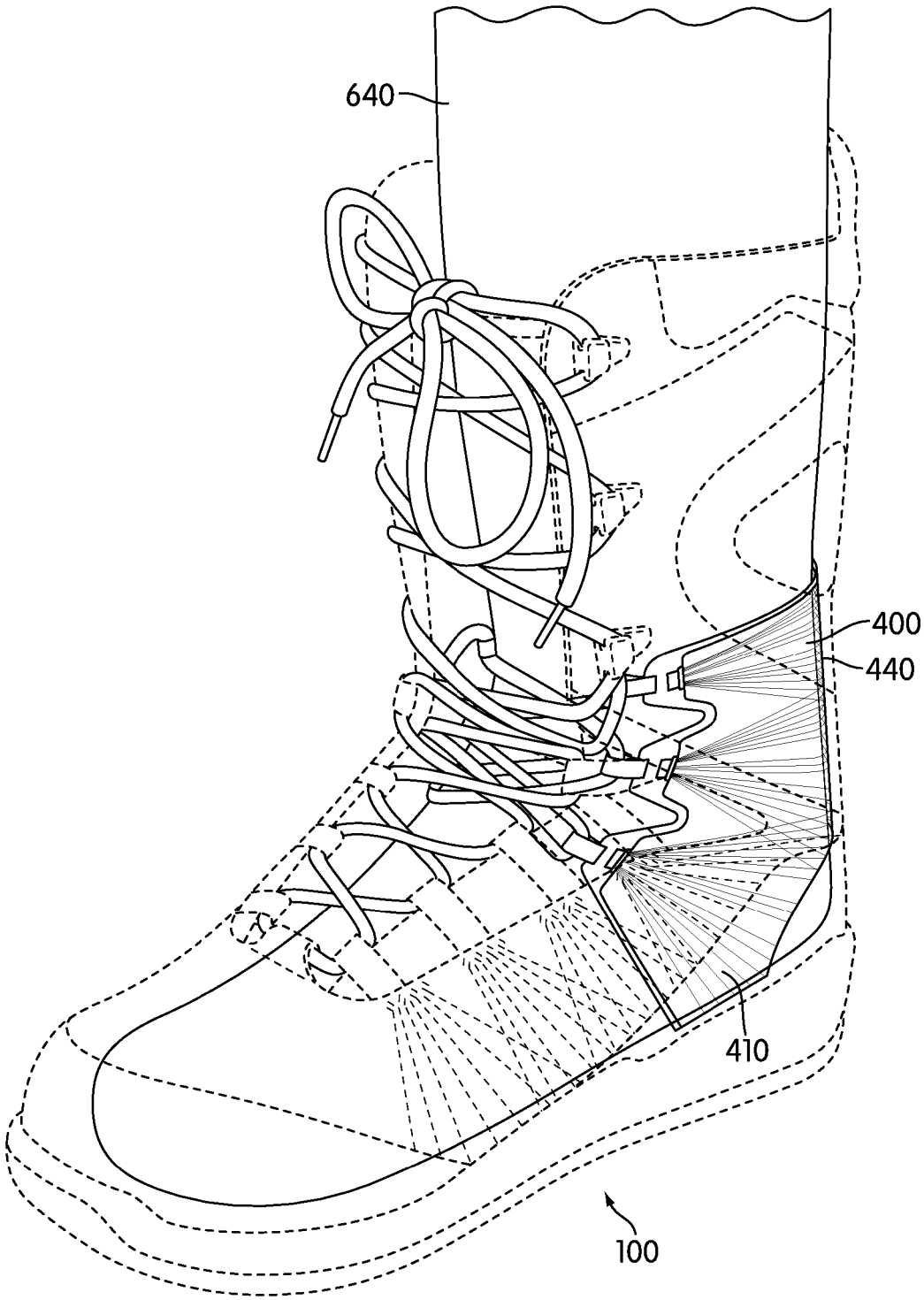
FIG. 21 is an isometric view of an exemplary embodiment of an article of footwear with a harness tightened around a foot.
Figure 22:
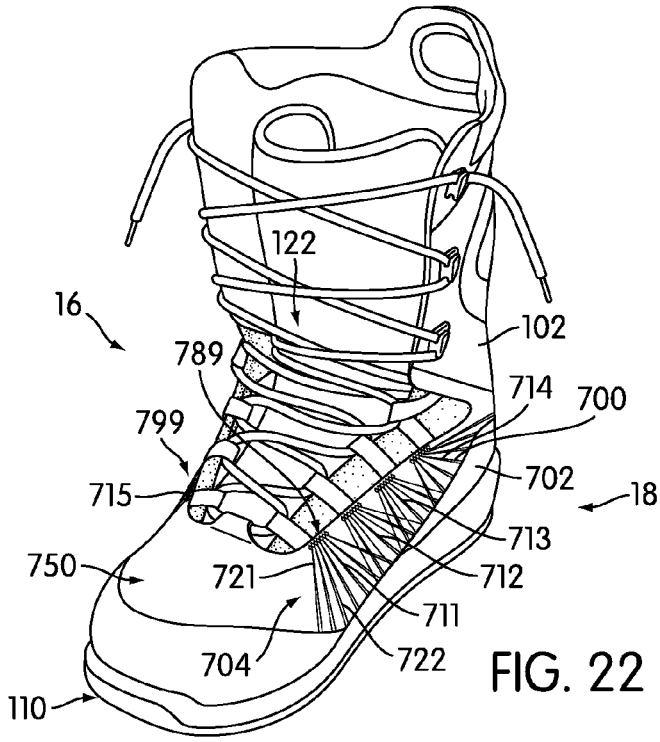
FIG. 22 is an isometric view of an exemplary embodiment of an upper of an article of footwear including external threads.

FIGS. 20 and 21 illustrate exemplary embodiments of harness 400 being used within article 100. In particular, FIG. 20 illustrates an exemplary lacing arrangement for harness 400 within article 100 and FIG. 21 illustrates an exemplary embodiment of harness 400 in a tightened position within article 100.

Referring to FIGS. 20 and 21, lacing member 124 may be disposed through a plurality of lace loops of article 100. For purposes of clarity, lacing member 124 is divided into first portion 630 and second portion 632 which correspond to two evenly divided halves of lacing member 124. In particular, first portion 630 and second portion 632 are integrally joined at central lace portion 634 that is inserted through toe lacing guide 636 disposed at first end portion 172 of lacing region 122.

In this embodiment, first portion 630 extends from toe lacing guide 636 to first lace loop 141, then to sixth lace loop 146, back to third lace loop 143 and then to eighth lace loop 148. In an alternating manner, second portion 632 extends from toe lacing guide 636 to fifth lace loop 145, then to second lace loop 142, back to seventh lace loop 147 and then to fourth lace loop 144. At this point, first end portion 630 and second end portion 632 extend to the lacing loops of harness 400. In particular, first end portion 630 extends from eighth lace loop 148 of lace loop set 130 to third lace loop 563 of harness 400. Also, second end portion 632 extends from fourth lace loop 144 of lace loop set 130 to sixth lace loop 566 of harness 400. First end portion 630 then extends from third lace loop 563 through fifth lace loop 565 and then through first lace loop 561 of harness 400. In an alternating manner, second end portion 632 extends from sixth lace loop 566 through second lace loop 562 and then through fourth lace loop 564 of harness 400. At this point, first end portion 630 and second end portion 632 can be laced through first lace hook 201, second lace hook 202, third lace hook 203, fourth lace hook 204, fifth lace hook 205 and sixth lace hook 206 in an alternating manner in order to fully fasten article 100.

With this arrangement, as lacing member 124 is tightened, lower medial edge 134 can be pulled together with lower lateral edge 136. In addition, upper medial edge 138 can be pulled together with upper lateral edge 140. Furthermore, medial edge 420 of harness 400 can be pulled together with lateral edge 422 of harness 400. This arrangement allows upper 102 to be tightened around a foot.

In this exemplary embodiment, harness 400 provides increased stability for foot 640. In particular, first side portion 410 and second side portion 412 are configured to wrap around medial and lateral sides of foot 640. Also, central portion 440 of harness 400 is configured to wrap around a rear side of foot 640 above the heel. This arrangement helps to reduce slippage of foot 640 within upper 102.

An article of footwear can include provisions to enhance the strength of portions of an upper. In an exemplary embodiment, an article can be provided with a threading layer that is disposed on an exterior surface of the upper. As previously discussed, by applying a threading layer to a material of an article, that material can be strengthened in various directions to enhance durability and prevent unwanted stretching or twisting of the material.

In one embodiment, upper 102 of article 100 can be provided with threads 700 that are disposed externally on upper 102. In particular, a portion of upper 102 may be formed of a base layer 702 and threading layer 704 that is disposed on base layer 702.

In this exemplary embodiment, threading layer 704 includes threads 700 that are arranged into a plurality of thread groups. In particular, threading layer 704 includes first thread group 711, second thread group 712, third thread group 713 and fourth thread group 714 that are disposed on medial side 18 of base layer 702. In addition, threading layer 704 includes fifth thread group 715, sixth thread group 716, seventh thread group 717 and eighth thread group 718 that are disposed on lateral side 16 of base layer 702. Each thread group can include a first end portion that is disposed adjacent to lacing region 122 and a second end portion disposed adjacent to sole structure 110. For example, first thread group 711 includes first end portion 721 disposed adjacent to lacing region 122 and second end portion 722 that is disposed adjacent to sole structure 110. In a similar manner, second thread group 712, third thread group 713, fourth thread group 714, fifth thread group 715, sixth thread group 716, seventh thread group 717 and eighth thread group 718 also include a first end portion disposed adjacent to lacing region 122 and a second end portion disposed adjacent to sole structure 110.

In some cases, each thread group may have a shape that extends radially outwards from lacing region 122. For example, threads 700 of first thread group 711 are packed closely together at first end portion 721. As threads 700 extend from first end portion 721 to second end portion 722 of first thread group 711, threads 700 are spaced further apart in a radially outward direction. In a similar manner, second thread group 712, third thread group 713, fourth thread group 714, fifth thread group 715, sixth thread group 716, seventh thread group 717 and eighth thread group 718 all extend radially outwards from lacing region 122 to sole structure 110. With threads 400 oriented in a generally vertical direction along base portion 702 of upper 102, threads 700 can provide increased strength in this generally vertical direction. This arrangement may help in stabilizing a snowboarding boot that undergoes vertical forces from the snowboard below the sole and from bindings above the upper.

In a similar manner to the threading layer provided for harness 400, threading layer 704 can provide structural elements for upper 102. In particular, base layer 702 of upper 102 provides a covering for a foot, but exhibits a relatively low mass. In addition, some of the thread groups of first thread group 711, second thread group 712, third thread group 713, fourth thread group 714, fifth thread group 715, sixth thread group 716, seventh thread group 717 and eighth thread group 718 are located to provide stretch resistance in predetermined directions and the number of threads 700 are selected to impart the desired amount of stretch resistance. In addition, some of the thread groups of first thread group 711, second thread group 712, third thread group 713, fourth thread group 714, fifth thread group 715, sixth thread group 716, seventh thread group 717 and eighth thread group 718 are located to reinforce specific areas of upper 102. With this arrangement, the orientations, locations and quantity of threads 700 are selected to provide structural elements for upper 102 that are tailored for a specific purpose.

As previously discussed for a harness, materials utilized in the conventional upper formed from multiple layers of material may have superfluous portions that do not significantly contribute to the desired properties of the upper. With regard to stretch-resistance, for example, a layer may have material that imparts (a) a greater number of directions of stretch-resistance or (b) a greater degree of stretch-resistance than is necessary or desired. The superfluous portions of these materials may, therefore, add to the overall mass of the footwear without contributing beneficial properties.

In contrast with the conventional layered construction, upper is 102 is constructed to minimize the presence of superfluous material. Base layer 702 provides a large surface area to wrap around a foot, but exhibits a relatively low mass. In addition, some of the thread groups of first thread group 711, second thread group 712, third thread group 713, fourth thread group 714, fifth thread group 715 and sixth thread group 716 are located to provide stretch resistance in predetermined directions and the number of threads 700 are selected to impart the desired amount of stretch resistance. In addition, some of the thread groups of first thread group 711, second thread group 712, third thread group 713, fourth thread group 714, fifth thread group 715 and sixth thread group 716 are located to reinforce specific areas of upper 102. With this arrangement, the orientations, locations and quantity of threads 700 are selected to provide structural elements for upper 102 that are tailored for a specific purpose.

Threads 700 may be utilized to modify properties of article 100 other than stretch resistance. For example, threads 700 may be utilized to provide additional wear-resistance in specific areas of upper 102. For example, threads 700 may be utilized for wear resistance. If utilized for wear resistance, threads 700 may be selected from materials that also exhibit relatively high wear-resistance properties. Threads 700 may also be utilized to modify the flex characteristics of upper 102. That is, areas with relatively high concentrations of threads 700 may flex to a lesser degree than areas with relatively low concentrations of threads 700. Similarly, areas with relatively high concentrations of threads 700 may be less air-permeable than areas with relatively low concentrations of threads 700.

As previously discussed, threads embroidered onto a base layer can be provided with a connecting layer to help bond intermediate portions of the threads to the base layer. In this exemplary embodiment, article 100 can be provided with connecting layer 740. In some cases, connecting layer 740 may be a substantially clear polymer layer. For example, in one embodiment connecting layer 740 may be a substantially clear layer of thermoplastic urethane (TPU). Using a clear TPU layer can help maintain the integrity of threading layer 704 without interfering with the design and aesthetic appearance of upper 102.

Generally, connecting layer 740 may have a shape and size to cover over the entirety of threading layer 704. In the exemplary embodiment, connecting layer 740 includes first side portion 742 and second side portion 744. In particular, first side portion 742 may be configured to extend over the entirety of first thread group 711, second thread group 712, third thread group 713 and fourth thread group 714. In some cases, first thread group 711, second thread group 712, third thread group 713 and fourth thread group 714 may be associated with first threading perimeter 789 that defines an outer boundary for first thread group 711, second thread group 712, third thread group 713 and fourth thread group 714. In one embodiment, first side portion 742 may extend within first threading perimeter 789. Furthermore, second side portion 744 may be configured to extend over the entirety of fifth thread group 715, sixth thread group 716, seventh thread group 717 and eighth thread group 718. In some cases, fifth thread group 715, sixth thread group 716, seventh thread group 717 and eighth thread group 718 may be associated with second threading perimeter 799 that defines an outer boundary for fifth thread group 715, sixth thread group 716, seventh thread group 717 and eighth thread group 718. In one embodiment, second side portion 744 may extend within second threading perimeter 799. With this arrangement, threading layer 704 may be substantially connected to base layer 702, which comprises upper 102, of article 100.

An article for use in snowboarding, or similar types of activities, can include provisions for protecting different regions of an upper from contact with a snowboard or other objects. In some embodiments, an article can include one or more protective layers disposed on different regions of an upper to help protect the outer surface of the upper. In embodiments using a connecting layer to facilitate connection of a threading layer to a base layer of the upper, the connecting layer can be extended over a greater surface area so that the connecting layer can provide increased protection over different regions of the upper.

In this exemplary embodiment, connecting layer 740 can include forward portion 746. In some cases, forward portion 746 may be disposed forwards for first side portion 742 and second side portion 744 in a substantially longitudinal direction. In some embodiments, forward portion 746 may extend away, or outside of, first threading perimeter 789 and second threading perimeter 799. The term "threading perimeter" as used throughout this detailed description and in the claims refers to a boundary formed around threads 700, such that each thread group is disposed within the threading perimeter and such that no portion of the threading perimeter is disposed between any two threads.

In some cases, forward portion 746 may extend forwards of threads 700 in a substantially longitudinal direction. In particular, forward portion 746 may extend forward of first thread group 711 in a substantially longitudinal direction. Likewise, forward portion 746 may extend forward of fifth thread group 715 in a substantially longitudinal direction.

Generally, forward portion 756 may be configured to cover any portion of upper 102. In one embodiment, forward portion 746 may be configured to cover a portion of forefoot portion 10 of upper 102. In an exemplary embodiment, forward portion 746 may be configured to cover toe portion 750 of upper 102.

Figure 24:
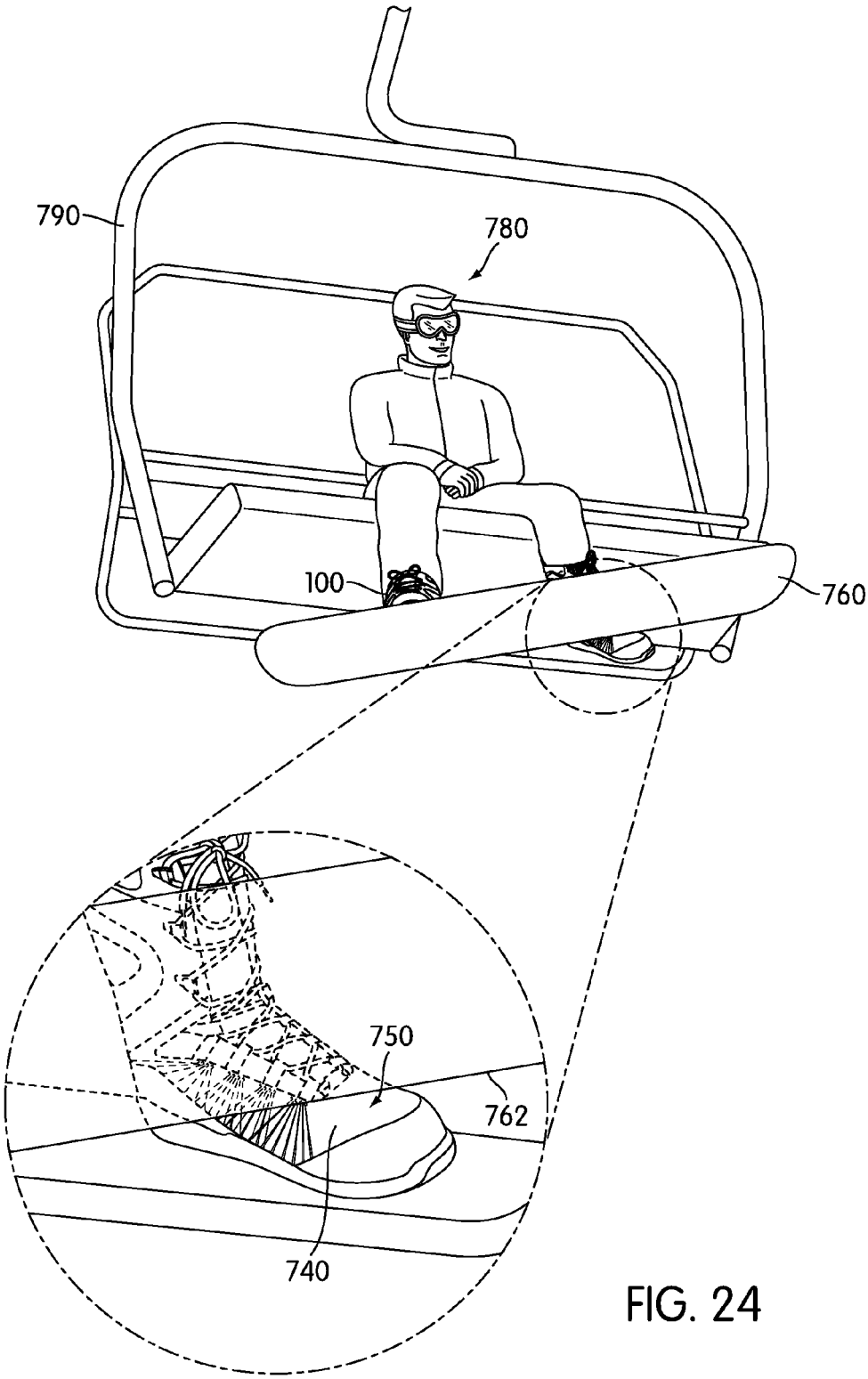
FIG. 24 is an enlarged view of an exemplary embodiment of an article of footwear including a connecting layer disposed over a toe portion of an upper and a snowboard edge resting on the connecting layer at the toe portion.
Figure 25:
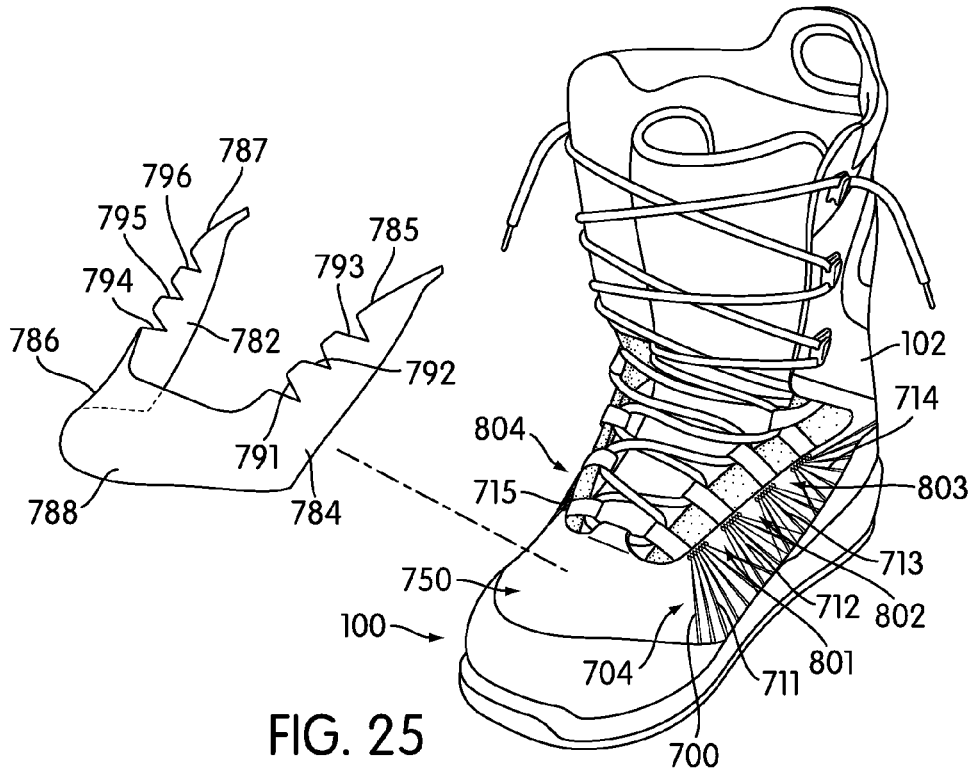
FIG. 25 is an isometric view of another embodiment of an article of footwear including a threading layer and a connecting layer.
Figure 26:
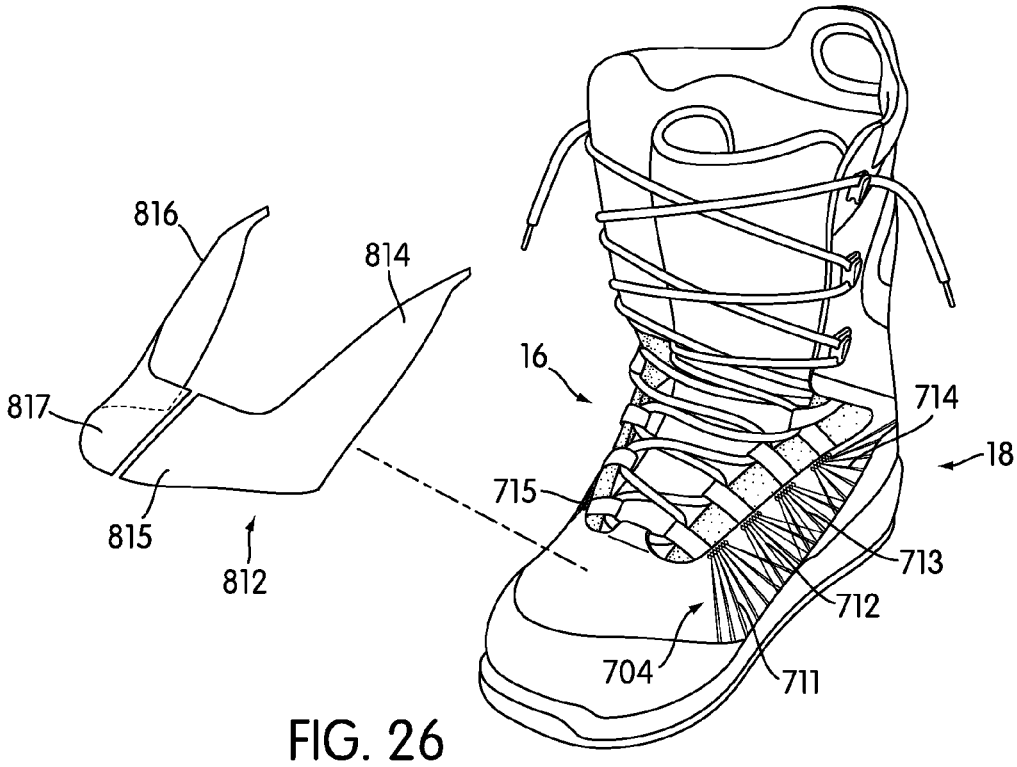
FIG. 26 is an isometric view of another embodiment of an article of footwear including a threading layer and a connecting layer.
Figure 27:
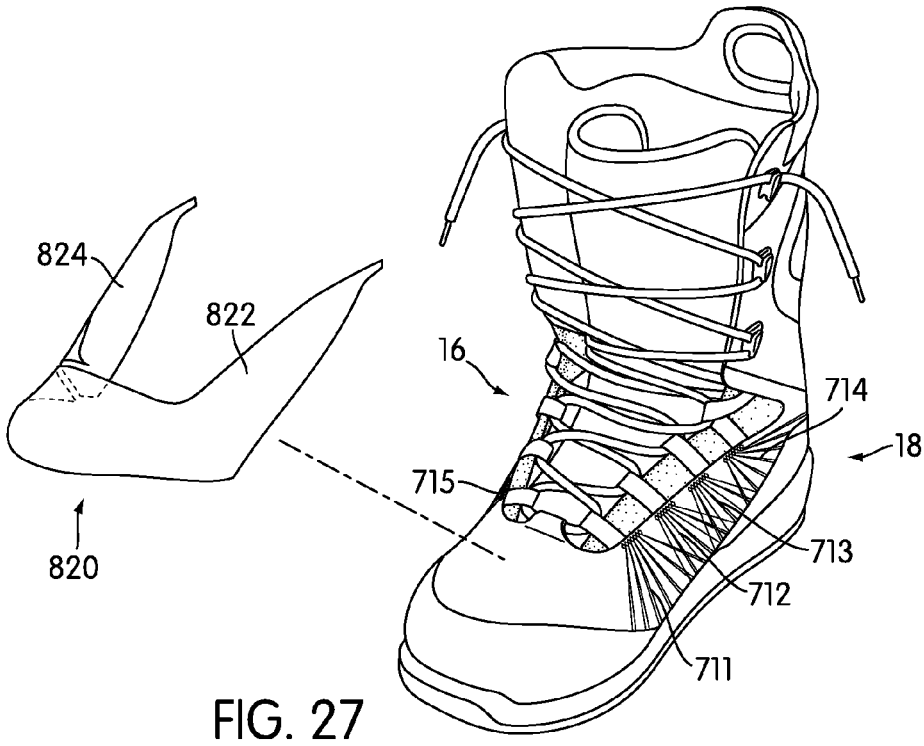
FIG. 27 is an isometric view of another embodiment of an article of footwear including a threading layer and a connecting layer.

FIG. 24 illustrates an embodiment of article 100 during use. Referring to FIG. 24, athlete 780 is sitting on ski lift 790. In this embodiment, athlete 780 is a snowboarder who has brought snowboard 760 onto ski lift 790. Athlete 780 is also wearing a pair of snowboarding boots, including article 100.

In some cases, athlete 780 may rest a portion of snowboard 760 on article 100 to help support snowboard 760 during the trip on ski lift 790. In particular, athlete 780 may rest snowboard edge 762 on article 100. Typically, the most readily available surface for placing snowboard edge 762 is toe portion 750 of upper 102.

In previous designs, toe portion 750 of upper 102 may comprise a traditional upper material such as synthetic leather. In such designs, as snowboard edge 762 is placed against toe portion 750, snowboard edge 762 could potentially scratch, rip, scuff, or otherwise damage toe portion 750, especially after athlete 780 has taken multiple trips on ski lift 790.

In contrast to these previous designs, article 100 may be provided with connecting layer 740 that extends over, and covers, toe portion 750. In particular, the exemplary embodiment includes a substantially clear layer of thermoplastic urethane (TPU) that provides a protective layer for toe portion 750. With this arrangement, snowboard edge 762 may scratch, scuff or otherwise damage connecting layer 740 without damaging base layer 702 of upper 102. Furthermore, since connecting layer 740 is substantially transparent, the appearance of toe portion 750 is not substantially changed as connecting layer 740 is deformed.

In different embodiments, the overall shape of connecting layer 740 can vary. In addition, in different embodiments connecting layer 740 can extend to different portions of upper 102. Furthermore, in other embodiments, multiple connecting layers can be used, rather than one single connecting layer.

Figure 23:
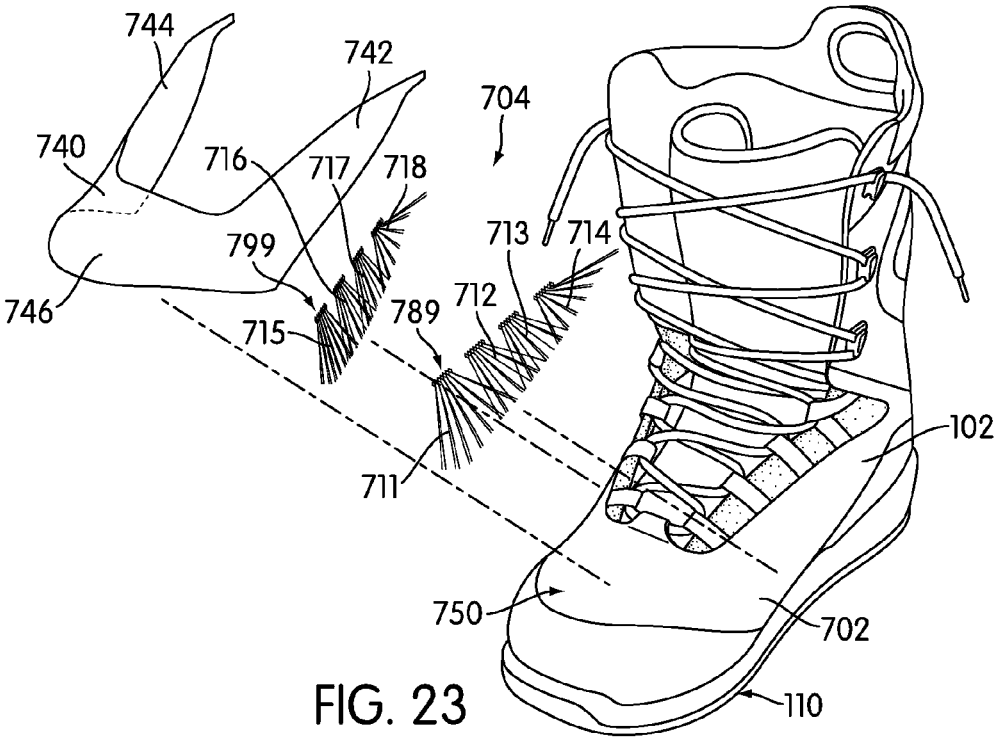
FIG. 23 is an exploded isometric view of an exemplary embodiment of an article of footwear including a threading layer and a connecting layer.

FIGS. 25 through 28 illustrate additional embodiments for an article with one or more connecting layers disposed on an upper. Referring to FIGS. 25 through 28, article 100 can be provided with threading layer 704, as discussed in the previous embodiment. In particular, threading layer 704 can include a plurality of thread groups, including first thread group 711, second thread group 712, third thread group 713, fourth thread group 714, fifth thread group 715, sixth thread group 716, seventh thread group 717 and eighth thread group 718. For purposes of illustration, fifth thread group 715, sixth thread group 716, seventh thread group 717 and eighth thread group 718 are not shown in FIGS. 25 through 28, but are visible in FIG. 23.

In one embodiment, article 100 can be provided with connecting layer 782. In some embodiments, connecting layer 782 may be a substantially transparent polymer layer. In an exemplary embodiment, connecting layer 782 may be a TPU layer. Connecting layer 782 may be provided with first side 784 and second side 786. In addition, connecting layer 782 can include forward portion 788 that is associated with toe portion 750 of upper 102.

In some cases, connecting layer 782 can have a shape that conforms to the shape of first thread group 711, second thread group 712, third thread group 713, fourth thread group 714, fifth thread group 715, sixth thread group 716, seventh thread group 717 and eighth thread group 718. In particular, first side 784 of connecting layer 782 can include interior medial edge 785 that includes first gap 791, second gap 792 and third gap 793 corresponding to first thread gap 801, second thread gap 802 and third thread gap 803. Likewise, second side 786 of connecting layer 782 can include interior lateral edge 787 that includes fourth gap 794, fifth gap 795 and sixth gap 796 corresponding to thread gaps associated with fifth thread group 715, sixth thread group 716, seventh thread group 717 and eighth thread group 718. With this arrangement, first side 784 and second side 786 of connecting layer 782 can be extended only over those portions of upper 102 associated with threads 700 of threading layer 704.

In some cases, a connecting layer can be divided into multiple separate portions to facilitate manufacturing. For example, referring to FIGS. 26 and 27, first connecting layer 812 can include first portion 814 and second portion 816. First portion 814 is configured to cover first thread group 711, second thread group 712, third thread group 713 and fourth thread group 714. In addition, first portion 814 includes first forward portion 815 that extends to medial side 18 of toe portion 750. Likewise, second portion 816 is configured to cover fifth thread group 715, sixth thread group 716, seventh thread group 717 and eighth thread group 718. In addition, second portion 816 includes second forward portion 817 that extends to lateral side 16 of toe portion 750. With this arrangement, first portion 814 and second portion 816 can be applied separately to medial side 18 and lateral side 16, respectively, of upper 102 during the manufacturing of article 100.

In another embodiment, second connecting layer 820 includes first portion 822 and second portion 824. In some cases, first portion 822 is associated with medial side 18 and toe portion 750 of upper 102. In particular, first portion 822 extends to cover first thread group 711, second thread group 712, third thread group 713 and fourth thread group 714 to help connect threads 700 to base layer 702. In addition, first portion 822 extends into toe portion 750 to help provide additional protection for toe portion 750. In contrast, second portion 824 extends only through lateral side 16 of upper 102. In particular, second portion 824 is disposed over fifth thread group 715, sixth thread group 716, seventh thread group 717 and eighth thread group 718. This arrangement can also help facilitate assembly of article 100 by providing separated portions of a connecting layer to thread groups disposed on opposing medial and lateral sides of upper 102.

Figure 28:
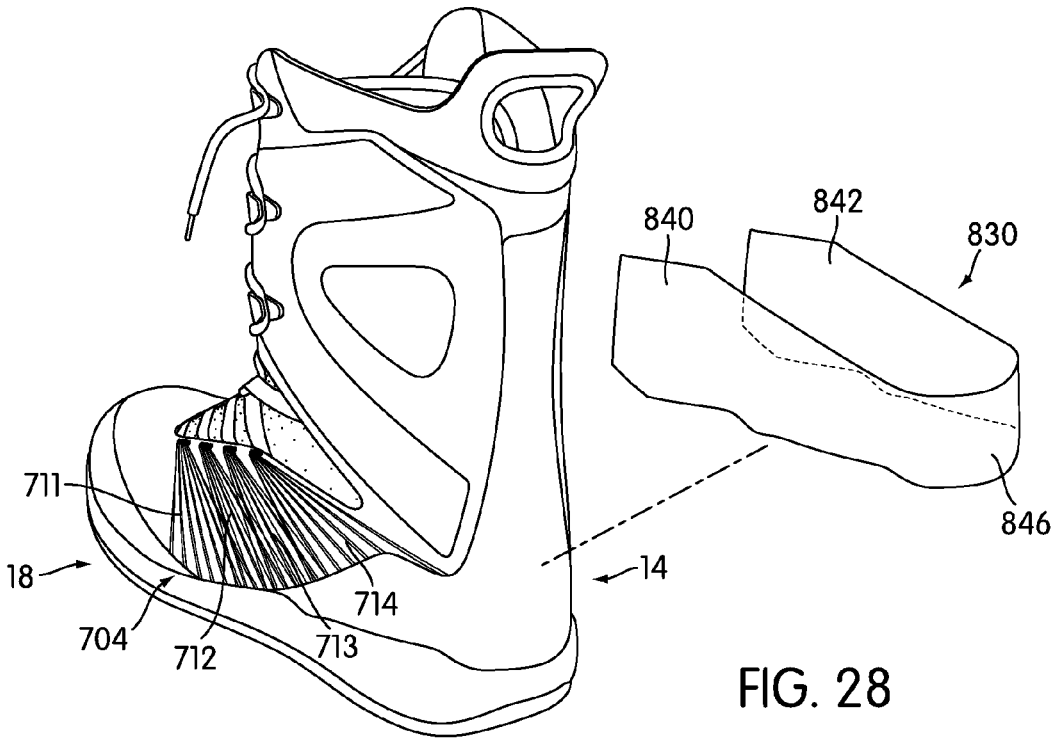
FIG. 28 is an isometric view of another embodiment of an article of footwear including a threading layer and a connecting layer.

In still another embodiment, a connecting layer may be configured to extend to different regions of an upper. As seen in FIG. 28, connecting layer 830 is configured to extend from threading layer 704 to heel portion 14. In particular, connecting layer 830 includes first side portion 840 and second side portion 842. First side portion 840 is associated with medial side 18 and extends over first thread group 711, second thread group 712, third thread group 713 and fourth thread group 714. Likewise, second portion 842 is associated with lateral side 16 and extends over fifth thread group 715, sixth thread group 716, seventh thread group 717 and eighth thread group 718 (see FIG. 27). In addition, connecting layer 830 includes rearward portion 846 that is associated with heel portion 14 of article 100. In particular, rearward portion 846 may cover portions of upper 102 corresponding to the heel of a foot. In some embodiments, rearward portion 846 may further extend to cover portions of upper 102 corresponding to the ankle of the foot.

In still other embodiments, other arrangements for a connecting layer are possible. For example, in one embodiment, a connecting layer may be restricted to covering threads of a threading layer. In another embodiment, a connecting layer may also extend from thread groups on sides of an upper down to a lower peripheral edge of the upper that is associated with a sole structure.

An article can include provisions for supporting a portion of a foot. In some cases, an article can include a heel counter. In other cases, an article can include an ankle counter. In an exemplary embodiment, an article can include a heel counter that extends through the heel and ankle portions of an upper.

Figure 29:
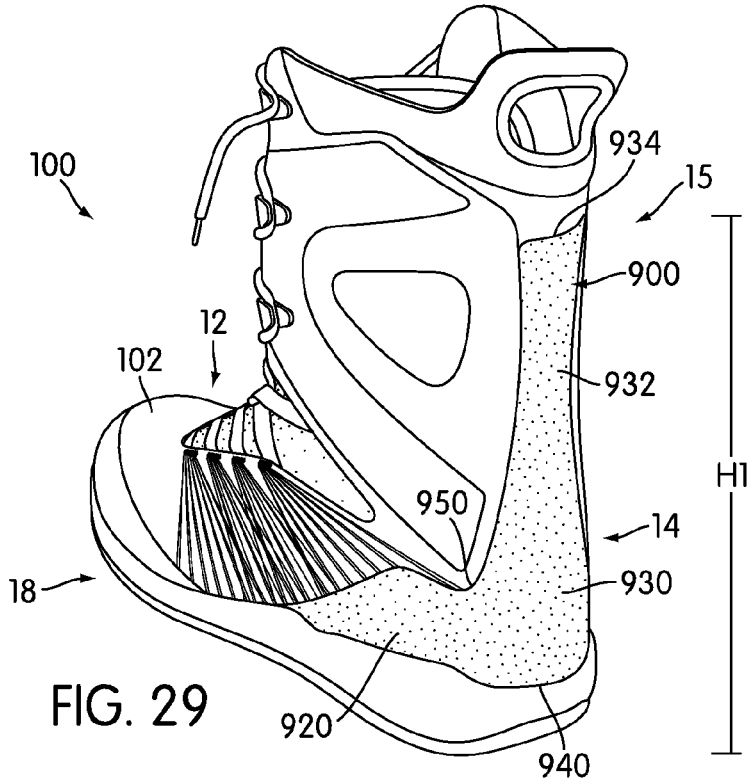
FIG. 29 is a rear isometric view of an exemplary embodiment of an article of footwear including a rear foot support.
Figure 30:
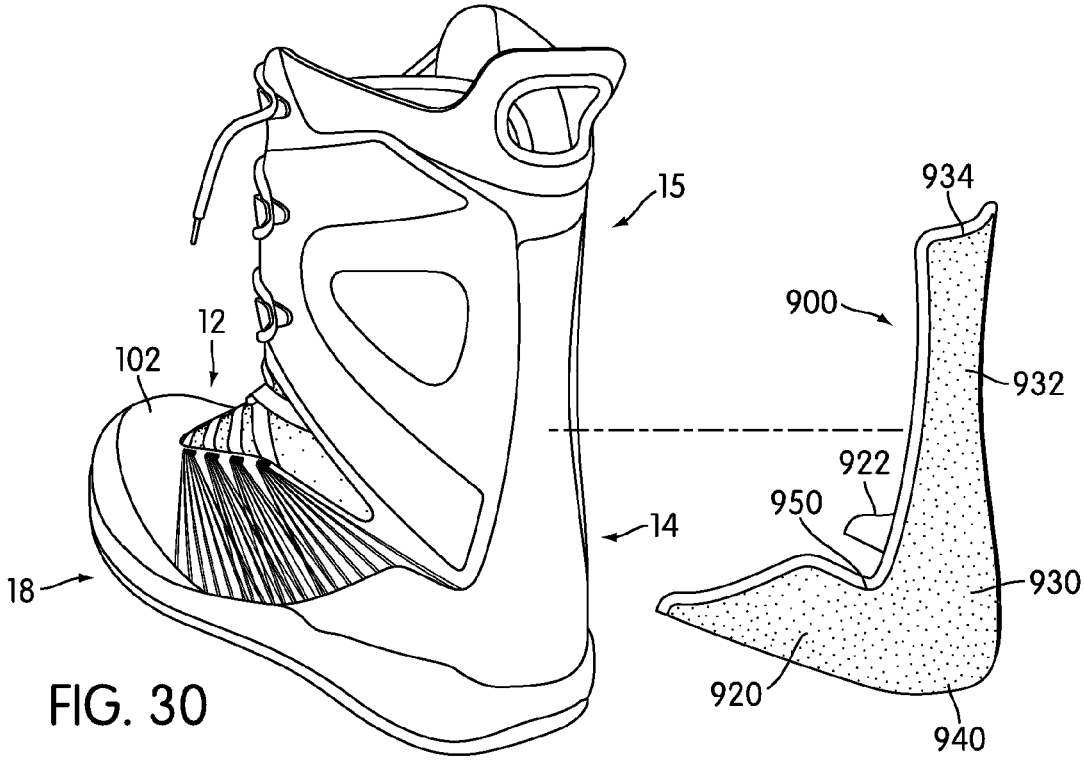
FIG. 30 is an exploded rear isometric view of an exemplary embodiment of an article of footwear including a rear foot support.

FIGS. 29 and 30 illustrate exemplary embodiments of an article of footwear including an extended heel counter. In particular, FIG. 29 illustrates a rear isometric view of an exemplary embodiment of an article with an extended heel counter and FIG. 30 illustrates an exploded rear isometric view of an exemplary embodiment of an article with an extended heel counter. Referring to FIGS. 29 and 30, upper 102 includes extended heel counter 900. In an exemplary embodiment, extended heel counter 900 may be associated with heel portion 14 of article 100. In particular, extended heel counter 900 may extend through heel portion 14 as well as ankle portion 15 of article 100.

Traditionally, a heel counter may be disposed internally to an article. In addition, a heel counter may be integrally formed with a sole. In contrast to the traditional design, however, extended heel counter 900 may be attached to upper 102. Furthermore, extended heel counter 900 may be disposed externally on article 100. With this arrangement, extended heel counter 900 can provide increased protection for a heel and/or ankle of article 100.

In some embodiments, extended heel counter 900 may include base portion 930 and upper portion 932. In some cases, base portion 930 may be disposed adjacent to a heel, while upper portion 932 may be disposed adjacent to an ankle of the foot. In particular, base portion 930 may include first side portion 920 and second side portion 922, which extend in a generally longitudinal direction. In some cases, first side portion 920 may be associated with medial side 18 of upper 102. In particular first side portion 920 may extend from heel portion 14 towards midfoot portion 12 of upper 102 on medial side 18. In addition, second side portion 922 may be associated with lateral side 16 of upper 102. In particular, second side portion 922 may extend from heel portion 14 towards midfoot portion 12 of upper 102 on lateral side 16. With this arrangement, extended heel counter 900 can also provide protection for the sides of an ankle during use.

In some embodiments, upper portion 932 may extend away from base portion 930. In some cases, upper portion 932 may extend in a substantially vertical direction from base portion 930. In particular, upper portion 932 includes end portion 934 that is disposed on upper portion 106 of upper 102.

In different embodiments, the height of extended heel counter 900 can vary. In one embodiment, end portion 934 may be disposed at height H1 above a bottom surface 940 of sole structure 110. In some cases, height H1 may have a value in the range between 100 and 400 millimeters. In other cases, height H1 may have a value in the range between 200 and 300 millimeters. In an exemplary embodiment, height H1 may have a value of approximately 283 millimeters.

An extended heel counter can include provisions to enhance flexibility. In one embodiment, extended heel counter 900 can be provided with one or more flex notches. In an exemplary embodiment, extended heel counter 900 includes first flex notch 950. In some cases, first flex notch 950 may be disposed on medial side 18 of extended heel counter 900. In particular, first flex notch 950 may be disposed between base portion 930 and upper portion 932 of extended heel counter 900 on medial side 18. In a similar manner, extended heel counter 900 can include a second flex notch (not shown). In some cases, the second flex notch may be disposed on lateral side 16 of extended heel counter 900. In particular, the second flex notch may be disposed between base portion 930 and upper portion 932 of extended heel counter 900 on lateral side 16.

In different embodiments, the materials comprising extended heel counter 900 can vary. For example, in some cases extended heel counter 900 can be made from similar materials to sole structure 110, including but not limited to: elastomers, siloxanes, natural rubber, other synthetic rubbers, aluminum, steel, natural leather, synthetic leather, or plastics. In other cases, heel counter 900 can be made from similar materials to upper 102 including, but not limited to: nylon, natural leather, synthetic leather, natural rubber or synthetic rubber. In other cases, any suitable knitted, woven or non-woven material can be used to make extended heel counter 900. In an exemplary embodiment, the materials chosen for extended heel counter 900 may be selected to achieve increased rigidity over other regions of article 100, especially other regions of upper 102.

Figure 31:
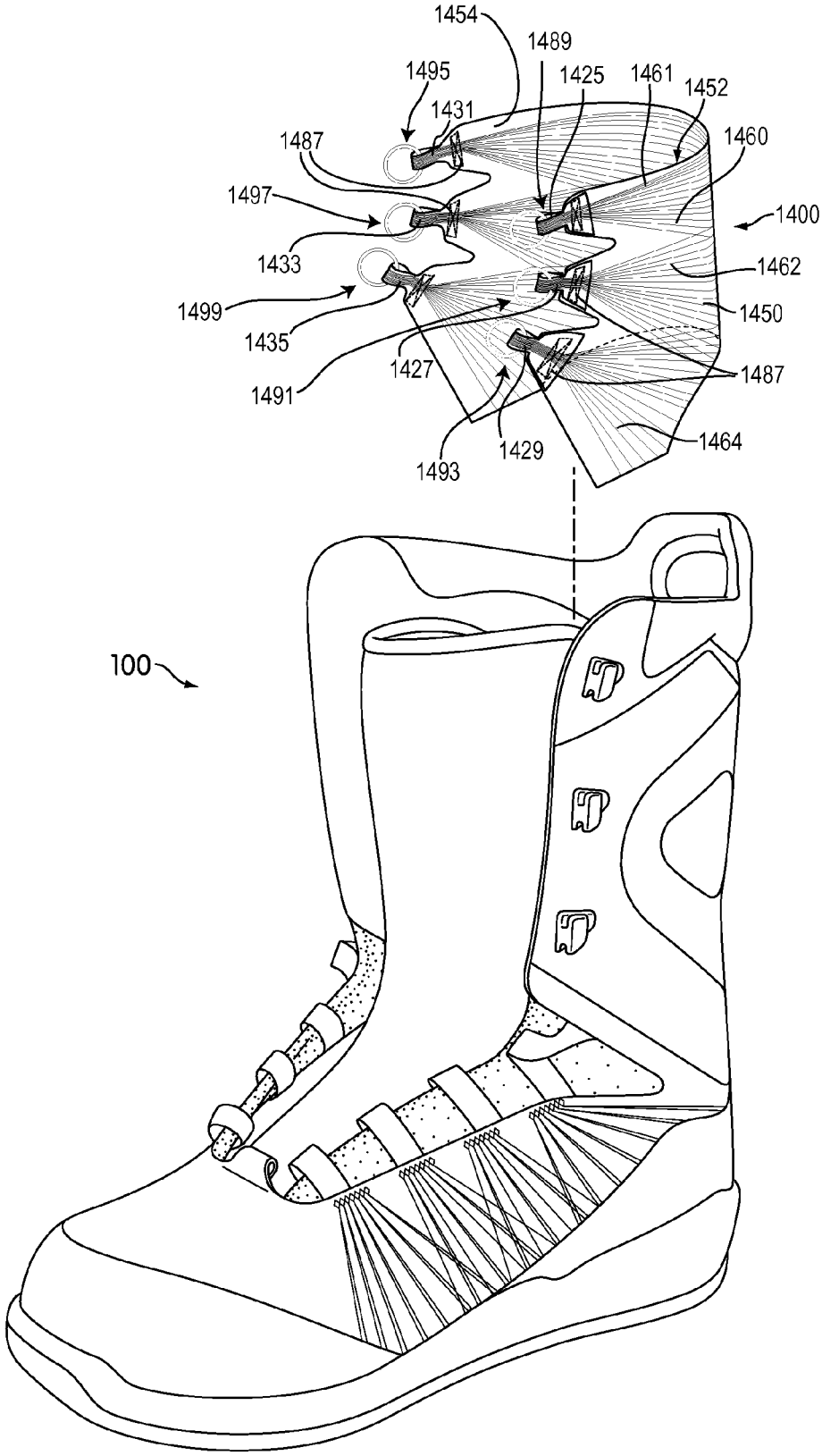
FIG. 31 is an exploded isometric view of another exemplary embodiment of an article of footwear with a harness.
Figure 32:
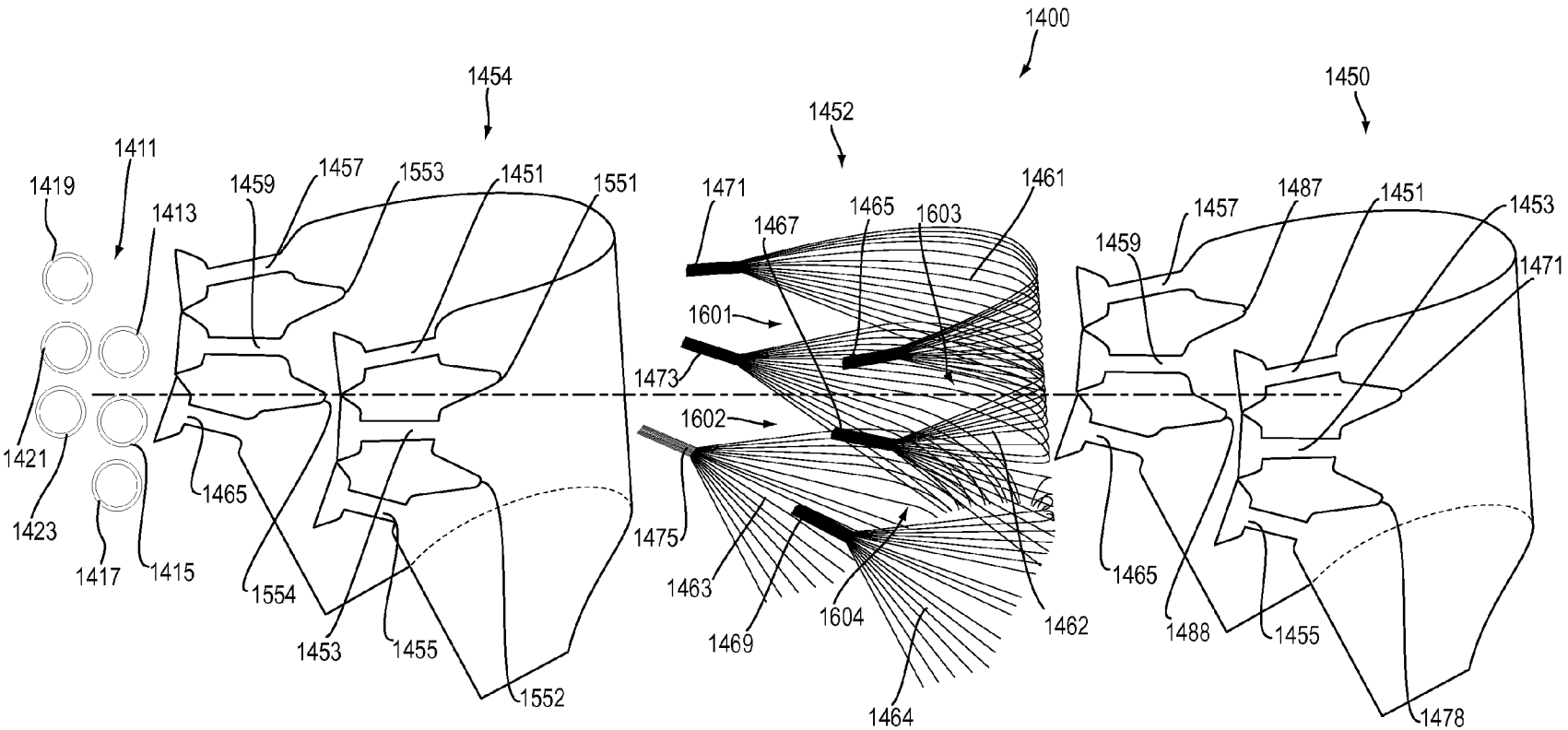
FIG. 32 is an exploded isometric view of another exemplary embodiment of a harness.

FIGS. 31 through 34 illustrate further exemplary arrangements of article 100 having alternative harness configurations. Referring initially to FIGS. 31 and 32, exemplary harness 1400 is shown that generally includes the features and preferences of harness 400 except as described herein. Harness 1400 may comprise base layer 1450, threading layer 1452, peripheral layer 1454 and lacing member connections 1489 to 1499. Peripheral layer 1454 can have a shape that confronts a substantial entirety of base layer 1450 and that corresponds to the notches and tabs of base layer 450 discussed previously along with FIGS. 16 to 18. Further, peripheral layer 1454 can be formed from the same material, or from a substantially similar material, as the material used for base layer 1450, which can enhance the cushioning of harness 1400 and enable it to distribute forces between it and the foot in a generally uniform manner. This can reduce the likelihood of discomfort to the foot related to prolonged use of article 100 or while harness 1400 securely engages the foot. In other embodiments, base layer 1450 and peripheral layer 1454 can be formed from different types of materials to provide specialized characteristics as desired, such as greater cushioning for peripheral layer 1454 disposed against the foot or greater strength for base layer 1450 attached to the interior of upper 102. Further, additional layers can be used beyond the base and peripheral layers described in these example arrangements to provide further beneficial characteristics.

In general, peripheral layer 1454 and base layer 1450, as well as threading layer 1452 disposed proximate base layer 1450 and opposed by peripheral layer 1452, can cooperate to form a resilient harness for effectively transmitting forces between the foot and article 100. Harness 1400 can include a pair of relatively thin opposing layers 1450 and 1454 that can surround a broad network of structural threads 1460, which can enhance the transmission of forces in various directions. As shown, outlines of threads 1460 may be visible via raised tunnel portions of layers 1450 and 1454 formed via the layers conforming to the outlines of the threads.

As shown in FIG. 32, peripheral layer 1454 may include first segment 1551, second segment 1552, third segment 1553 and fourth segment 1554 that are shaped to correspond to the edges of base layer first medial notch 1471, second medial notch 1478, first lateral notch 1487 and second lateral notch 1488 formed in base layer 1450. With this arrangement, first segment 1551 may also correspond to the shape of third thread gap 1603 formed in threading layer 1452. In other words, first segment 1551 may be disposed between first thread group 1461 and second thread group 1462. Likewise, second segment 1552 may correspond to the shape of fourth thread gap 1604. In other words, second segment 1552 may be disposed between second thread group 1462 and fourth thread group 1464. Additionally, third segment 1553 may correspond to the shape of first thread gap 1601. In other words, third segment 1553 may be disposed between first thread group 1461 and second thread group 1462. Finally, fourth segment 1554 may correspond to the shape of second thread gap 1602. In other words, fourth segment 1554 may be disposed between second thread group 1462 and third thread group 1463.

This arrangement of peripheral layer 1454 and base layer 1450 can provide a resilient harness having a generally uniform thickness for affording even pressure and cushioning against the foot during use along with high strength and flexibility characteristics, such as described previously along with harness 400. Likewise, such an arrangement can provide a durable configuration of structural threads for effectively transmitting forces between the foot and article 100 via the harness. As noted above, in some previous designs, threads have been attached to portions of a base layer without reinforcing the threads via use of an opposing layer, which can affect the durability and useful life of such designs due to delamination of the threads. In contrast, the current arrangement includes provisions for reinforcing the attachment of the threads to the harness by applying a peripheral layer over the threads to secure them in place with the base layer. Peripheral layer 1454 can do so along the substantial entirety of the base layer and the network of threads disposed there on. Such a reinforced arrangement can enhance the strength and durability of the thread connections, as well as improve the overall resiliency of the harness. In addition, as discussed below, such an arrangement can provide for robust lacing member connections via threads providing structural reinforcement for the lacing loops.

Harness 1400 can be constructed to minimize the presence of superfluous material while still providing a thin, high-strength, flexible harness that can impart generally uniform pressure and cushioning against the foot during use. Base layer 1450 and peripheral layer 1454 can provide a large surface area for wrapping around the foot while being relatively thin to exhibit a low overall mass. In addition, some of the thread groups of first thread group 1461, second thread group 1462, third thread group 1463 and fourth thread group 1464 can be arranged to provide stretch resistance in predetermined directions to allow the harness have a low mass while maintaining needed strength in those directions. Moreover, the number of threads 1460 can be selected to impart a desired amount of stretch resistance to the harness. In addition, some of the thread groups of first thread group 1461, second thread group 1462, third thread group 1463 and fourth thread group 1464 can be located to reinforce specific areas of harness 1400. As such, the orientations, locations and quantities of threads 1460 can be selected to provide structural elements for harness 1400 that are tailored for specific purposes.

The exemplary arrangement of harness 1400 can include reinforced lacing member connections 1489 to 1499 (FIG. 31), which can be formed via looped tab extensions extending from the base and peripheral layers that retain rigid lace receiving members, such as lace-receiving hoops 1411 (FIG. 32). Tab extensions 1451 to 1461 extending from the stacked base and peripheral layers along with thread extensions 1465 to 1475 extending from the ends of the thread groups can be folded over or looped lengthwise through lace-receiving hoops to provide structurally reinforced lace-receiving members. The corresponding tab extensions of the base and peripheral layers along with respective thread extensions can form stacks of robust support materials for securely connecting the lace-receiving members to the harness. Such a configuration can create robust, yet resilient, lacing member connections 1489 to 1499 shown in FIG. 31. The stacks of supports can each be folded over or looped back to attach to one or more of the fabric layers via stitching 1487 or another attachment mechanism, such as an adhesive bond. However, a stitched connection can engage all layers of the stack including the end portions of threads 1460 and, thus, provide high strength lace receiving member connections.

In the exemplary arrangement shown in FIG. 32, first tab extensions 1451 in the base and peripheral layers and first thread extension 1465 can form a stack of support materials that is looped through first lace-receiving hoop 1413. This stack of support materials can be stitched to one or more of the harness layers to create a reinforced first lace connection tab 1425. Similarly, second tab extensions 1453 and second thread extensions 1467 can loop through second lace-receiving hoop 1415 and be stitched to create a reinforced second lace connection tab 1427, and third tab extensions 1455 and third thread extensions 1469 can loop through third lace-receiving hoop 1417 and be stitched to create a reinforced third lace connection tab 1429. Likewise, fourth tab extensions 1457 and fourth thread extensions 1471 can loop through fourth lace-receiving hoop 1419 and be stitched to create a reinforced fourth lace connection tab 1431; fifth tab extensions 1459 and fifth thread extensions 1473 can loop through fifth lace-receiving hoop 1421 and be stitched to create a reinforced fifth lace connection tab 1433; and sixth tab extensions 1461 and sixth thread extensions 1475 can loop through sixth lace-receiving hoop 1423 and be stitched to create a reinforced sixth lace connection tab 1435.

Lace-receiving hoops 1411 retained by the lace connection tabs can provide a robust configuration for securing the harness to the foot. The lace-receiving hoops 1411 can be formed from a relatively rigid material, such as a metal or polymeric material, or combinations of materials, such as a rigid base material and a less rigid cover material. A rigid material can distribute tensile forces to most or all of the corresponding thread group and permit harness 1400 to be more effectively secured than may be provided by other types of lacing member connections. In embodiments where lace-receiving hoops 1411 comprise a metal material, various types of metals or metal alloys could be used, such as, for example, materials including stainless steel, iron or aluminum. In embodiments where lace-receiving hoops 1411 comprise a polymeric material, the lace-receiving hoops could be formed from a wide variety of polymers. Examples of different types of polymers could include synthetic polymers, or plastics, such as thermoplastics, thermosets and elastomers. Some examples of thermoplastics include, but are not limited to: acrylonitrile butadiene styrene (ABS), acrylic (PMMA), celluloid, cellulose acetate, ethylene-vinyl acetate (EVA), ethylene vinyl alcohol (EVOH), fluoroplastics (PTFE), ionomers, Kydex, liquid crystal polymer (LCP), polyacetal (POM or Acetal), polyacrylates (Acrylic), polyacrylonitrile (PAN or Acrylonitrile), polyamide (PA or Nylon), polyamide-imide (PAI), polyaryletherketone (PAEK or Ketone), polybutadiene (PBD), polybutylene (PB), polybutylene terephthalate (PBT), polycaprolactone (PCL), polychlorotrifluoroethylene (PCTFE), polyethylene terephthalate (PET), polycyclohexylene dimethylene terephthalate (PCT), polycarbonate (PC), polyhydroxyalkanoates (PHAs), polyketone (PK), polyester, polyethylene (PE), polyetheretherketone (PEEK), polyetherimide (PEI), polyethersulfone (PES), polyethylenechlorinates (PEC), polyimide (PI), polylactic acid (PLA), polymethylpentene (PMP), polyphenylene oxide (PPO), polyphenylene sulfide (PPS), polyphthalamide (PPA), polypropylene (PP), polystyrene (PS), polysulfone (PSU), polytrimethylene terephthalate (PTT), polyurethane (PU), polyvinyl acetate (PVA), polyvinyl chloride (PVC), polyvinylidene chloride (PVDC), styrene-acrylonitrile (SAN) as well as other types of thermoplastic. In embodiments where lace-receiving hoops 1411 comprise combinations of materials, the lace-receiving hoops could be formed from a wide variety of base materials, such as from a rigid metal or metal alloy covered by a less rigid polymeric material, or from a rigid base material such as iron having a covering such as a galvanic coating, powder coating or paint.

Harness 1400 can provide high-strength lacing member connections via its thread-reinforced looped-tab configuration, as well as a resilient and comfortable cradle that can wrap around the foot and distribute forces encountered during use generally evenly against the foot. The use of lace-receiving hoops 1411 can permit the user to tighten the harness under greater tension than can typically be applied comfortably to a harness configuration having other types of lacing member connections, such as flexible lace loops or apertures formed through fabric. The lace-receiving hoops can also allow the user to tighten the harness much more quickly than can typically be accomplished via a configuration having other types of lacing member connections including lace hooks. In the exemplary configuration shown in FIGS. 31 and 32, lace-receiving hoops have a circular configuration, which can allow the lacing member to retain the harness quickly and securely with a variety of lace-receiving hoop orientations that can conform to particular user characteristics such as the shape and size of the user's ankle. However, lace-receiving hoops 1411 can form other shapes, such as shapes having particular directional characteristics like oval, rectangular or triangular hoops that can have rounded corners to avoid pinching the lacing member or forming stress concentrations in the lacing member.

The lace-receiving hoop configurations shown in the exemplary arrangement can permit the user to bind harness 1400 about the foot at the heel and ankle locations quickly and securely, which can be significant portions of the foot often used when maneuvering a snowboard or other object attached to article 100. The exemplary arrangement can permit lace-receiving hoops 1411 to have significant orientation flexibility within the looped tab connections attaching them to the harness such that they can rotate several degrees in the medial and lateral directions as needed. This can permit lace-receiving hoops 1411 to conform to the particular configuration and size of the user's foot and to engage it tightly in a comfortable manner.

Harness 1400 shown in FIGS. 31 and 32 includes an arrangement of threads similar to the arrangements shown in FIGS. 13-21 along with having the generally uniform peripheral layer 1454 noted above. Such an arrangement can provide structural reinforcement to the harness in many different directions while comfortable distributing forces along the harness. The versatile and multi-directional structural reinforcement provided by the threads can be desirable for certain uses and types of footwear articles, such as footwear for sports requiring a wide variety of differing maneuvers or footwear for use by skilled athletes of particular sports. However, it is understood that a variety of thread arrangements can be used as desired, which can be varied according to factors such as the intended use of article 100 including the type of sport, skill of the user, special needs of the user, cost considerations for article 100, and design considerations such as configuration options for the base and peripheral layers. For the exemplary arrangement shown in FIGS. 31 and 32, a substantial majority of the surface area of base layer 1450 can be reinforced via threads 1460 in order to enhance greatly the overall strength of harness 1400 to do so in many directions. As discussed along with FIG. 34, thread configurations can be selected for specific types and uses of article 100 or to provide other advantages, such as a low mass harness.

Figure 33:
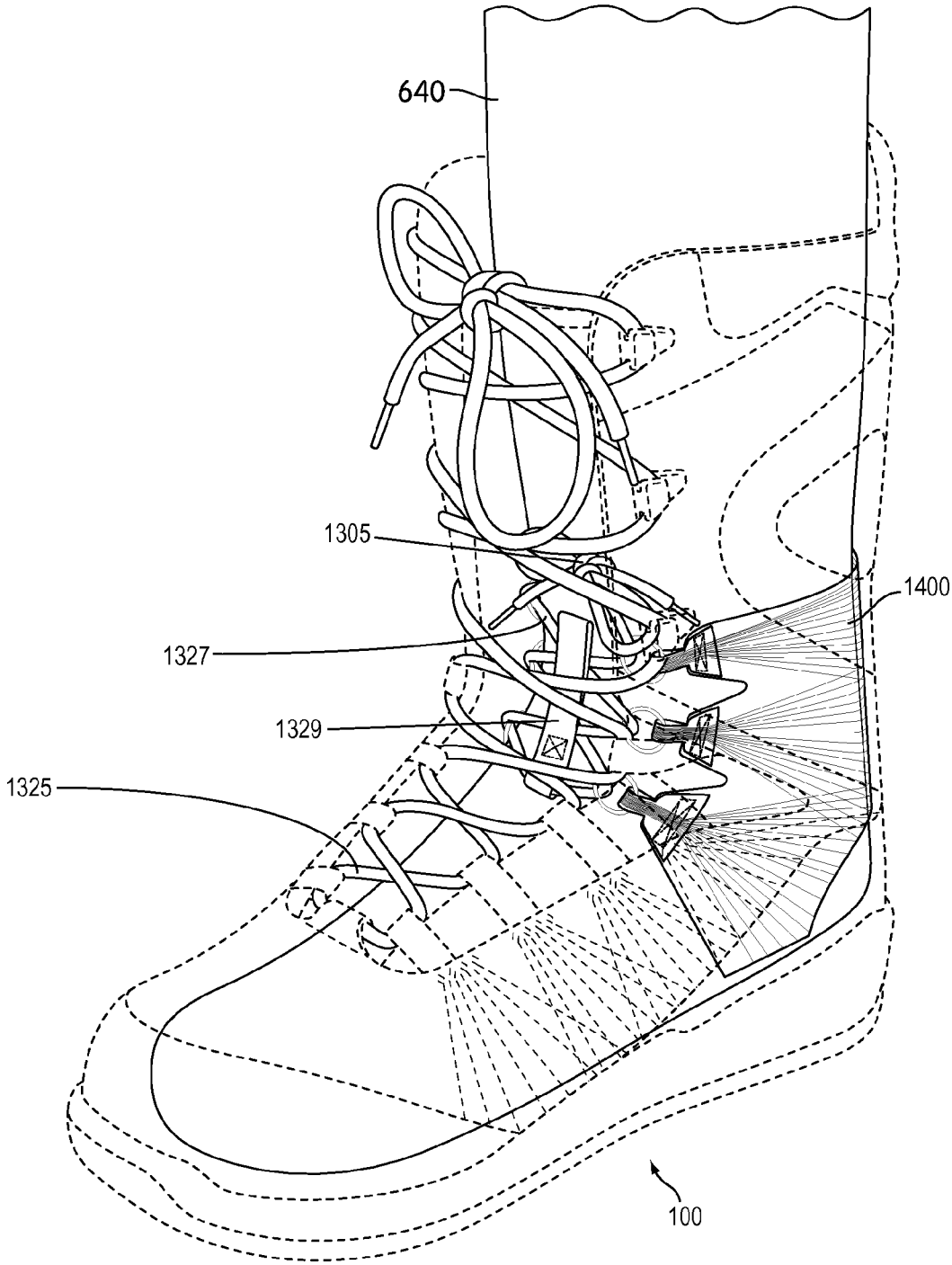
FIG. 33 is an isometric view of an another exemplary embodiment of an article of footwear shown with a harness tightened around a foot.

Referring now to FIG. 33, harness 1400 is shown in a dual lacing member arrangement that includes an outer lacing member 1325 and an inner lacing member 1327. Inner lacing member 1327 can secure harness 1400 about the foot separately from outer lacing member 1325. This can ensure a highly secure connection between the foot and harness 1400 that is less affected by usage variations or deficiencies in the tension of outer lacing member 1325. Further, the dual lacing member arrangement can allow article 100 to be loosely secured about the foot by outer lacing member 1325 as desired by the user for a more comfortable fit, while still providing a firm connection between the harness and foot via more securely retained inner lacing member 1327. This can allow the user to maintain significant control of the snowboard or other object during use in a comfortable and secure manner, which can often be largely provided by movements of the heel and ankle portions of the foot engaged by the harness.

As shown in FIG. 33, a quick release tab 1329 can also be provided to allow the user to pull inner lacing member 1327 to assist with quickly releasing harness tension about the foot, which may be provided without the user needing to modify significantly the tension of the outer lacing member. This can be beneficial for releasing pressure on the foot when unnecessary, such as between snowboard runs or when the snowboard or other object has been disconnected from article 100. It is understood that quick release fittings (not shown), such as spring-loaded ratchet fittings or other quick release lacing mechanisms, could also be used along with quick release tab 1329 instead of the manual tie 1305 illustrated in FIG. 33.

Figure 34:
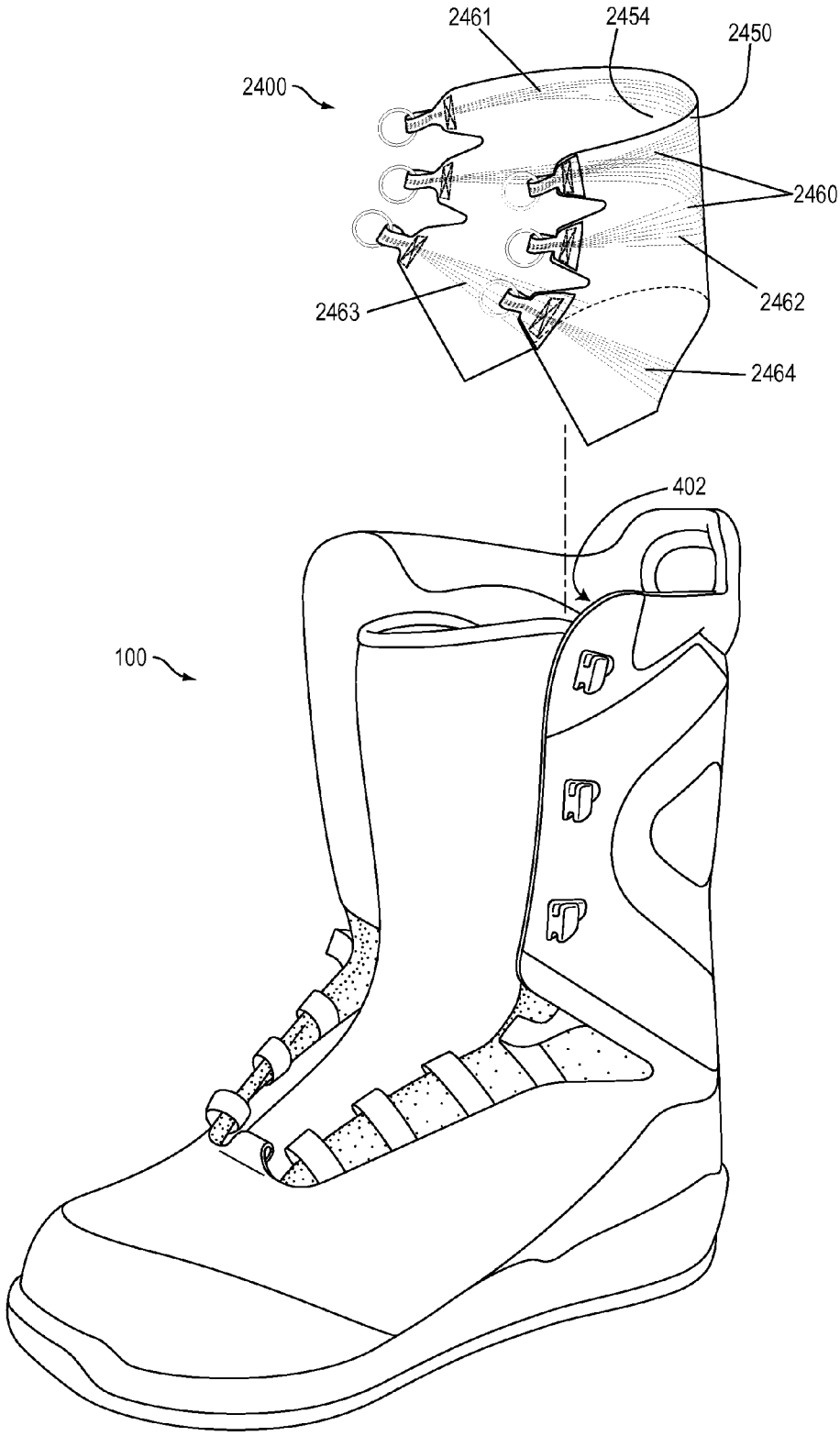
FIG. 34 is an exploded isometric view of yet another exemplary embodiment of an article of footwear with a harness.

Referring now to FIG. 34, an alternative harness 2400 is shown having fewer threads 2460, and threads disposed in fewer orientations, than those for harness 1400 illustrated in FIGS. 31-33. Although they are fewer in number and orientation, threads 2460 can be selectively arranged to provide secure retention in desired directions for the most often encountered uses of article 100. Other than the quantity and orientations of threads or corresponding mass reductions in the base and peripheral layers, harness 2400 is generally the same as harness 1400.

As shown in the exemplary arrangement, threads 2460 can be oriented to provide high tensile strength in directions of primary need for a given use or sport while otherwise keeping small the mass of harness 2400. For instance, upper thread group 2461 and middle thread group 2462 can wrap around the back of the foot proximate the Achilles tendon, which can provide tensile force for retaining the rear wall 402 of upper 102 against the back of the foot just above the heel during many common maneuvers. This can allow movement of the foot to be quickly transmitted to the snowboard when the user executes a common toe turn, which can include rocking forward or curling the toes while raising the heel. This can be accomplished via tensile forces being transmitted through thread groups 2461 and 2462 to article 100 and then to the snowboard. Of course, reverse movements of the snowboard due to contact with slopes can likewise be transmitted via threads groups 2461 and 2462 to the foot, which the user would likely counteract in a similar manner via tension along thread groups 2461 and 2462.

Similarly, the medial or lateral sides of thread groups 2461 and 2462 can transmit corresponding tensile forces when the user twists the foot in the lateral or medial directions to execute other manuevers. In a like manner, the diagonal orientation of thread groups 2463 and 2464 extending along the harness from the heel of article 100 can efficiently transmit tensile forces to the snowboard or other device when the user leans forward or backward during maneuvers or when the user rocks the foot laterally about the longitudinal axis of the foot. Thus, although the thread groups can be relatively small in quantity and the numbers of orientations, they can be arranged to transmit the forces most often encountered during the primary control movements of the foot in an efficient and robust manner.

Further, harness 2400 can be reinforced in other directions via varying thread quantities, orientations and configurations according to the primary movements anticipated for article 100, or as desired by a user, to transmit effectively the encountered tensile forces while minimizing the presence of superfluous material. As such, a relatively thin base layer 2450 and peripheral layer 2454 can be used with a small number of appropriately oriented threads 2460 to provide a robust harness 2400 having a low mass that distributes forces well to the foot.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

a harness, the harness including a base layer and a threading layer, the threading layer configured to attach to the base layer;

the threading layer comprising threads arranged in a first thread group and a second thread group;

the first thread group including a first end portion and a second end portion, wherein the threads extend radially outward from the first end portion to the second end portion;

the second thread group including a third end portion and a fourth end portion, wherein the threads extend radially outward from the third end portion to the fourth end portion;

the first end portion of the first thread group being substantially spaced apart from the third end portion of the second thread group by a thread gap;

wherein the base layer includes a notch associated with the thread gap;

wherein the base layer includes a tab portion;

the harness further comprising:

a peripheral layer configured to oppose the threading layer, the peripheral layer having a tab portion configured to oppose the base layer tab portion and at least one of the first end portion, the second end portion, the third end portion, and the fourth end portion; and a lace connection loop formed by the base layer tab portion, the peripheral tab portion and at least one of the first end portion, the second end portion, the third end portion, and the fourth end portion arranged generally in a stack having a length, the stack folded over along its length to form a loop portion and attached to at least one of the base layer and the peripheral layer.

2. The article of footwear according to claim 1, wherein the thread gap has a substantially triangular shape.

3. The article of footwear according to claim 2, wherein the notch has a similar substantially triangular shape to the thread gap.

4. The article of footwear according to claim 1, wherein the first end portion and the third end portion are fixedly attached to the base layer.

5. The article of footwear according to claim 4, wherein the first end portion is associated with a first lace connection loop of the harness and wherein the third end portion is associated with a second lace connection loop of the harness.

6. The article of footwear according to claim 5, wherein the notch of the base layer is disposed between the first lace connection loop and the second lace connection loop.

7. An article of footwear, comprising:

a harness, the harness including a base layer and a threading layer, the threading layer configured to attach to the base layer;

the threading layer comprising threads arranged in a first thread group and a second thread group;

the first thread group including a first end portion and a second end portion, wherein the threads extend radially outward from the first end portion to the second end portion;

the second thread group including a third end portion and a fourth end portion, wherein the threads extend radially outward from the third end portion to the fourth end portion;

the first thread group including a first side edge extending from the first end portion of the first thread group to the second end portion of the first thread group;

the second thread group including a second side edge extending from the third end portion of the second thread group to the fourth end portion of the second thread group;

the threading layer including a thread gap disposed between the first side edge and the second side edge;

wherein the base layer includes a notch that extends between the first side edge and the second side edge;

wherein the base layer includes a tab portion;

the harness further comprising:

a peripheral layer configured to oppose the threading layer, the peripheral layer having a tab portion configured to oppose the base layer tab portion and at least one of the first end portion, the second end portion, the third end portion, and the fourth end portion; and a lace connection loop formed by the base layer tab portion, the peripheral tab portion and at least one of the first end portion, the second end portion, the third end portion, and the fourth end portion arranged generally in a stack having a length, the stack folded over along its length to form a loop portion and attached to at least one of the base layer and the peripheral layer.

8. The article of footwear according to claim 7, wherein the first end portion of the first thread group is disposed adjacent to a first lace connection loop of the harness.

9. The article of footwear according to claim 8, wherein the second end portion of the second thread group is disposed adjacent to a second lace connection loop of the harness.

10. The article of footwear according to claim 7, wherein the peripheral layer is configured to attach to an outer peripheral portion of the base layer.

11. An article of footwear, comprising:

a harness, the harness including a base layer and a threading layer, the threading layer configured to attach to the base layer;

the harness further including a peripheral layer;

the threading layer comprising a plurality of threads arranged in a thread group;

the thread group including an end portion disposed adjacent to an edge of the base layer;

wherein the threads of the end portion are disposed between the peripheral layer and the base layer;

wherein the base layer includes a tab portion;

wherein the peripheral layer is configured to oppose the threading layer, the peripheral layer having a tab portion configured to oppose the base layer tab portion and the thread group end portion; and a lace connection loop formed by the base layer tab portion, the peripheral tab portion and the thread group end portion arranged generally in a stack having a length, the stack folded over along its length to form a loop portion and attached to at least one of the base layer and the peripheral layer.

12. The article of footwear according to claim 11, wherein the end portion of the thread group is fixedly attached to the base layer.

13. The article of footwear according to claim 11, wherein the end portion of the thread group is stitched to the base layer.

14. The article of footwear according to claim 11, wherein the harness includes a plurality of thread groups and wherein each thread group includes at least one end portion associated with a tab portion of the peripheral layer.

15. An article of footwear, comprising:

a harness comprising:

a base layer having a tab portion;

a threading layer attached to the base layer, the threading layer comprising a plurality of threads arranged in a thread group, the thread group having an end portion extending adjacent the base layer tab portion;

a peripheral layer configured to oppose the threading layer, the peripheral layer having a tab portion configured to oppose the base layer tab portion and the thread group end portion; and a lace connection loop formed by the base layer tab portion, the peripheral tab portion and the thread group end portion arranged generally in a stack having a length, the stack folded over along its length to form a loop portion and attached to at least one of the base layer and the peripheral layer.

16. The article of footwear according to claim 15, wherein the end portion of the thread group generally extends the length of the stack and is fixedly attached to the at least one of the base layer and the peripheral layer.

17. The article of footwear according to claim 16, wherein the end portion of the thread group is stitched to the at least one of the base layer and the peripheral layer.

18. The article of footwear according to claim 16, wherein a longitudinal end portion of the stack is stitched to the at least one of the base layer and the peripheral layer.

19. The article of footwear according to claim 16, wherein the harness further comprises a lace-receiving hoop retained by the loop portion.

20. The article of footwear according to claim 19, wherein the lace-receiving hoop is formed from a rigid material.

21. The article of footwear according to claim 20, wherein the lace-receiving hoop further comprises a flexible material covering the rigid material.

22. The article of footwear according to claim 20, wherein the lace-receiving hoop comprises an elastomeric material.

23. The article of footwear according to claim 20, wherein the lace-receiving hoop has a circular shape.

24. The article of footwear according to claim 15, wherein the harness further comprises a plurality of thread groups and wherein each thread group includes at least one end portion associated with a tab portion of the peripheral layer and a corresponding tab portion of the base layer together arranged in a folded over stack forming a loop portion.

25. The article of footwear according to claim 24, wherein the harness further comprises a plurality of lace-receiving hoops each retained by a corresponding one of the loop portions.

26. The article of footwear according to claim 15, further comprising a first lacing member configured to secure an upper to a foot and a second lacing member separate from the first lacing member configured to secure the harness to the foot.

27. The article of footwear according to claim 26, wherein the harness further comprises a quick release tab.

28. The article of footwear according to claim 27, wherein the quick release tab comprises a tab attached to a lower portion of the second lacing member.

* * * * *